US010833463B2

(12) United States Patent
Tsai

(10) Patent No.: US 10,833,463 B2
(45) **Date of Patent: *Nov. 10, 2020**

(54) ELECTRONIC DEVICE HAVING LOW-HEIGHT DUPLEX ELECTRICAL CONNECTION PLUG ADAPTED TO DUPLEX ELECTRICAL CONNECTION STRUCTURE

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/166,433

(22) Filed: Oct. 22, 2018

(65) Prior Publication Data

US 2019/0058298 A1 Feb. 21, 2019

Related U.S. Application Data

(62) Division of application No. 15/321,373, filed as application No. PCT/CN2015/082256 on Jun. 24, 2015, now Pat. No. 10,109,966.

(30) Foreign Application Priority Data

Jun. 24, 2014 (CN) ..... 2014 2 0341035 U
Sep. 19, 2014 (CN) ..... 2014 2 0541444 U
Feb. 17, 2015 (CN) ..... 2015 2 0114091 U

(51) Int. Cl.
*H01R 24/00* (2011.01)
*H01R 33/00* (2006.01)
(Continued)

(52) U.S. Cl.
CPC ..... *H01R 24/60* (2013.01); *H01R 13/502* (2013.01); *H01R 13/6581* (2013.01); *H01R 2107/00* (2013.01)

(58) Field of Classification Search
CPC ..... H01R 24/60; H01R 13/6581; H01R 13/65802; H01R 13/6593; H01R 13/642; H01R 13/648
(Continued)

(56) References Cited

U.S. PATENT DOCUMENTS 10,109,966 B2 * 10/2018 Tsai ..... H01R 13/502
2010/0267282 A1 * 10/2010 Tsai ..... H01R 24/60 439/607.17

(Continued)

*Primary Examiner* — Hae Moon Hyeon
(74) *Attorney, Agent, or Firm* — WPAT, PC

(57) ABSTRACT

An electronic device includes a transmission medium and first and second duplex electrical connection plugs. The first duplex electrical connection plug includes: an insulated seat; two terminal sets disposed in the insulated seat; and a metal housing covering the insulated seat and provided with a four-sided primary housing, wherein heights of two contact interface substrates of the second duplex electrical connection plug can be fit with the two spaces of the two connection surfaces of a tongue, and a connection slot of the first duplex electrical connection plug is fit with the tongue. The second duplex electrical connection plug includes: an insulated seat; a metal housing covering the insulated seat; and a fitting portion provided on one end of the insulated seat, wherein heights of two contact interface substrates of the second duplex electrical connection plug can be fit with two spaces of two connection surfaces of another tongue.

23 Claims, 31 Drawing Sheets

(51) Int. Cl.

| | |
|---|---|
| ***H01R 24/60*** | (2011.01) |
| ***H01R 13/502*** | (2006.01) |
| ***H01R 13/6581*** | (2011.01) |
| *H01R 107/00* | (2006.01) |

(58) Field of Classification Search
USPC ..... 439/660, 676, 607.01, 607.55
See application file for complete search history.

(56) References Cited

U.S. PATENT DOCUMENTS

| | | | | |
|---|---|---|---|---|
| 2013/0005193 | A1* | 1/2013 | Tsai | H01R 13/6315 439/676 |
| 2015/0044886 | A1* | 2/2015 | Little | H01R 12/75 439/55 |
| 2016/0149348 | A1* | 5/2016 | Kao | H01R 13/6585 439/607.05 |
| 2016/0204540 | A1* | 7/2016 | Chen | H01R 13/56 439/660 |
| 2017/0040761 | A1* | 2/2017 | Tsai | H01R 24/64 |
| 2017/0194754 | A1* | 7/2017 | Tsai | H01R 13/502 |
| 2017/0279226 | A1* | 9/2017 | Tsai | H01R 13/502 |
| 2017/0294749 | A1* | 10/2017 | Tsai | H01R 24/60 |
| 2018/0026410 | A1* | 1/2018 | Tsai | H01R 13/502 439/607.09 |
| 2018/0097311 | A1* | 4/2018 | Ju | H01R 13/04 |
| 2018/0248323 | A1* | 8/2018 | Tsai | H01R 24/64 |
| 2019/0334298 | A1* | 10/2019 | Tsai | H01R 13/642 |
| 2019/0334299 | A1* | 10/2019 | Tsai | H01R 24/60 |

* cited by examiner

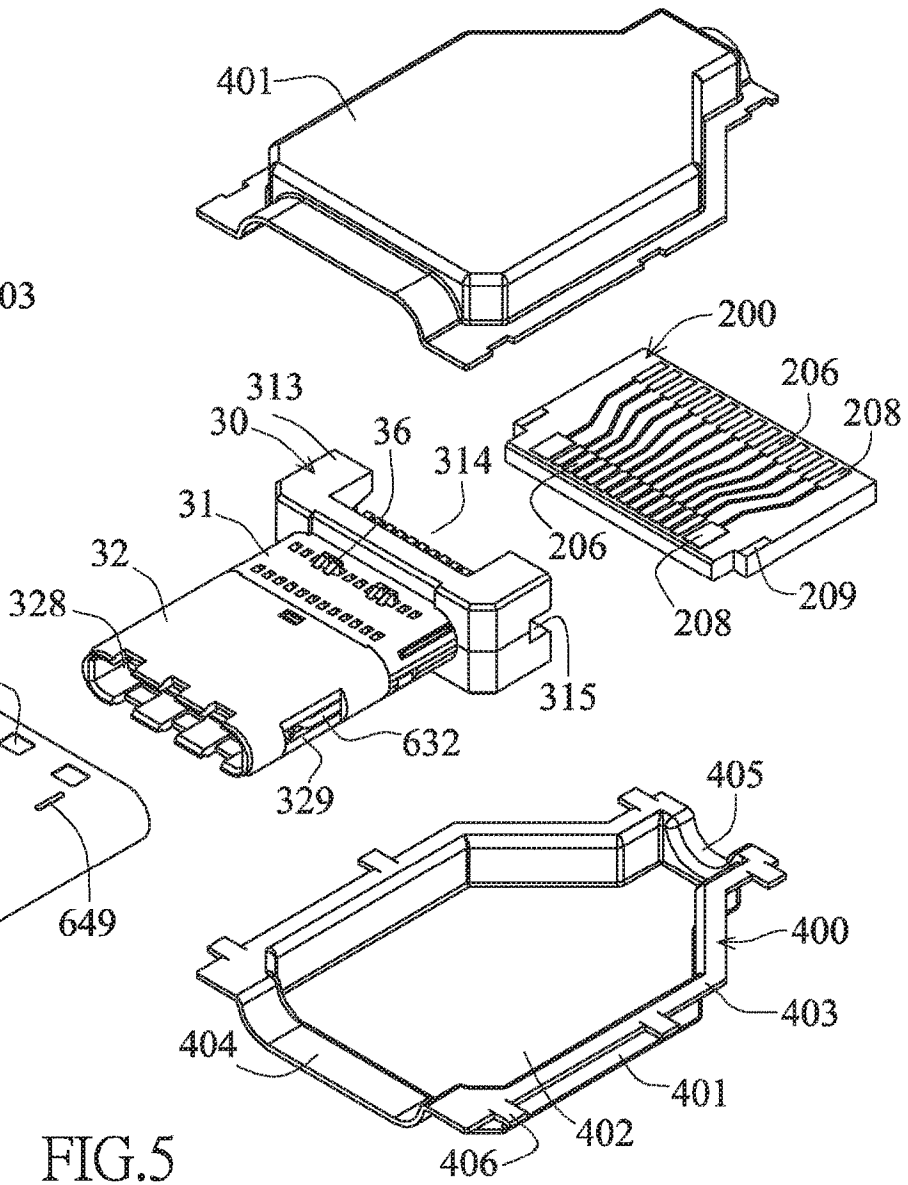
FIG.5
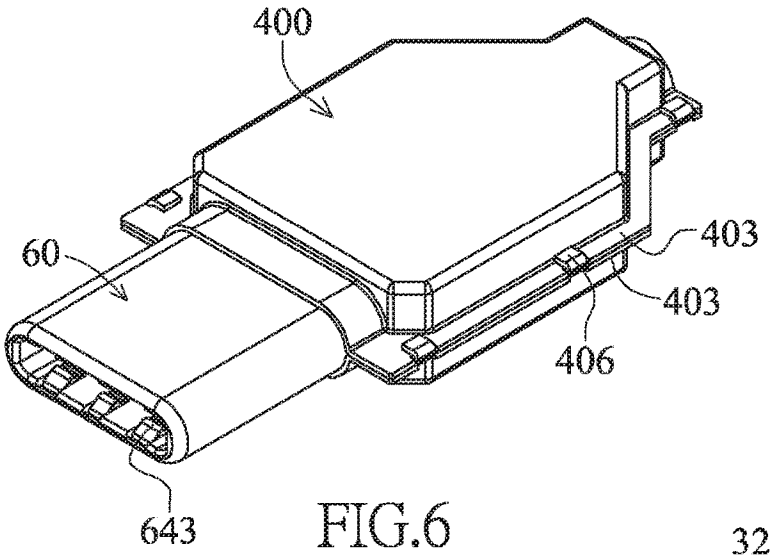
FIG.6
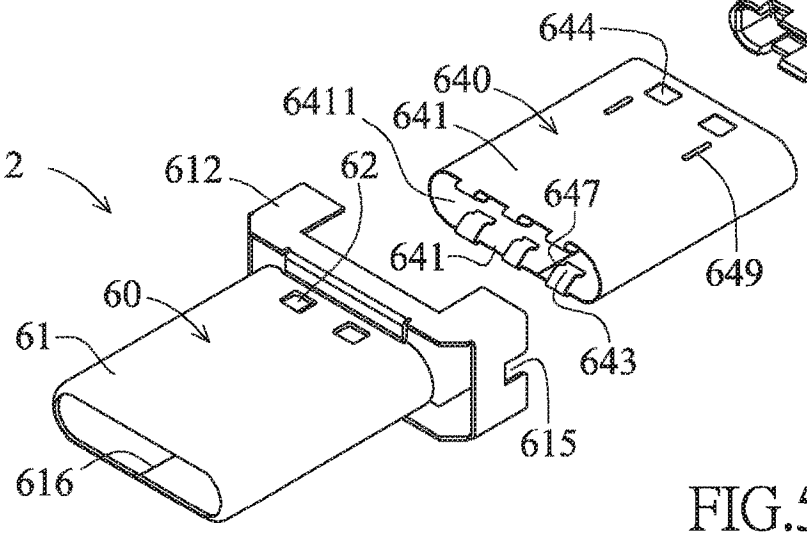

ELECTRONIC DEVICE HAVING LOW-HEIGHT DUPLEX ELECTRICAL CONNECTION PLUG ADAPTED TO DUPLEX ELECTRICAL CONNECTION STRUCTURE

CROSS-REFERENCE TO RELATED APPLICATIONS

This application is a Divisional Application of U.S. patent application Ser. No. 15/321,373, filed on Dec. 22, 2016, now issued as U.S. Pat. No. 10,109,966 B2, which is a national stage application of PCT Patent Application No. PCT/CN2015/082256, filed on Jun. 24, 2015, which claims priorities to China Patent Application Ser. No. 201420341035.7, filed on Jun. 24, 2014; No. 201420541444.1, filed on Sep. 19, 2014; and No. 201520114091.1, filed on Feb. 17, 2015, the contents of which are incorporated herein by reference.

BACKGROUND OF THE INVENTION

Field of the Invention

The invention relates to an electric connector, and more particularly to an electronic device having a low-height duplex electrical connection plug adapted to a duplex electrical connection structure.

Description of the Related Art

Referring to FIGS. 1 and 2 showing a conventional high-definition multimedia interface (HDMI) electric connector comprising a plastic seat 91, two rows of terminals 92 and a metal housing 93, wherein the plastic seat 91 is integrally provided with a base seat 911 and a tongue 912, the tongue 912 projects beyond the front end of the base seat 911, the two rows of terminals 92 are embedded into the plastic seat 91, each of the two rows of terminals 92 are provided with an elastically non-movable contact 921 disposed on top and bottom surfaces of the tongue 912, respectively, and two rows of contacts 921 of the top and bottom surfaces of the tongue 912 respectively contain 10 and 9 contacts cross-interleaving in the left-to-right direction. The two rows of contacts 921 form the HDMI contact interface, the metal housing 93 covers the plastic seat 91, a front section inside the metal housing 93 is formed with a connection slot 95, the tongue 912 is horizontally disposed in the connection slot 95, and the shape of the connection slot 95 is asymmetrical in the top-to-bottom direction to provide the mistake-proof effect, so that the electrical connection can be made at one single position.

A conventional electrical connection socket cannot be easily manufactured because the two rows of terminals 92 are integrally embedded into the plastic seat 91. More particularly, when the specification becomes smaller, the manufacturing precision needs to be very high, and cannot be easily implemented.

Furthermore, the metal housing 93 is a four-sided housing bent from a metal plate sheet to have a seam to affect the shielding effect.

Moreover, the rear shielding shell of the conventional plug is formed by way of metal pulling and extending to form front and rear shielding shells fitting with each other in the front-to-rear direction, so that the manufacturing cost is so high.

Furthermore, disposing two rows of elastically movable terminals on the insulated seat of the conventional dual-position plug with the smaller dimensional specification is not so easy. It is one of main objects of the invention to make the manufacturing process become easier.

Furthermore, the conventional socket and plug are provided with internal ground shielding sheets electrically connected together. However, the conventional socket and plug are provided with two separate ground shielding sheets, so that the assembling becomes more inconvenient and the effect of strengthening the overall structure cannot be provided.

Referring to FIG. 3 showing a side cross-sectional view of docking between a conventional biased MIRCO USB electrical connection plug 20 and a conventional biased MIRCO USB electrical connection socket 90. The biased MIRCO USB electrical connection plug and biased MIRCO USB electrical connection socket are the biased electrical connection plug and electrical connection socket having the minimum height specification specified by USB Association.

The biased MIRCO USB electrical connection socket 90 is provided with a plastic seat 91, one row of five terminals 92 and a metal housing 93, wherein the plastic seat 91 is integrally provided with a base seat 911 and a tongue 912, the tongue 912 projects beyond the front end of the base seat 911, the one row of terminals 92 are embedded into the plastic seat 91, the one row of terminals 92 are provided with elastically non-movable contacts 921 disposed on the bottom surface of the tongue 912, the metal housing 93 covers the plastic seat 91, a front section inside the metal housing 93 is formed with a connection slot 95, and the tongue 912 is horizontally disposed above an upper position of the connection slot 95, so that the connection slot 95 is formed with a small space 951 and a large space 952 on two opposite surfaces of the tongue 912.

The biased MIRCO USB electrical connection plug 20 is provided with an insulated seat 21, a metal housing 22 and one row of five terminals 23, the metal housing 22 covers the insulated seat 21, and the connection portion of the biased electrical connection plug is provided with a fitting slot 24 fitting with the tongue 921 and a fitting interface substrate 25 fitting with the large space 952. The fitting interface substrate 25 has an outer layer being the metal housing, and an inner layer being the insulated seat. The one row of five terminals 23 are provided with vertically elastically movable contacts 231. The contact 231 projects from the inner surface of the fitting interface substrate 25 to the fitting slot 24.

In the biased micro universal serial bus (MICRO USB) electrical connection socket 90 specified by USB Association, the tongue 921 has a height of 0.6 mm, the small space 951 has a height of 0.28 mm and the large space 952 has a height of 0.97 mm, and the connection slot 16 has a height of 1.85 mm.

In the biased MICRO USB electrical connection plug 20 specified by USB Association, the connection portion has a height of 1.8 mm, the fitting slot 24 has a height of 0.65 mm, the metal housing 22 has a thickness of 0.25 mm, and the fitting interface substrate 25 has a height of 0.9 mm.

Referring to FIG. 4 showing a side cross-sectional view showing docking between a conventional dual-position MIRCO USB electrical connection plug 20' and a dual-position MIRCO USB electrical connection socket 90'. The dual-position MIRCO USB electrical connection socket 90 is substantially the same as the biased MICRO USB electrical connection socket 90, except for the difference that the tongue 912 is horizontally disposed at a middle height of the connection slot 95 so that the connection slot 95 forms symmetrical spaces, each of which is the large space 952 having a height of 0.97 mm, on two opposite surfaces of the tongue 912.

The dual-position MIRCO USB electrical connection plug 20' is substantially the same as the biased MICRO USB electrical connection plug 20 except for the difference that the top of the fitting slot 24 is also provided with a fitting interface substrate 25 fitting with the large space 952, and the upper fitting interface substrate 25 is also provided with one row of five terminals 23.

So, the height of the connection portion of the dual-position MIRCO USB electrical connection plug 20' is equal to 2.45 mm, which is equal to the height (0.65 mm) of the fitting slot 24 plus a double of a height (0.9 mm) of the fitting interface substrate 25.

SUMMARY OF THE INVENTION

A main object of the invention is to provide an electronic device having a low-height duplex electrical connection plug adapted to a duplex electrical connection structure, wherein the insulated seat is provided with a base seat and a docking part fitting with each other, so that elastically movable terminal sets can be easily disposed upon manufacturing.

With the above-mentioned structure to achieve the above-identified objects, the invention provides an electronic device, including: a transmission medium; a first duplex electrical connection plug including: an insulated seat, wherein the insulated seat is provided with a base seat and a docking part fitting with each other, the docking part is provided with two connection plates facing each other in a vertical direction and is provided with two side plates connected to the two connection plates to form a fitting frame body, each of opposite surfaces of the two connection plates is provided with a connection surface, and a connection slot is formed between the two connection surfaces, wherein at least one of the connection plates is provided with one or multiple elastic movement spaces much more depressed than the connection surface, and a rear end of the docking part is fitted with and positioned at a front end of the base seat; at least two terminal sets disposed in the insulated seat, wherein each of the terminal sets is provided with at least one row of terminals, the terminal is provided with a fixing portion and an extension, the fixing portion is fixed to the base seat, the extension is directly connected to a front end of the fixing portion, the fixing portion is directly fixed to the base seat and the extension extends out of the front end of the base seat, wherein after the two terminal sets are fixed to and combined with the base seat to form a total combination, the base seat is fitted with and positioned at the docking part, so that the docking part can be independently fitted with and positioned at, or separated from the total combination, wherein the extension is vertically elastically movable relatively to the docking part, the extension extends to the one or multiple elastic movement spaces of one of the connection surfaces and is provided with a contact projecting beyond the connection surface, the contact is vertically elastically movable, and the contacts of the terminals of each of the terminal sets project from the one of the connection surfaces to the connection slot to form a contact interface, wherein the total combination includes the two terminal sets and the base seat combined together, and the two terminal sets are electrically connected to the transmission medium; and a metal housing covering the insulated seat and provided with a four-sided primary housing, wherein the four-sided primary housing shields the docking part to form a docking structure, a shape of the docking structure can be positioned at a docking electric connector in a reversible dual-position manner, the metal housing and the two connection plates form two contact interface substrates, and the contact interface substrate has a height, which is a perpendicular distance from an outer surface of the metal housing to the connection surface, wherein the heights of the two contact interface substrates are smaller than a height of a fitting interface substrate of a biased electrical connection plug having a minimum height specification of 0.9 mm specified by USB Association and larger than or equal to 0.65 mm; wherein the docking structure can be bidirectionally inserted into a connection slot of a first duplex electrical connection socket, the connection slot is formed by a metal housing, a tongue is disposed at a middle height of the connection slot of the first duplex electrical connection socket, upper and lower connection surfaces of the tongue form symmetrical two spaces, the heights of the two contact interface substrates of the second duplex electrical connection plug can be fit with the two spaces of the two connection surfaces of the tongue, and the connection slot of the first duplex electrical connection plug is fit with the tongue; and a second duplex electrical connection plug including: an insulated seat; a metal housing covering the insulated seat; and a fitting portion provided on one end of the insulated seat, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates has two inside layers being the insulating layers and two outside layers pertaining to the metal housing, each of the two contact interface substrates is provided with a contact interface, each of the two contact interfaces is provided with two rows of contacts arranged in a front-low and rear-high manner, the two rows of contacts project beyond the contact interface substrate and are vertically elastically movable, the two rear rows of contacts are formed on two rows of terminals, the terminal is provided with a pin, a fixing portion and an extension, the fixing portion is fixed to the insulated seat, the extension is connected to one end of the fixing portion, extends to the contact interface substrate and is provided with the contact, the pin is connected to the other end of the fixing portion, at least one pair of the contacts of the two contact interfaces with the same circuit are arranged reversely, at least one pair of the contacts of the two contact interfaces with the same circuit are electrically connected together, and the two contact interfaces are electrically connected to the transmission medium and electrically connected to the two terminal sets of the first duplex electrical connection plug; wherein the insulated seat is provided with vertically stacked upper and lower bases, the upper and lower bases are respectively embedded with, injection molded with and fixed to the two rows of terminals, a middle between the upper and lower bases is provided with a transversally extending metal partition plate, the metal partition plate separates the two rows of terminals from each other, and the heights of the two contact interface substrates are the same and are smaller than a height of a fitting interface substrate of a biased electrical connection plug having a minimum height specification of 0.9 mm specified by USB Association and larger than or equal to 0.65 mm; wherein the fitting portion can be bidirectionally inserted into a connection slot of a second duplex electrical connection socket, the connection slot is formed by a metal housing, a tongue is disposed at a middle height of the connection slot of the duplex electrical connection socket, upper and lower connection surfaces of the tongue form symmetrical two spaces, the heights of the two contact interface substrates of the second duplex electrical connection plug can be fit with the two spaces of the two connection surfaces of the tongue, and the fitting space is fit with the tongue.

The invention has the following advantages.

1. The insulated seat is provided with a base seat and a docking part fitting with each other, so that elastically movable terminal sets can be easily disposed upon manufacturing.

2. The docking structure has the low-height design to achieve the slim and light effects.

The above-mentioned and other objects, advantages and features of the invention will become more fully understood from the detailed description of the preferred embodiments given hereinbelow and the accompanying drawings.

BRIEF DESCRIPTION OF THE DRAWINGS

FIG. 5 is a pictorially exploded view according to a first embodiment of the invention.

FIG. 6 is a pictorially assembled view according to the first embodiment of the invention.

DETAILED DESCRIPTION OF THE INVENTION

Figures 1, 2, 3, 4:
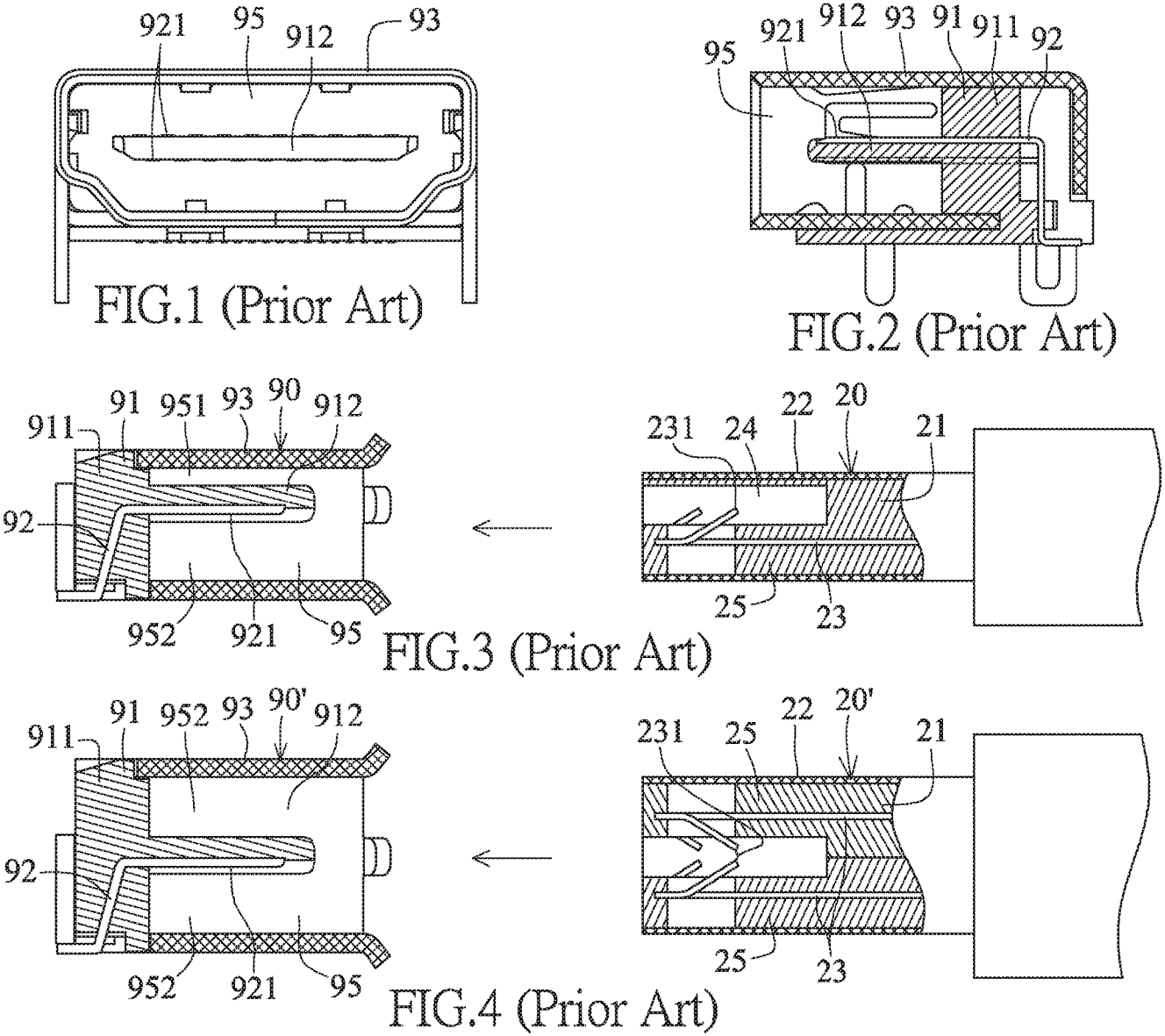
FIG.1 (Prior Art)
FIG.2 (Prior Art)
FIG.3 (Prior Art)
FIG.4 (Prior Art)
FIG. 1 is a front view showing a conventional electric connector.
FIG. 2 is a side cross-sectional view showing the conventional electric connector.
FIG. 3 is an exploded side cross-sectional view showing docking between the conventional electrical connection plug and the electrical connection socket.
FIG. 4 is an exploded side cross-sectional view showing docking between the conventional electrical connection plug and the electrical connection socket.
Figure 7:
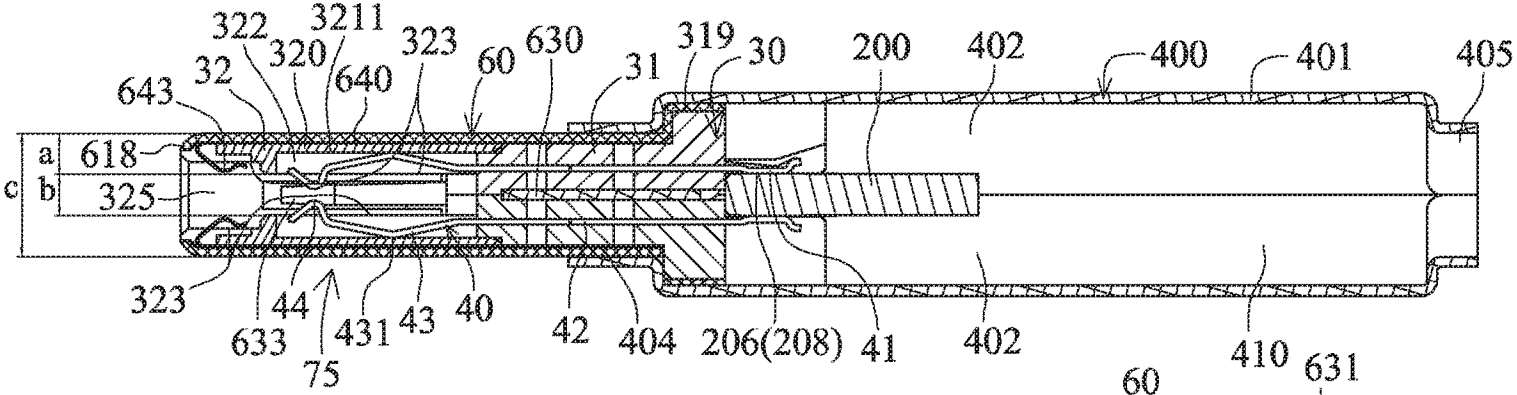
FIG. 7 is a side cross-sectional view according to the first embodiment of the invention.
Figure 9:
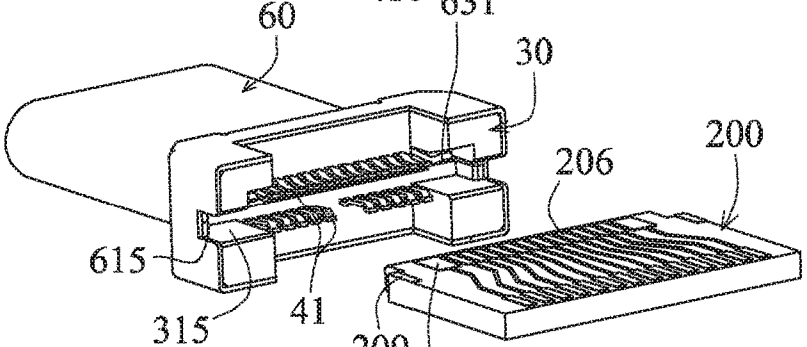
FIG. 9 is a pictorially exploded view showing an insulated seat and a circuit board according to the first embodiment of the invention.
Figure 10:
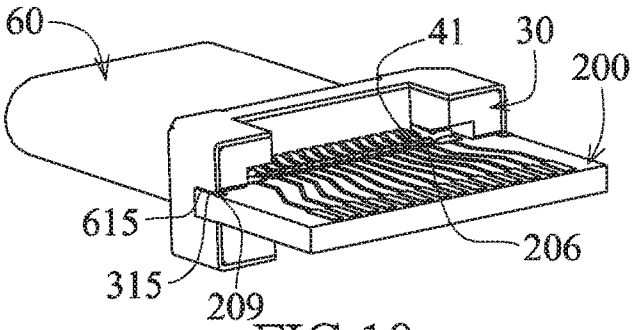
FIG. 10 is a pictorially assembled view showing the insulated seat and the circuit board according to the first embodiment of the invention.

Referring to FIGS. 5 to 14 showing a dual-position duplex USB TYPE-C electrical connection plug 2 according to the first embodiment of the invention, which comprises an insulated seat 30, two terminal sets, a metal housing 60, a metal partition plate 630, a ground shielding member 640, a circuit board 200 and a rear shielding shell 400.

Referring to FIGS. 5, 7, 11 and 12, the insulated seat 30 is provided with a base seat 31 and a docking part 32.

The base seat 31 is provided with a first base seat 311 and a second base seat 312 directly stacked vertically. The rear section of the base seat 31 is higher and wider than the front section thereof. The front end of the base seat is provided with a jointing portion 304. Two sides of the jointing portion 304 are provided with frontwardly projecting and arced side portions with a notch formed therebetween. Each of the top and bottom surfaces of the middle section of the jointing portion 304 is provided with an engagement block 307. Each of the top and bottom surfaces of the front section of the base seat 31 is provided with two engagement blocks 36. Two sides 313 of the rear section of the base seat 31 backwardly project so that a middle of the rear section of the base seat 31 is formed with a notch 314. Two sides of the base seat 31 are provided with a fitting slot 315. Each of the jointing surfaces of the first and second base seats 311 and 312 is provided with a concave surface 317.

The docking part 32 is a fitting member, which is a fitting frame body having a flat and long shape and two arced sides and approaching a rectangle. The docking part 32 is provided with two connection plates 320 facing each other in a top-to-bottom direction and having the same height, and has two side plates 327 connected to the two connection plates 320 to form a fitting frame body, so that the front end of the docking part 32 is an inserting port 3213, and the rear end of the docking part 32 is a fitting port 3214. The opposite surfaces of the two connection plates 320 are two connection surfaces 323 facing opposite directions. A connection slot 325 is formed between the two connection surfaces 323. Each of rear sections of the inner surfaces of the two connection plates 320 is provided with one row of separate barriers 3210 to separate the space into one row of elastic movement spaces 322. The opposite surfaces of two rows of barriers are rear sections of the two connection surfaces 323. The one row of elastic movement spaces 322 are much more depressed than the rear sections of the two connection surfaces 323 and have bottom surfaces 3211 separated from the metal housing 60. So, the two connection surfaces 323 have the front sections lower than the rear sections, so that the connection slot 325 forms the front section higher then the rear section in the height direction. Each of the portions near the middles of the rear ends of the two connection plates 320 is provided with an engagement hole 321 and has a front end provided with three openings 328, and two side plates each provided with an opening 329.

The fitting port of the rear end of the docking part 32 is fitted with the jointing portion 304 of the base seat 31. The engagement hole 321 engages with the engagement block 307.

Figure 8:
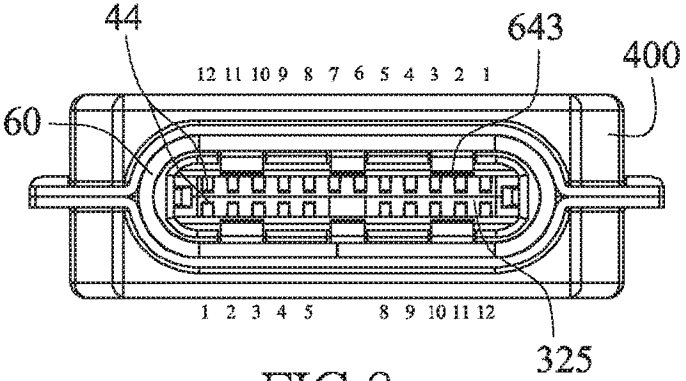
FIG. 8 is a front view according to the first embodiment of the invention.
Figure 11:
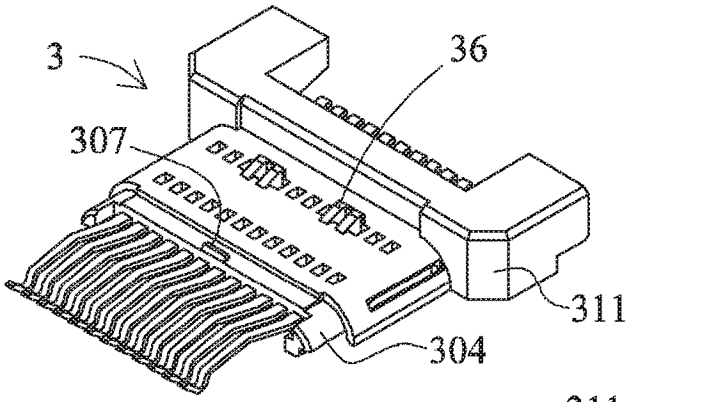
FIG. 11 is a pictorially exploded view showing the insulated seat and a metal partition plate according to the first embodiment of the invention.
Figure 11:
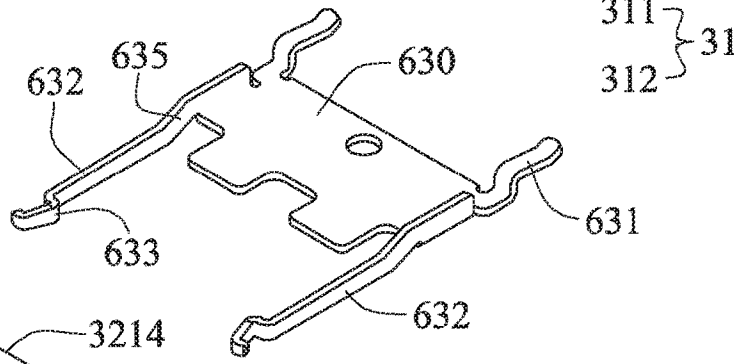
Figure 11:
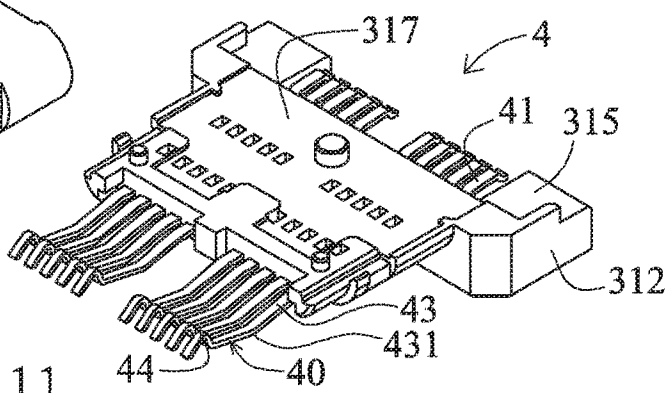
Figure 12:
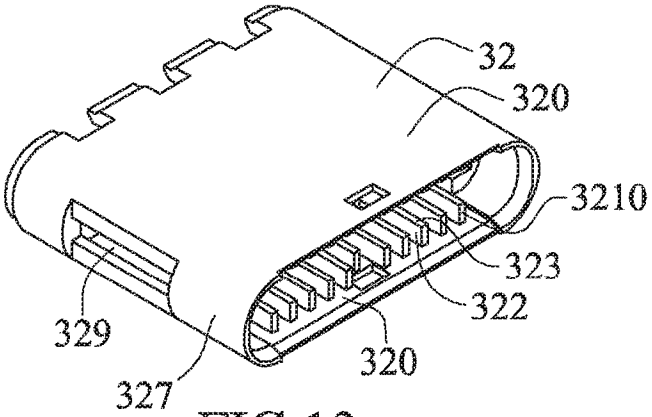
FIG. 12 is a pictorial view showing a docking part according to the first embodiment of the invention.
Figure 13:
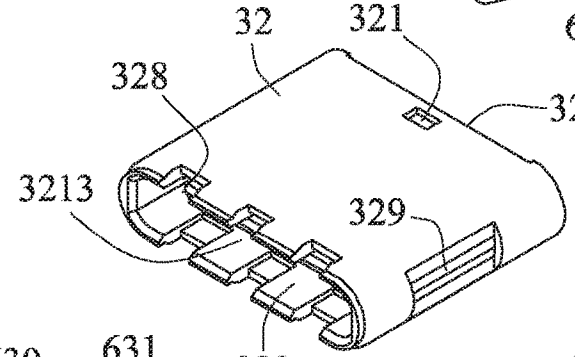
FIG. 13 is a side view showing the metal partition plate according to the first embodiment of the invention.
Figure 13:
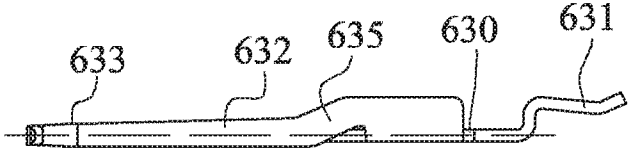

The two terminal sets include one row of 12 first terminals 40 fixedly embedded into and injected molded with the first base seat 311 to form a first combination 3, and one row of 10 first terminals 40 fixedly embedded into and injected molded with the second base seat 312 to form a second combination 4, wherein the first combination 3 and the second combination 4 are mutually stacked together to form the total combination 5. Each first terminal 40 is sequentially provided with, from one end to the other end, a pin 41, a fixing portion 42 and an extension 43. The fixing portion 42 is directly fixed to the base seat 31. The extension 43 is connected to the front end of the fixing portion 42, extends to the position in front of the base seat 31, is covered by the docking part 32, and is vertically elastically movable in the elastic movement space 322. A portion of the extension 43 near the front end of the extension 43 is curved and projectingly provided with a contact 44. The contact 44 projects from the rear section of the connection surface 323 to the connection slot 325. The middle section of the extension 43 is provided with a fulcrum 431 resting against the bottom surface 3211 of the elastic movement space 322 of the connection plate 320. The pin 41 is connected to the rear end of the fixing portion 42 and extends out of the rear end of the base seat 31, and the contacts of the two rows of first terminals 40 with the same circuit serial numbers are arranged reversely, as shown in FIG. 8. The contacts 44 of the lower terminal set have the connection points with the circuit serial numbers arranged as 1, 2, 3, . . . , 11, 12 from left to right, and the contacts 44 of the upper terminal set have the connection points with the circuit serial numbers arranged as 12, 11, . . . , 3, 2, 1 from left to right. The lower terminal set has 10 terminals, and lacks the terminal with the contacts having the connection points with the circuit serial numbers of 6 and 7.

The contacts of the two terminal sets are vertically aligned, and the contacts of the two terminal sets are arranged in an equally spaced manner.

According to the USB TYPE-C contact interface specified by USB Association, the connection point with the circuit serial number 1, 12 being one pair of ground contacts, the connection point with the circuit serial number 4, 9 being one pair of power contacts, and the connection points with the circuit serial numbers 6 and 7 being one pair of signal contacts represented by D+ and D−, respectively; and the connection points with the circuit serial numbers 11 and 10, and 2 and 3 being two pairs of signal contacts represented by RX+ and RX−, and TX+ and TX−, respectively.

The fulcrums 431 of the extensions 43 of the two rows of first terminals 40 rest against the connection plate 320 (i.e., rest against the bottom surface of the elastic movement space), so that the elastically movable arm of force has the high structural strength and the good resilience, and the contact 44 has the larger normal force.

The metal partition plate 630 is assembled on the concave surface 317 of the jointing surface between the first and second base seats 311 and 312 and positioned between the first and second base seats 311 and 312 and in the exact middle of the base seat 31 to separate the two terminal sets. Each of the left and right sides of the metal partition plate 630 integrally extends backwards to form a pin 631, and integrally extends frontwards to form a resilient snap 632. The portions of the resilient snaps near the front ends of the resilient snaps are provided with two snapping convex portions 633 disposed on the left and right sides of the connection slot 325. The height of the snapping convex portion 633 is greater than the material thickness of the metal partition plate 630, and the snapping convex portion 633 is substantially disposed at the middle height of the connection slot 325. When the two resilient snaps 632 elastically move in the left-right direction, the openings 329 on the two sides of the docking part 32 may provide the spaces for the two resilient snaps 632. The rear end of the resilient snap 632 has a plate surface vertically connected to the metal partition plate 630, and the rear section of the resilient snap 632 is provided with a bent portion 635 so that a vertical step is formed between the front section and the rear end, and the middle height of the snapping convex portion 633 is substantially disposed at the middle thickness of the metal partition plate 630.

The ground shielding member 640 has a four-sided housing to form a second metal shell. The four-sided housing is a four-sided cover formed by bending a metal plate sheet and provides one side for combination and engagement to form a seam 647. The top and bottom plate sheets of the four-sided housing are two ground shielding sheets 641 forming a gap 6411 equal to the height of the four-sided housing. Each of the rear sections of the two ground shielding sheets 641 is provided with two ribs 649 and two engagement holes 644, and each of the front ends of the two ground shielding sheets 641 is bent inwardly and reversely to form three elastic sheets. Each of the three elastic sheets is curved and projects to form a contact 643. The ground shielding member 640 is fitted with and rests against the front section of the base seat 31 and the docking part 32 of the insulated seat 30. The engagement hole 644 is engaged with the engagement block 36. The contacts 643 of the two ground shielding sheets 641 project from an opening 328 of the docking part 32 to the front sections of the two connection surfaces 323. The contacts of the two terminal sets 44 are respectively exposed from the rear sections of the two connection surfaces 323 and are closer to the middle height of the connection slot 325 than the contacts 643 of the two ground shielding sheets 641.

The metal housing 60 covers the insulated seat 30 and the ground shielding member 640. The metal housing 60 is formed by bending a metal plate sheet and is integrally provided with a four-sided primary housing 61 and a convex shell 612. The convex shell 612 is connected to the rear end of the four-sided primary housing 61, and projects beyond the four-sided primary housing 61 in the top-bottom direction and the left-right direction. The convex shell 612 rests against top and bottom surfaces 319 of the rear section of the first and second base seats of the base seat 31. The four-sided primary housing 61 is combined and engaged together on a plate surface to form a seam 616. The four-sided primary housing 61 is top-bottom symmetrical and left-right symmetrical. The four-sided primary housing 61 shields the docking part 32 to form a docking structure 75 (see FIG. 30). The shape of the docking structure 75 may be reversibly positioned in a docking electric connector at two positions. The convex shell 612 covers the rear section of the base seat 31 and has left and right sides each provided with a fitting slot 615 corresponding to the fitting slot 315 of the insulated seat 30. The top and bottom plates of the rear section of the four-sided primary housing 61 are provided with two engagement holes 62. The engagement hole 62 is engaged with the engagement block 36. The ground shielding member 640 has a four-sided housing to form a second metal shell, which is fitted with and rests against and inside the metal housing 60. A rib 649 can ensure the tight contact with the metal housing 60. A front edge 618 of the metal housing 60 is bent inwardly and stopped at the front edge of the ground shielding member 640.

The metal housing 60 and the two connection plates 320 form two contact interface substrates. The height "a" of the contact interface substrate is the perpendicular distance from the outer surface of the metal housing 60 to the rear section of the connection surface 323. In this embodiment, the height "a" of the two contact interface substrates is about 0.8 mm, and the height "b" of the rear section of the connection slot 325 is about 0.8 mm, so the total height "c" of the docking structure 75 is about 2.4 mm.

The height "a" (0.8 mm) of each of the two contact interface substrates is smaller than that of the fitting interface substrate (0.9 mm) of the biased MICRO USB electrical connection plug 20 of FIG. 3 having the minimum height specification specified by USB Association, and is larger than that of the small space (0.28 mm) of the connection slot of the biased electrical connection socket having the minimum height specification specified by USB Association.

In addition, the total height "c" of the docking structure 75 of this embodiment is about 2.4 mm, and is smaller than the height of the connection portion of the dual-position MIRCO USB electrical connection plug 20' of FIG. 4 (the height of the fitting slot 24 (0.65 mm)+ a double of the height of the fitting interface substrate 25 (0.9 mm)=2.45 mm). The height of the connection portion of the dual-position MIRCO USB electrical connection plug 20' is the total height, which is obtained by adding the heights of two fitting interface substrates to the height of one fitting slot of the biased electrical connection plug having the minimum height specification specified by USB Association.

The seam 616 of the metal housing 60 and the seam 647 of the ground shielding member 640 are disposed on the bottom plate surface, but are staggered in the left-right direction so that the two housings can mutually shield the seams.

In addition, the seam 616 of the metal housing 60 and the seam 647 of the ground shielding member 640 may also be implemented as being disposed on the top plate surface and the bottom plate surface, respectively, so that the two housings can mutually shield the seams to reinforce the structure.

Furthermore, the seam 616 of the metal housing 60 and the seam 647 of the ground shielding member 640 may also implemented by way of laser welding and hot melting combination so that the combination portions have no gap.

Referring to FIGS. 5, 7, 9 and 10, the circuit board 200 is a printed circuit board (PCB). Each of the front and rear ends of the top surface of the PCB is provided with one row of connection points 206 and 208 with circuit connections, and each of the front and rear ends of the bottom surface of the PCB is provided with one row of connection points 206 with circuit connections. Each of the left and right sides of the top and bottom surfaces is provided with a wear-resistant pad 209. The left and right sides of the circuit board 200 are snapped to the fitting slots 315 and 615, and the wear-resistant pad 209 may rest against the metal fitting slot 615. The pins 41 of the two terminal sets are respectively bonded to one row of connection points 206 of the front ends of the top and bottom surfaces, and the two pins 631 of the metal partition plate 630 are bonded to the two connection points 208 of the front end of the top surface.

The rear shielding shell 400 is made of a metal material and covers the rear section of the metal housing 60, the rear section of the insulated seat 30 and the circuit board 200. The rear shielding shell 400 is formed with an accommodating space 410 thereinside, and has front and rear ends each provided with fitting ports 404 and 405. The fitting port 404 is fitted with the rear section of the four-sided primary housing 61 of the metal housing. The heights of the fitting ports 404 and 405 are lower than that of the accommodating space 410. The rear shielding shell 400 is composed of two housings 401 vertically combined together. Each of the two housings 401 is provided with a seamless chamber 402. The periphery of the chamber 402 is provided with a combination plate 403. The combination plates 403 of the two housings 401 are vertically combined together. The chambers 402 of the two housings face each other to form the accommodating space 410, wherein the combination plate 403 of one housing 401 is provided with snapping sheets 406 snapping to the combination plate 403 of the other housing 401.

The chambers 402 of the two housings 401 are formed of metal sheets by way of drawing extension molding, are formed by way of metal die casting, or are formed by way of metal powder injection molding.

Figure 14:
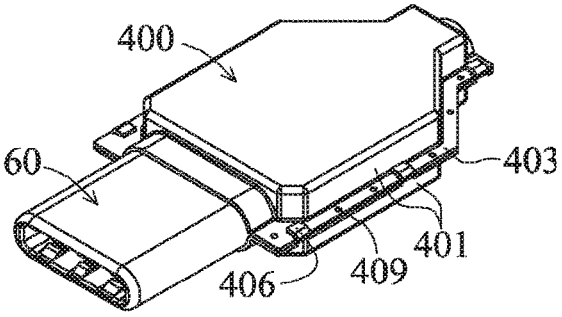
FIG. 14 is a diagram showing the implemented state according to the first embodiment of the invention.
Figure 15:
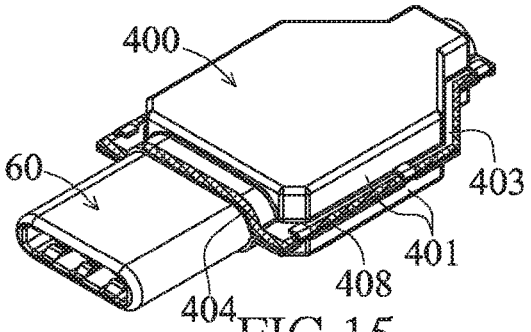
FIG. 15 is a diagram showing the implemented state according to the first embodiment of the invention.

Referring to FIG. 14 upon implementation, the combination plates 403 of the two housings 401 are further formed with the spot welding 409. Referring to FIG. 15, the combination plates 403 of the two housings 401 and the fitting port 404 may further be formed with the laser welding 408 (hatched portion) to implement the hot melting combination so that the combination portion is formed with the seamless combination.

Figure 15A:
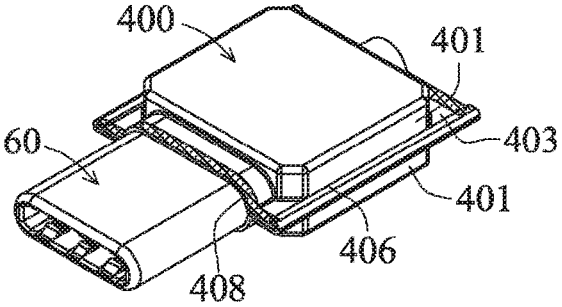
FIG. 15A is a diagram showing the implemented state according to the first embodiment of the invention.
Figure 15B:
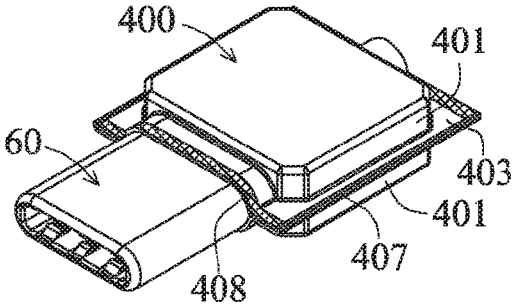
FIG. 15B is a diagram showing the implemented state according to the first embodiment of the invention.
Figure 15C:
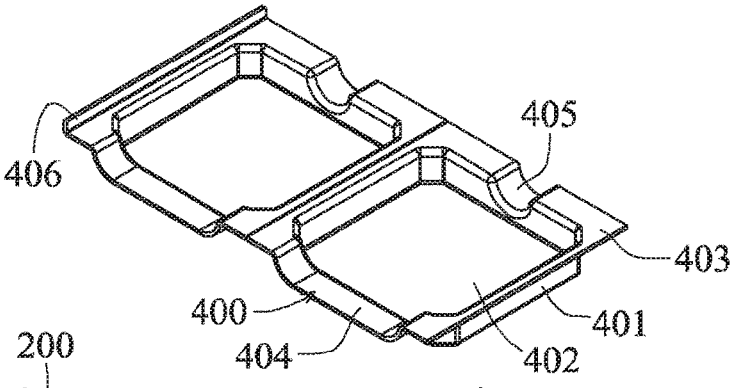
FIG. 15C is a diagram showing the implemented state according to the first embodiment of the invention.
Figure 15D:
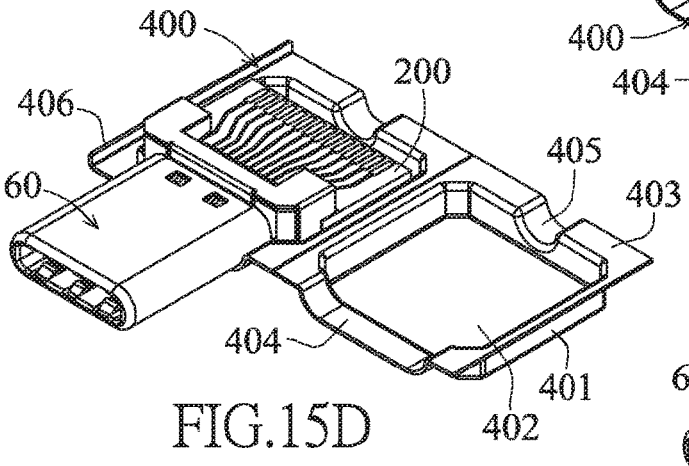
FIG. 15D is a diagram showing the implemented state according to the first embodiment of the invention.
Figure 15E:
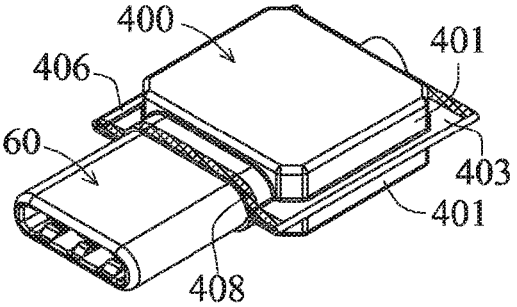
FIG. 15E is a diagram showing the implemented state according to the first embodiment of the invention.

Referring to FIGS. 15A to 15E showing the variations of the rear shielding shell 400 of this embodiment. In FIG. 15A, each of the combination plates 403 of the left and right sides of one housing 401 is provided with a front-to-rear continuous snapping sheet 406 snapping to the combination plate 403 of the other housing 401, and the front and rear ends thereof are the same as FIG. 15. In FIG. 15B, each of the combination plates 403 of the left and right sides of one housing 401 is vertically provided with a front-to-rear continuous bending edge 407 shielding the outside of the combination plate 403 of the other housing 401, and the front and rear ends are the same as FIG. 15A. In FIGS. 15C to 15E, the combination plates 403 of the left and right edges of the two housings 401 are integrally connected together and can be folded and combined together, and the others are the same as FIG. 15A.

Figure 16:
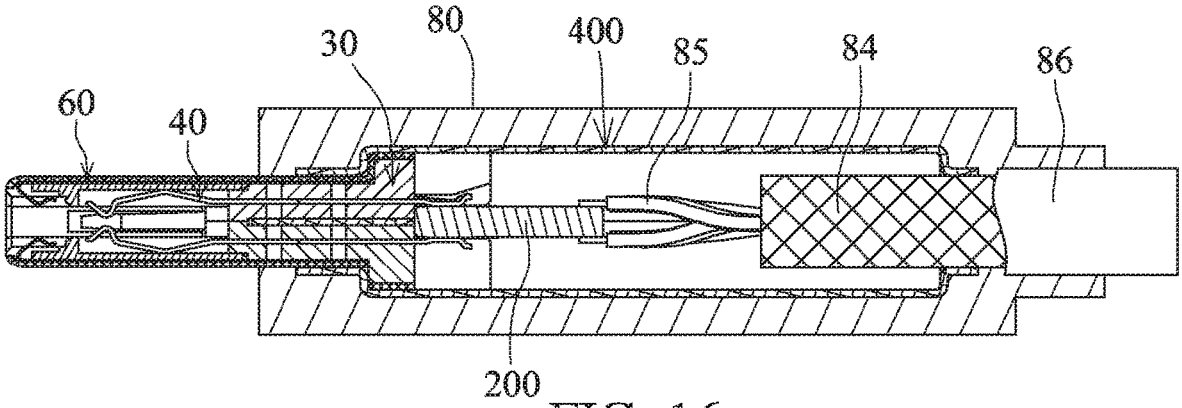
FIG. 16 is a diagram showing the implemented state according to the first embodiment of the invention.

Referring to FIG. 16, the plug of this embodiment serves as the plug of a transmission cable. The transmission cable 86 is an electronic unit provided with two sets of wires 85 bonded to two rows of connection points 206 of the circuit board 200. Metal grid lines 84 covering the two sets of wires 85 are bonded to the two connection points 208 of the circuit board 200 (see FIG. 5), and then encapsulated to form a coating 80.

Figure 17:
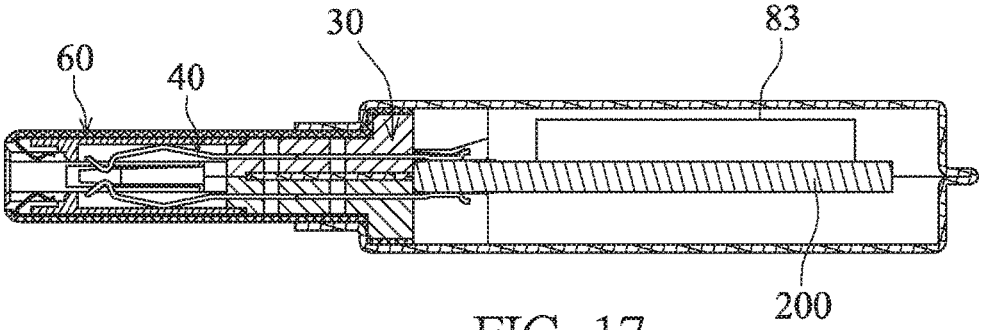
FIG. 17 is a diagram showing the implemented state according to the first embodiment of the invention.
Figure 17A:
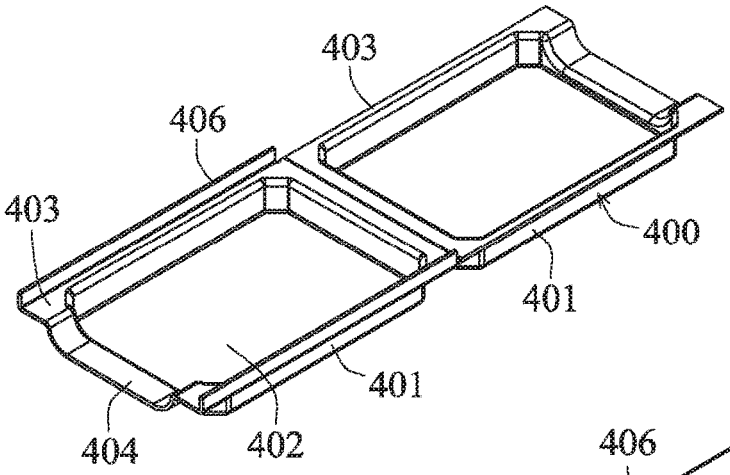
FIG. 17A is a diagram showing the implemented state according to the first embodiment of the invention.
Figure 17B:
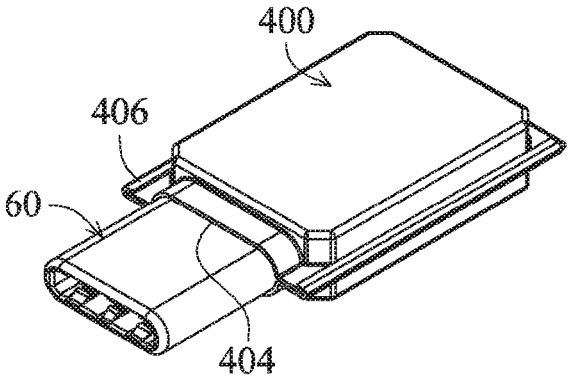
FIG. 17B is a diagram showing the implemented state according to the first embodiment of the invention.

Referring to FIG. 17, this embodiment functions as a plug of a mobile disk. The circuit board 200 needs to be larger, and an electronic unit is disposed on and electrically connected to the circuit board 200. The electronic unit is a storage unit 83 electrically connected to the two terminal sets through the circuit board 200. Referring to FIGS. 17A and 17B, the combination plates 403 of the two ends of the two housings 401 of the rear shielding shell 400 are integrally connected together and can be folded and combined together.

According to the above-mentioned description, the plug of this embodiment has the following advantages:

1. The ground shielding member 640 is integrally provided with two ground shielding sheets 641 to form a four-sided housing, to facilitate the assembling, wherein its four-sided housing and the four-sided primary housing 61 of the metal housing 60 are fitted with and rest against together, so that the structural strength of the metal housing 60 can be reinforced, and the seam can be effectively shielded.

2. The rear shielding shell 400 is formed with the two housings 401 vertically combined together, and each of the two housings 401 is provided with a chamber 402 without a combination gap, so that the easy manufacturing and the good shielding effect can be achieved.

3. The insulated seat 30 is provided with a base seat 31 and a docking part 32 mutually fitted together, wherein the base seat 31 is provided with vertically stacked first and second base seats 311 and 312, which are fixedly embedded into and injected molded with two terminal sets, respectively, so that the elastically movable terminal sets can be easily disposed upon manufacturing.

4. The height of the snapping convex portion 633 of the resilient snap 632 is greater than the material thickness of the metal partition plate 630, and the resilient snap 632 is provided with a bent portion 635 so that a vertical step 635 is formed between the front section and the rear end, and the middle height of the snapping convex portion 633 is substantially disposed at the middle thickness of the metal partition plate 630.

5. The insulated seat 30 provided with the fitting slot 315 can be engaged with the circuit board 200.

6. The docking structure has the low-height design to achieve the slim and light effects.

Referring again to FIG. 18, the plug 2 of this embodiment can be electrically connected to a dual-position duplex USB TYPE-C electrical connection socket 1 in a reversible and duplex dual-position manner to achieve the doubled transmission and easy insertion effects. That is, when the front side or reverse side of the plug 2 is inserted into the connection slot 16 of the socket 1, the contacts 44 of the two terminal sets of the plug 2 are electrically connected to the contacts 141 of the terminals 14 of the two terminal sets of the socket 1, and the tongue 121 of the insulated seat 12 of the socket 1 is connected to the connection slot 325 of the plug 2. The inner sections of the two connection surfaces of the tongue 121 are more convex than the outer sections of the two connection surfaces to fit in conjunction with the front-high-rear-low structure of the connection slot 325. The contact 643 of the ground shielding member 640 of the plug is electrically connected to the first plate sheet 191 of the ground shielding member 19 of the socket, so that the metal housing 60 of the plug 2 is electrically connected to the metal housing 93 of the socket 1.

In addition, the snapping convex portion 633 of the resilient snap 632 of the plug 2 snaps to the slot of a metal partition plate 17 of the socket 1, so that the plug 2 and the socket 1 form the inner snapping.

Figure 20:
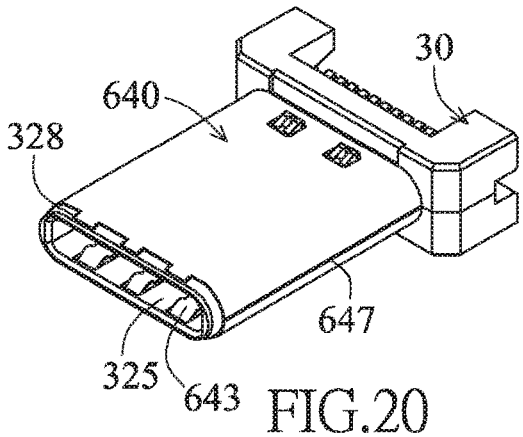
FIG. 20 is a pictorially assembled view according to the second embodiment of the invention.
Figure 19:
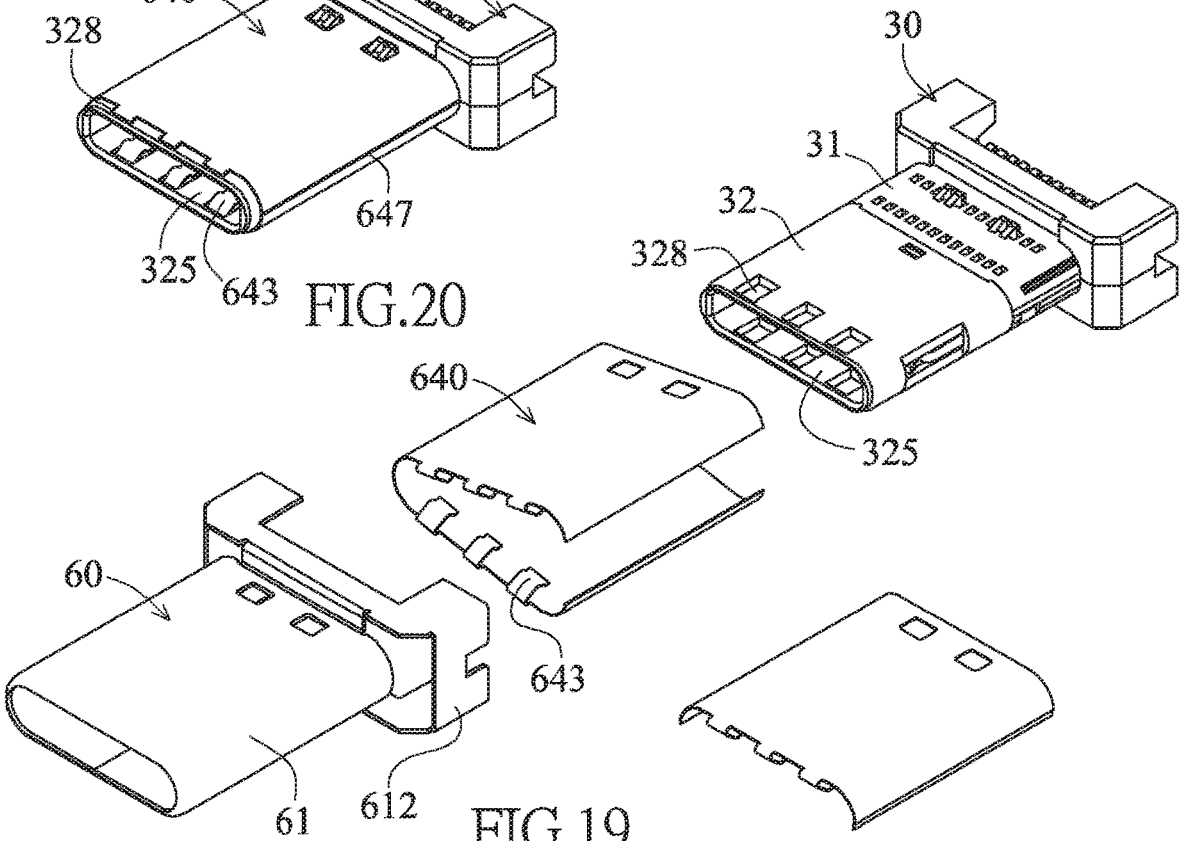
FIG. 19 is a pictorially exploded view according to a second embodiment of the invention.

Referring to FIGS. 19 and 20, the second embodiment of the invention is substantially the same as the plug of the first embodiment except for the difference that the left and right sides of the ground shielding member 640 of the this embodiment are connected together to form the seam 647, so that the opening 328 of the docking part 32 needs not to be disposed on the front end, and the docking part 32 may have the complete front edge.

Figure 21:
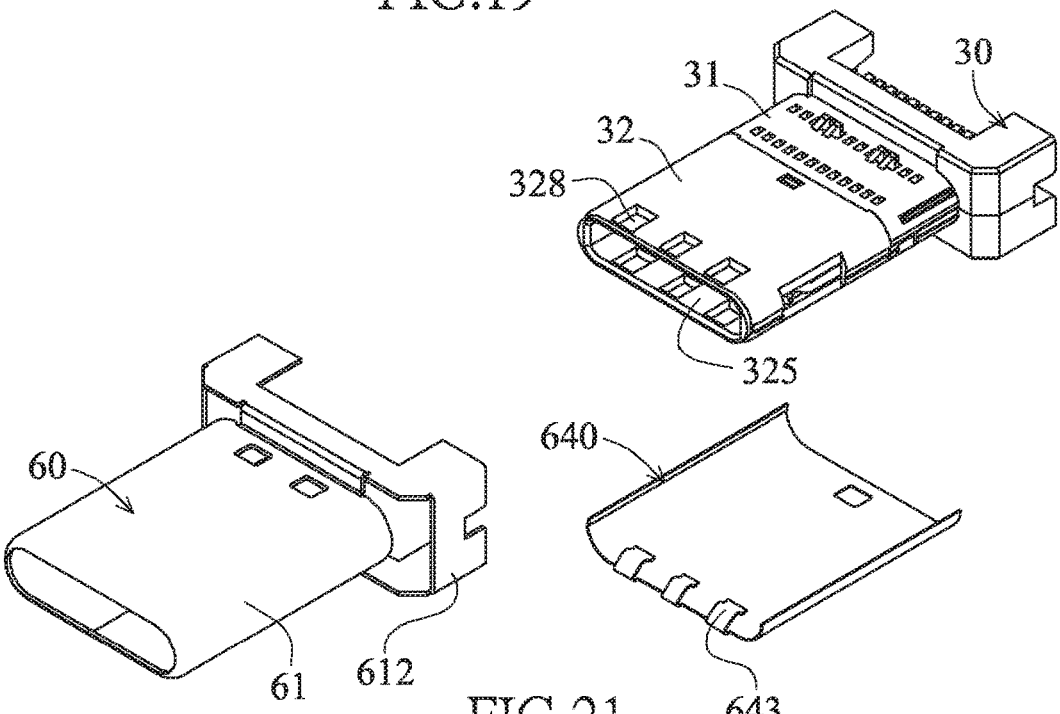
FIG. 21 is a pictorially exploded view according to a third embodiment of the invention.

Referring to FIG. 21, the third embodiment of the invention is substantially the same as the second embodiment except for the difference that the ground shielding member 640 of this embodiment has two half housings vertically connected together.

Figure 22:
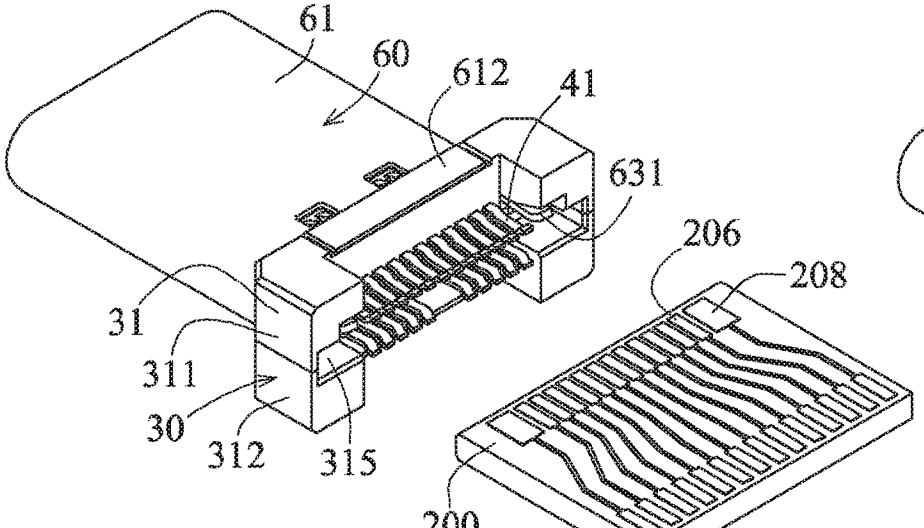
FIG. 22 is a pictorially exploded view showing the insulated seat and the circuit board according to a fourth embodiment of the invention.
Figure 23:
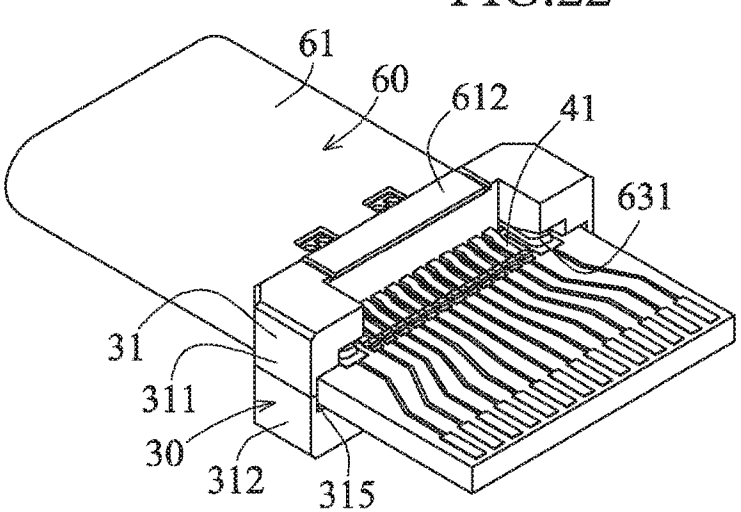
FIG. 23 is a pictorially assembled view showing the insulated seat and the circuit board according to the fourth embodiment of the invention.

Referring to FIGS. 22 and 23, the fourth embodiment of the invention is substantially the same as the plug of the first embodiment except for the difference that the convex shell 612 of the metal housing 60 of this embodiment only projects in the top-bottom direction, to facilitate the metal sheet bending. So, only the left and right sides of the base seat 31 are provided with the fitting slot 315 snapping to the circuit board 200.

Figure 24:
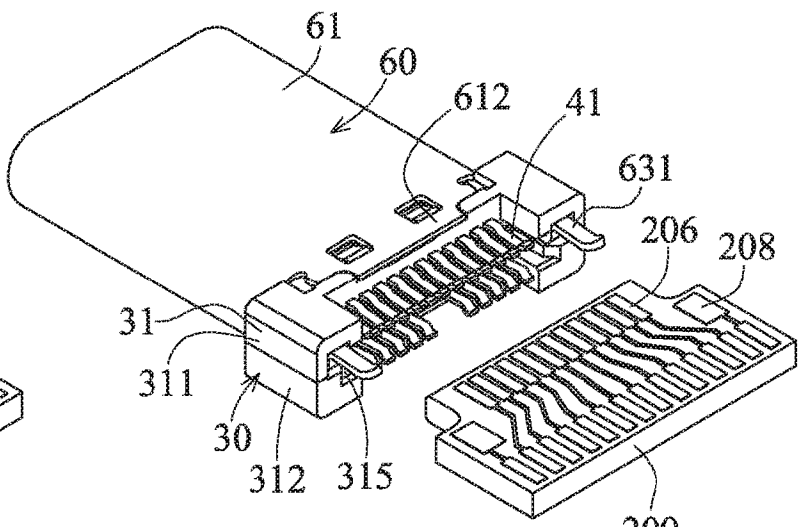
FIG. 24 is a pictorially exploded view showing the insulated seat and the circuit board according to a fifth embodiment of the invention.
Figure 25:
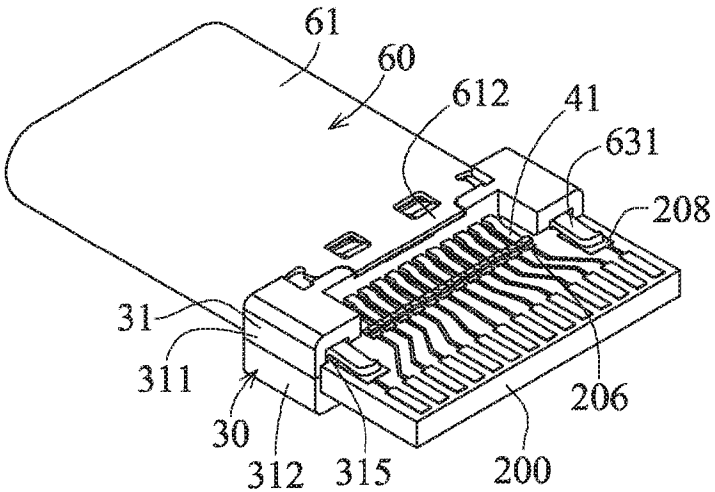
FIG. 25 is a pictorially assembled view showing the insulated seat and the circuit board according to the fifth embodiment of the invention.

Referring to FIGS. 24 and 25, the fifth embodiment of the invention is substantially the same as the fourth embodiment except for the difference that the two pins 631 of the metal partition plate 630 of this embodiment and the pins 41 of a terminal set of the first base seat 311 are arranged in one front row and one rear row. So, the one row of connection points 206 and the two connection points 208 on the circuit board 200 are arranged in one front row and one rear row.

Figure 26:
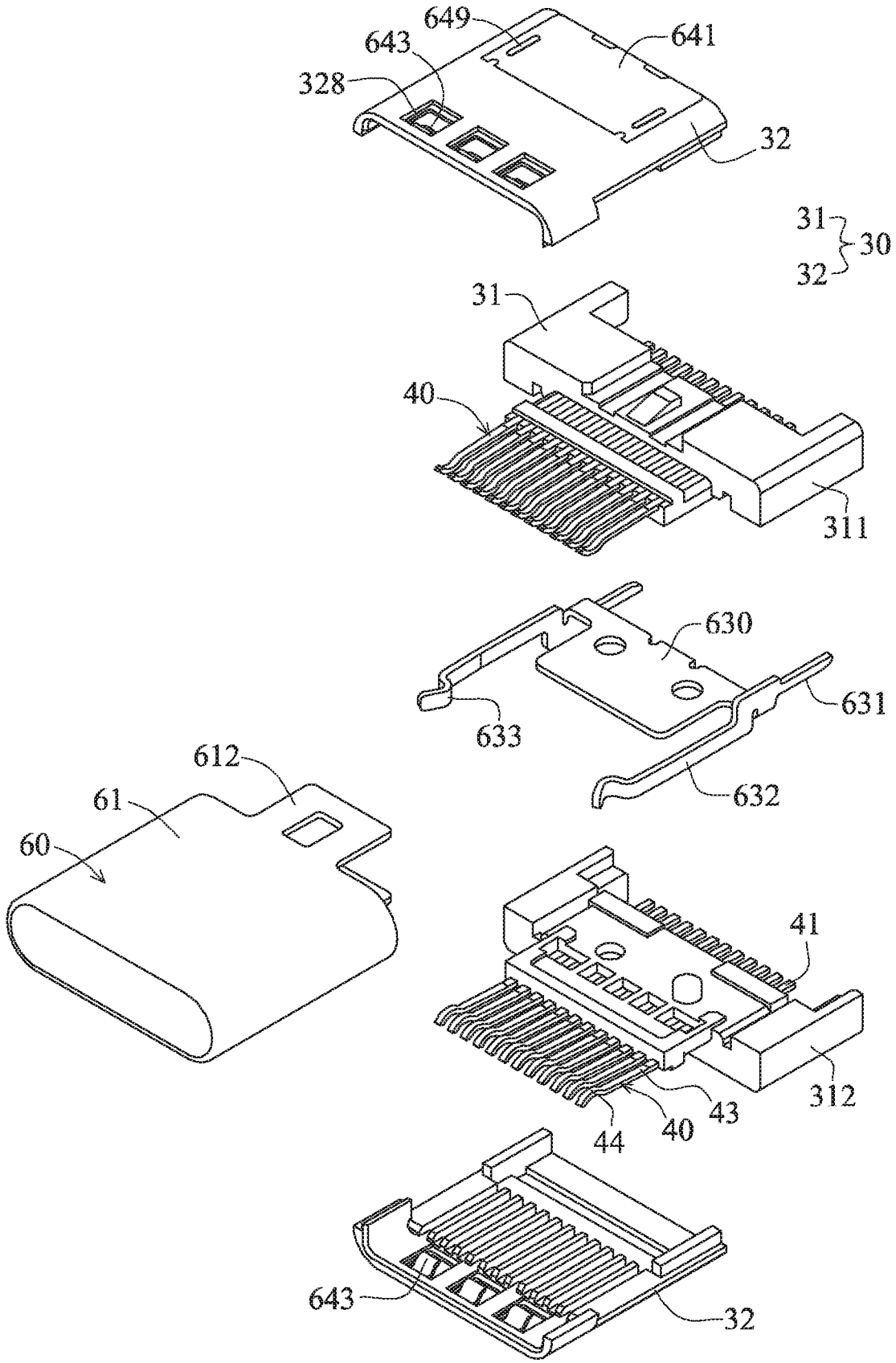
FIG. 26 is a pictorially exploded view according to a sixth embodiment of the invention.
Figure 27:
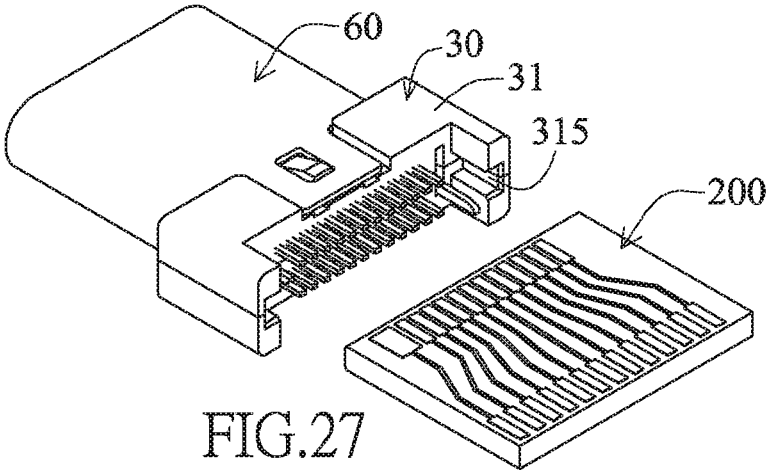
FIG. 27 is a pictorially exploded view showing the insulated seat and the circuit board according to the sixth embodiment of the invention.
Figure 28:
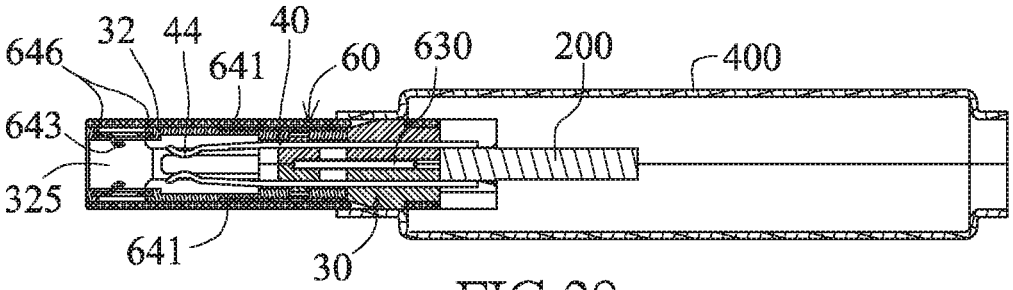
FIG. 28 is a side cross-sectional view according to the sixth embodiment of the invention.

Referring to FIGS. 26 to 28, the sixth embodiment of the invention is substantially the same as the first embodiment and the fifth embodiment except for the difference that the rear ends of two resilient snaps 632 of the metal partition plate 630 of this embodiment are one upper end and one lower end bent to be vertically connected to the metal partition plate 630, so that the middle height of the snapping convex portion 633 of the two resilient snaps 632 is similarly substantially disposed at the middle thickness of the metal partition plate 630, and the two pins 631 are respectively flush with the pins 41 of the two terminal sets.

In addition, the docking part 32 of this embodiment comprises upper and lower housings connected together to form a fitting frame body similar to that of the first embodiment, the upper and lower housings are respectively embedded into a ground shielding sheet 641. Each of the two ground shielding sheets 641 is provided with three contacts 643 respectively projecting from the opening 328 of the docking part 32 to the front sections of the two connection surfaces 323. The three contacts 643 of the two ground shielding sheets 641 are vertically elastically movable. The two ground shielding sheets 641 also function as reinforcement sheets to reinforce the structural strength of the upper and lower housings. At least one portion 646 of the ground shielding sheet 641 is totally embedded into the front section of the fitting frame body to reinforce the structural strength of the inserting port of the fitting frame body.

Figure 29:
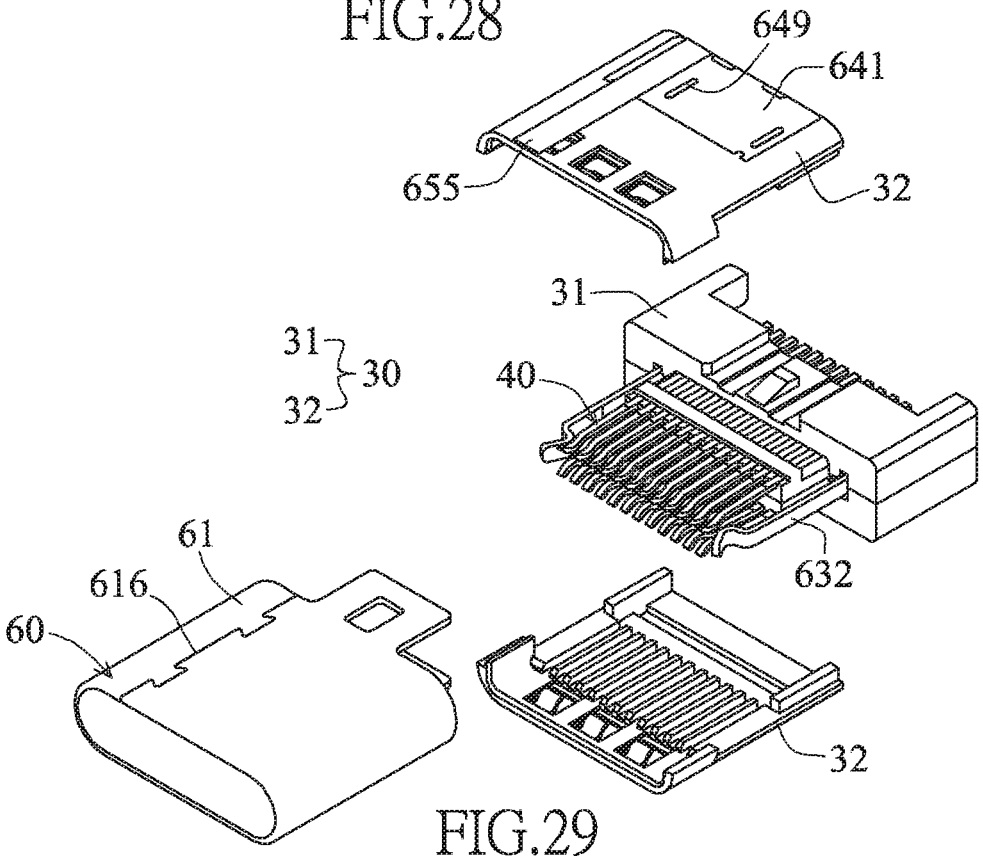
FIG. 29 is a pictorially exploded view according to a seventh embodiment of the invention.

Referring to FIG. 29, the seventh embodiment of the invention is substantially the same as the sixth embodiment except for the difference that the outside of the docking part 32 of this embodiment is fixedly provided with a metal sheet 655. The metal sheet 655 correspondingly shields the seam 616 of the four-sided primary housing 61. The metal sheet 655 may be aluminum platinum directly attached to the docking part 32. The easy configuration of the metal sheet 655 achieves the function of shielding the seam of the four-sided primary housing 61.

Figure 30:
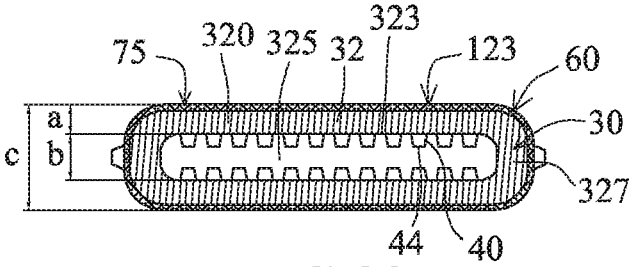
FIG. 30 is a front cross-sectional view according to an eighth embodiment of the invention.

Referring to FIG. 30, the eighth embodiment of the invention provides a dual-position duplex electrical connection plug 123, which is substantially the same as the first embodiment. The external shape of the docking structure 75 of this embodiment is similarly in the form of two arced sides, and the contacts 44 of the two rows of first terminals 40 are vertically aligned except for the difference that this embodiment has no metal partition plate, ground shielding member, circuit board and rear shielding shell.

The height "a" of the contact interface substrate of the dual-position duplex electrical connection plug 123 ranges between 0.65 mm and 0.9 mm. The height "b" of the connection slot 325 ranges from about 0.85 mm to 1.0 mm. The overall height "c" of the docking structure 75 ranges from about 2.2 mm to 2.8 mm, so that the slim and light product can be easily manufactured.

The height "a" of the contact interface substrate of this embodiment is about 0.75 mm, the height "b" of the connection slot 325 is about 0.9 mm, and the overall height "c" of the docking structure 75 is about 2.4 mm.

The height "a" (0.75 mm) of each of the two contact interface substrates is smaller than that of the fitting interface substrate (0.9 mm) of the biased MICRO USB electrical connection plug 20 of FIG. 3 having the minimum height specification specified by USB Association, and is larger than that of the small space (0.28 mm) of the connection slot of the biased electrical connection socket having the minimum height specification specified by USB Association.

In addition, the total height of the docking structure of this embodiment is about 2.4 mm, and is smaller than the height of the connection portion of the dual-position MIRCO USB electrical connection plug 20' of FIG. 4 (the height of the fitting slot 24 (0.65 mm)+a double of the height of the fitting interface substrate 25 (0.9 mm)=2.45 mm). The height of the connection portion of the dual-position MIRCO USB electrical connection plug 20' is the total height, which is obtained by adding the heights of the two fitting interface substrates to the height of one fitting slot of the biased electrical connection plug having the minimum height specification specified by USB Association.

Figure 31:
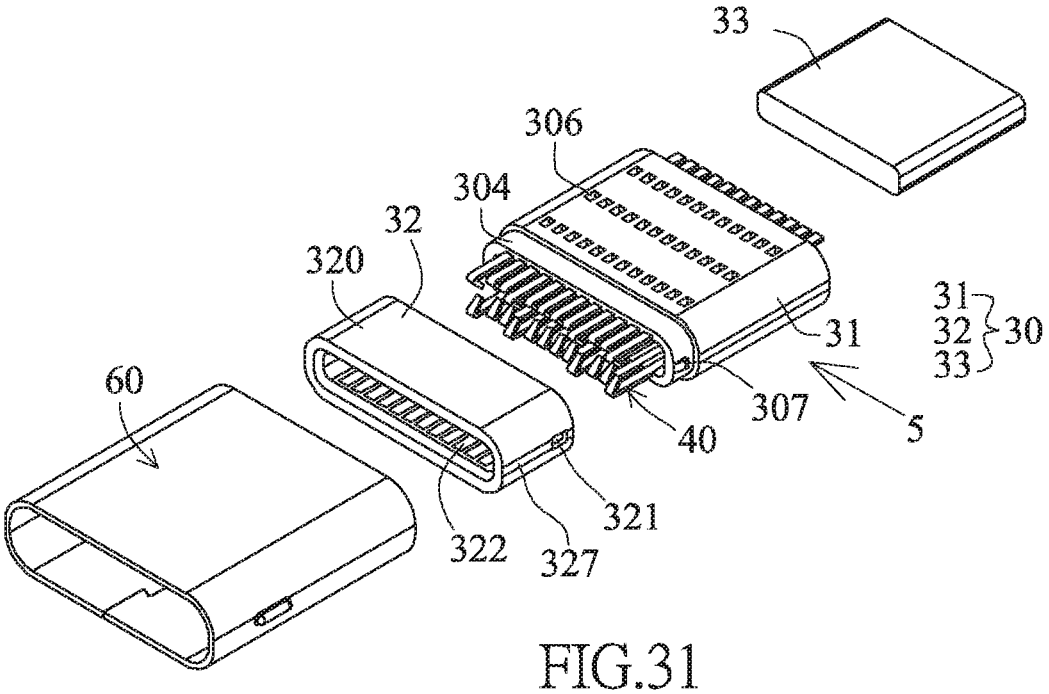
FIG. 31 is a pictorially exploded view according to a ninth embodiment of the invention.
Figure 32:
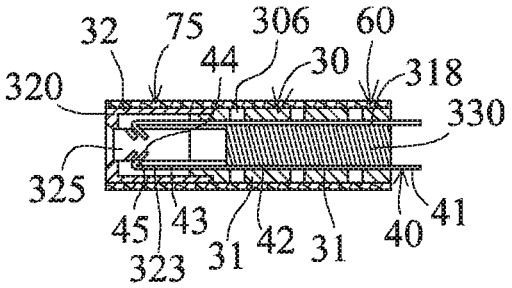
FIG. 32 is a side cross-sectional view according to the ninth embodiment of the invention.
Figure 33:
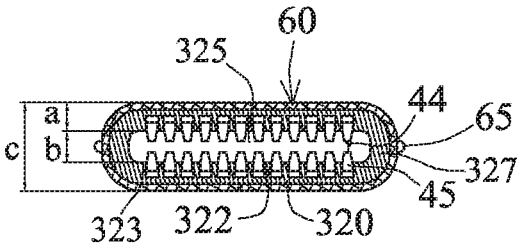
FIG. 33 is a front cross-sectional view according to the ninth embodiment of the invention.

Referring to FIGS. 31 to 33, the ninth embodiment of the invention is a dual-position duplex electrical connection plug and is substantially the same as the first and eighth embodiments except for the differences that the insulated seat 30 comprises a base seat 31, a docking part 32 and an insulation plug block 33, that the two rows of first terminals 40 and the base seat 31 are integrally embedded and injection molded together to form a total combination 5, that the base seat 31 forms a hollow chamber 318, that the fixing portions 42 of each of the one row of first terminals 40 of the two terminal sets are respectively arranged and fixed to the top and bottom surfaces of the hollow chamber 313, that the extensions 43 of the two rows of first terminals 40 extend out to a position in front of the base seat 31, that each of the top and bottom surfaces of the base seat 31 is formed with three rows of cavities 306, that each cavity 306 corresponds to the fixing portion 42 of the first terminal 40, that the end section of the extension 43 of the first terminal 40 is bent reversely to form a reverse extension sheet 45 projecting beyond the connection surface 323, that the cut surface of the distal end of the reverse extension sheet 45 is the contact 44, that the extension 43 is vertically elastically movable, that the reverse extension sheet 45 is shorter and is not elastically movable, that the front end of the base seat 31 is provided with a jointing portion 304, and that each of the left and right sides of the jointing portion 304 is provided with an engagement block 307.

In addition, the extensions 43 of each one row of first terminals 40 have different lengths, and some first terminals 40 have the longer extensions 43, so each of the two connection surfaces 323 is projectingly provided with one front row of contacts 44 and one rear row of contacts 44. The two rows of contacts are vertically elastically movable. The end section of the extension 43 of the first terminal 40 is bent reversely to form the contact 44 projecting beyond the connection surface 323, and the contact 44 is a cut surface of a distal end.

Each of the two terminal sets is one row of 12 first terminals 40. The contacts of the two terminal sets having the same contact interface and the connection points with the same circuit serial numbers are arranged reversely.

The docking part 32 is fitted with the jointing portion 304 of the front end of the base seat 31. The structure of the docking part 32 is almost the same as that of the first embodiment, is similarly provided with two connection plates 320 facing each other in a top-to-bottom direction and having the same height and has two side plates 327 connected to the two connection plates 320 to form a fitting frame body, so that the front end of the docking part 32 is an inserting port and the rear end is a fitting port. The opposite surfaces of the two connection plates 320 are two connection surfaces 323 facing opposite directions. A connection slot 325 is formed between the two connection surfaces 323. Each of the rear sections of the inner surfaces of the two connection plates 320 is provided with one row of separate barriers to separate the space into one row of elastic movement spaces 322 to separate the extensions 43 of the two rows of first terminals 40 of the two contact interfaces. The opposite surfaces of two rows of barriers are two connection surfaces 323. The one row of elastic movement spaces 322 are much more depressed than the connection surface 323 and have bottom surfaces separated from the metal housing 60.

Each of two sides of the rear end of the docking part 32 is provided with an engagement hole 321 engaged with the engagement block 307 of the base seat 303.

The insulation plug block 330 is fitted with the hollow chamber 313 of the base seat 303. The front end of the insulation plug block 330 is formed with a limiting surface to rest and limits against the tongue of the electrical connection socket.

The height "a" of the contact interface substrate of this embodiment is about 0.75 mm, the height "b" of the connection slot 325 is about 0.9 mm, and the overall height "c" of the docking structure 75 is about 2.4 mm.

Figure 34:
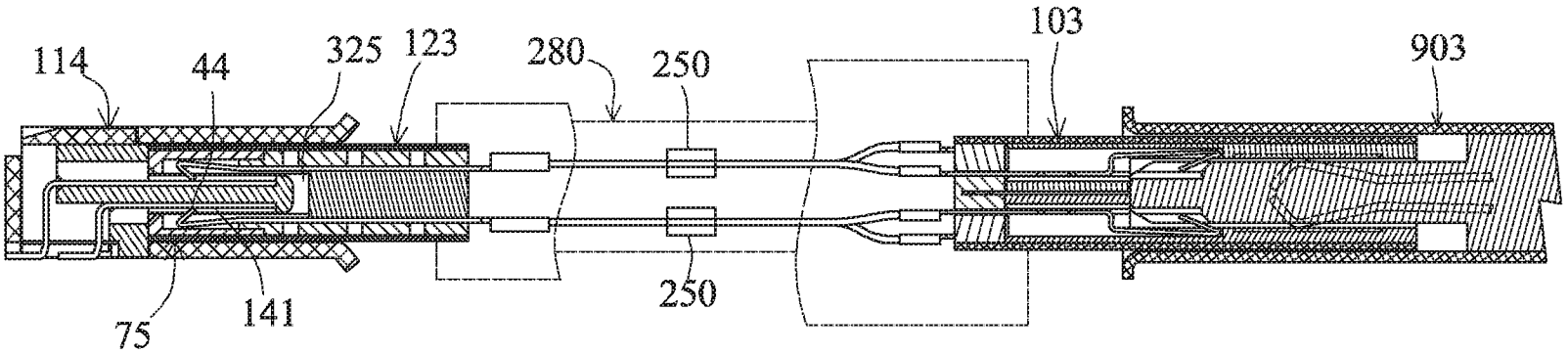
FIG. 34 is a side cross-sectional view according to a tenth embodiment of the invention.

Referring to FIG. 34, the tenth embodiment of the invention is an adapter cable 280 (also defined as a transmission medium) having one end connected to a dual-position duplex USB 3.0 electrical connection plug 103 (also defined as a second duplex electrical connection plug, or a duplex electrical connection structure), and the other end adapted into a dual-position duplex electrical connection plug 123 (also defined as a first duplex electrical connection plug) according to the ninth embodiment. The dual-position duplex USB 3.0 electrical connection plug 103 is inserted into a dual-position duplex USB 3.0 electrical connection socket 903 (also defined as a second duplex electrical connection socket, or a docking electrical connector docked with the duplex electrical connection structure) to achieve the doubled transmission. The dual-position duplex electrical connection plug 123 is inserted into a dual-position duplex electrical connection socket 114 (also defined as a first duplex electrical connection socket) to achieve the doubled transmission. The contact 141 of the dual-position duplex electrical connection socket 114 is not elastically movable.

The two contact interfaces of the docking dual-position duplex plug and socket have the same contact interface, and the circuit serial numbers of the connection points of the two contact interfaces are arranged reversely.

Figure 98:
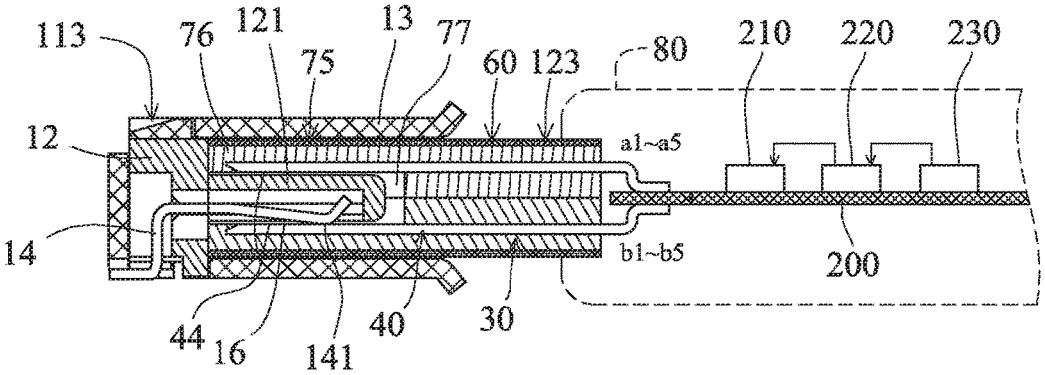
FIG. 98 is a side cross-sectional combination view according to the 25th embodiment of the invention.
Figure 100:
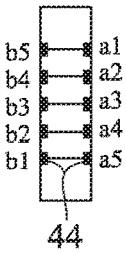
FIG. 100 is a schematic front view showing the two serially connected contact interfaces of the plug according to the 25th embodiment of the invention.
Figure 99:
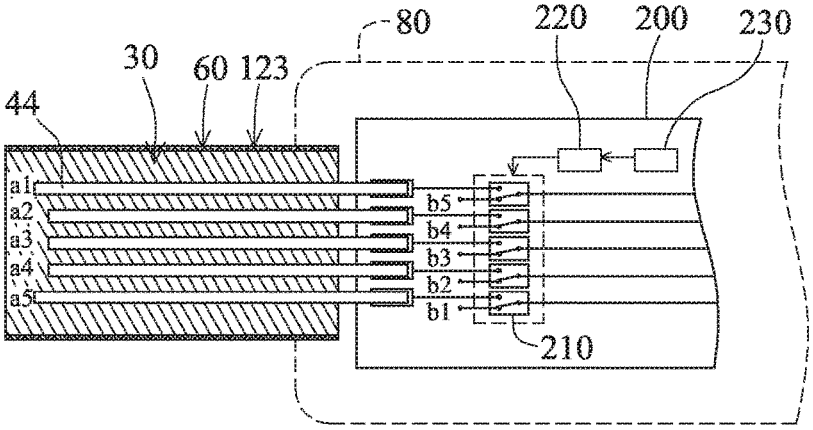
FIG. 99 is a schematic top view showing two serially connected contact interfaces of the plug according to the 25th embodiment of the invention.
Figure 102:
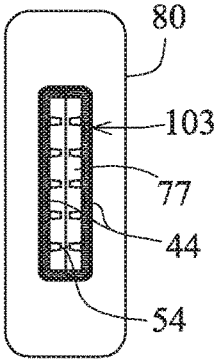
FIG. 102 is a front cross-sectional view showing the plug at one end according to the 26th embodiment of the invention.
Figure 101:
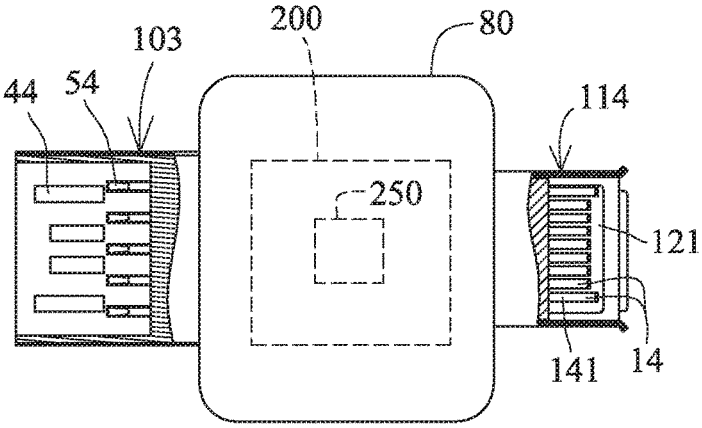
FIG. 101 shows a top cross-sectional view according to a 26th embodiment of the invention.
Figure 103:
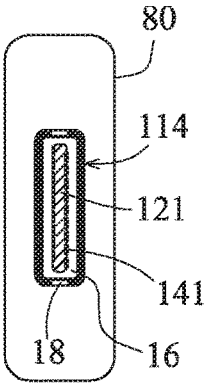
FIG. 103 is a front cross-sectional view showing the socket at the other end according to the 26th embodiment of the invention.
Figure 104:
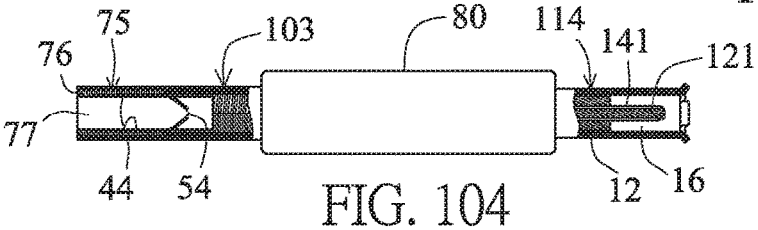
FIG. 104 shows a side cross-sectional view according to the 26th embodiment of the invention.

The adapter cable of this embodiment needs to be provided with two connection point switching devices 250, so that the two USB 3.0 contact interfaces of the dual-position duplex USB 3.0 electrical connection plug 103 and the two contact interfaces of the dual-position duplex electrical connection plug 123 can be integrated and switched mutually. That is, different connection points of the male and female contact interfaces can be integrated and switched mutually. The connection point switching device 250 may also switch the transmission of the corresponding circuit connection points when the two contact interfaces are respectively bidirectionally electrically connected together, wherein the switch control method thereof are shown in FIGS. 98 to 100.

The detailed structure explanation of the bidirectional duplex USB 3.0 electrical connection plug 103 is made according to FIGS. 55 to 84.

Figure 35:
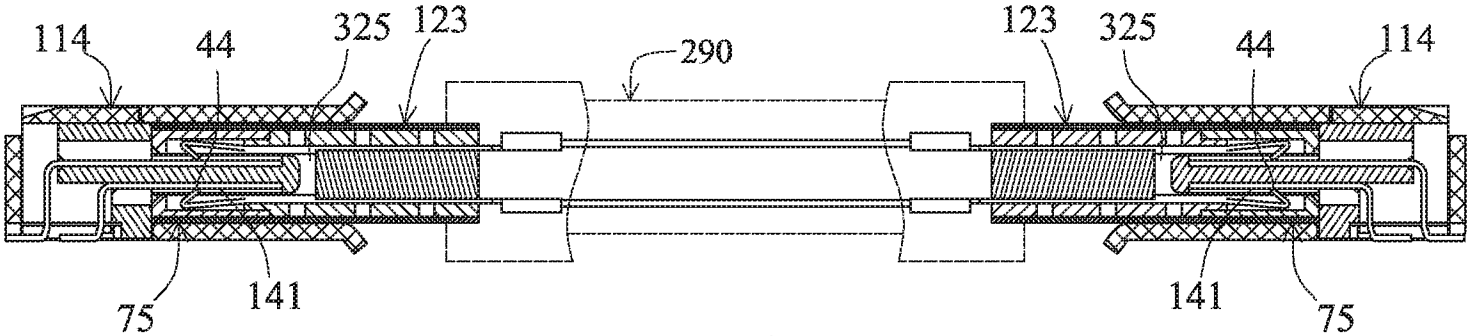
FIG. 35 is a side cross-sectional view according to an eleventh embodiment of the invention.

Referring to FIG. 35, the eleventh embodiment of the invention is a transmission cable 290 and is substantially the same as the tenth embodiment except for the difference that two ends of the transmission cable 290 of this embodiment are connected to a dual-position duplex electrical connection plug 123.

Figure 36:
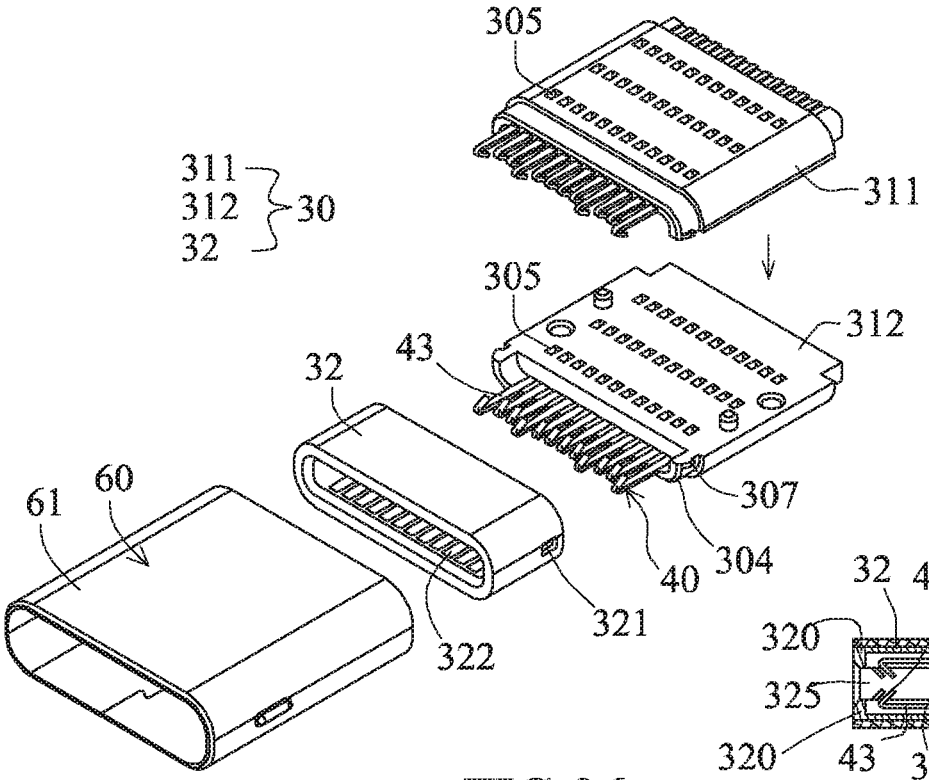
FIG. 36 is a pictorially exploded view according to a twelfth embodiment of the invention.
Figure 37:
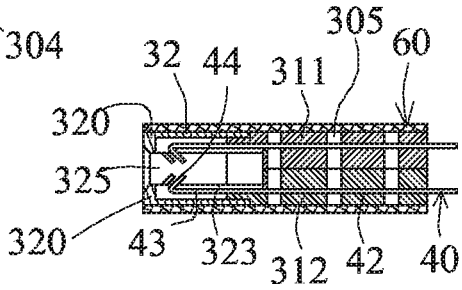
FIG. 37 is a side cross-sectional view according to the twelfth embodiment of the invention.

Referring to FIG. 36 and FIG. 37, the twelfth embodiment of the invention is a dual-position duplex electrical connection plug, and is substantially the same as the ninth embodiment except for the difference that the base seat of the insulated seat 30 is the same as the first embodiment and similarly provided with the vertically stacked first and second base seats 311 and 312, that the first and second base seats 311 and 312 are respectively integrally embedded and injection molded with one row of first terminals 40, that each of the first and second base seats 311 and 312 is formed with three rows of through holes 305, and that each through hole 305 corresponds to and penetrates through the fixing portion 42 of the first terminal 40. That is, some fixing portions 42 of the two rows of first terminals 40 are respectively embedded into the first and second base seats 311 and 312, wherein the two terminal sets substantially the same as the ninth embodiment.

In addition, the jointing portion 304 of the front end of the base seat is a hollow frame body, which is formed by stacking the inverse-U shaped frame body and the U-shaped frame body together so that the extensions 43 of the two rows of first terminals 40 may have the shorter elastically movable arm of force, and that the contact 44 has the larger normal force.

Figure 38:
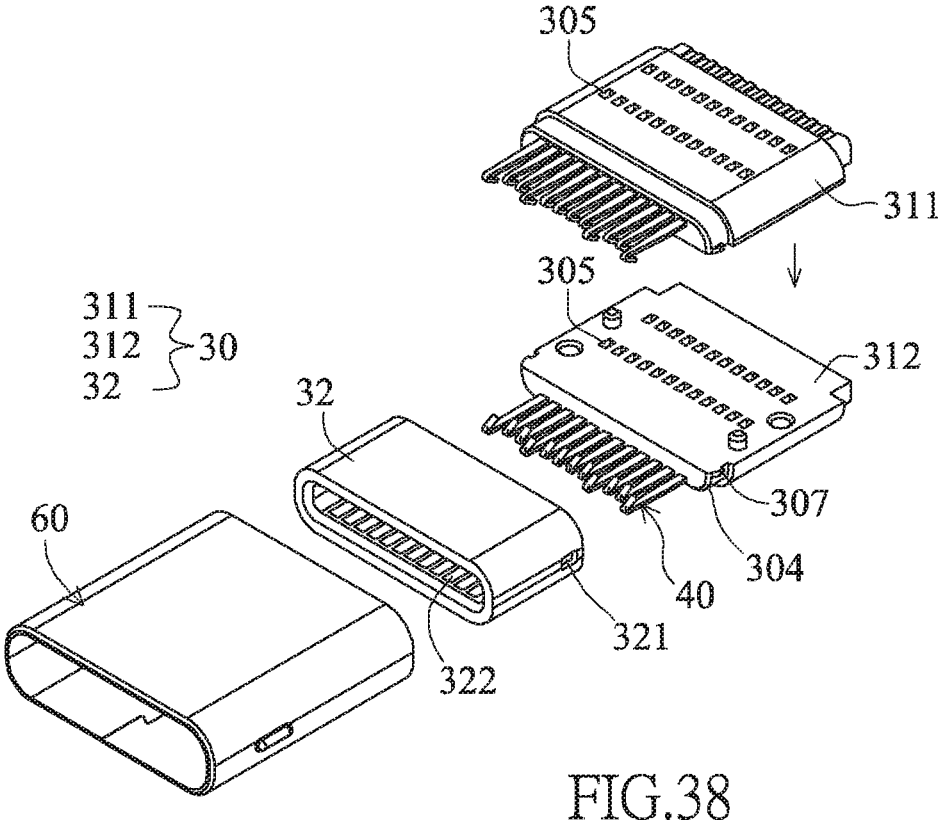
FIG. 38 is a pictorially exploded view according to a thirteenth embodiment of the invention.
Figures 39, 40, 41:
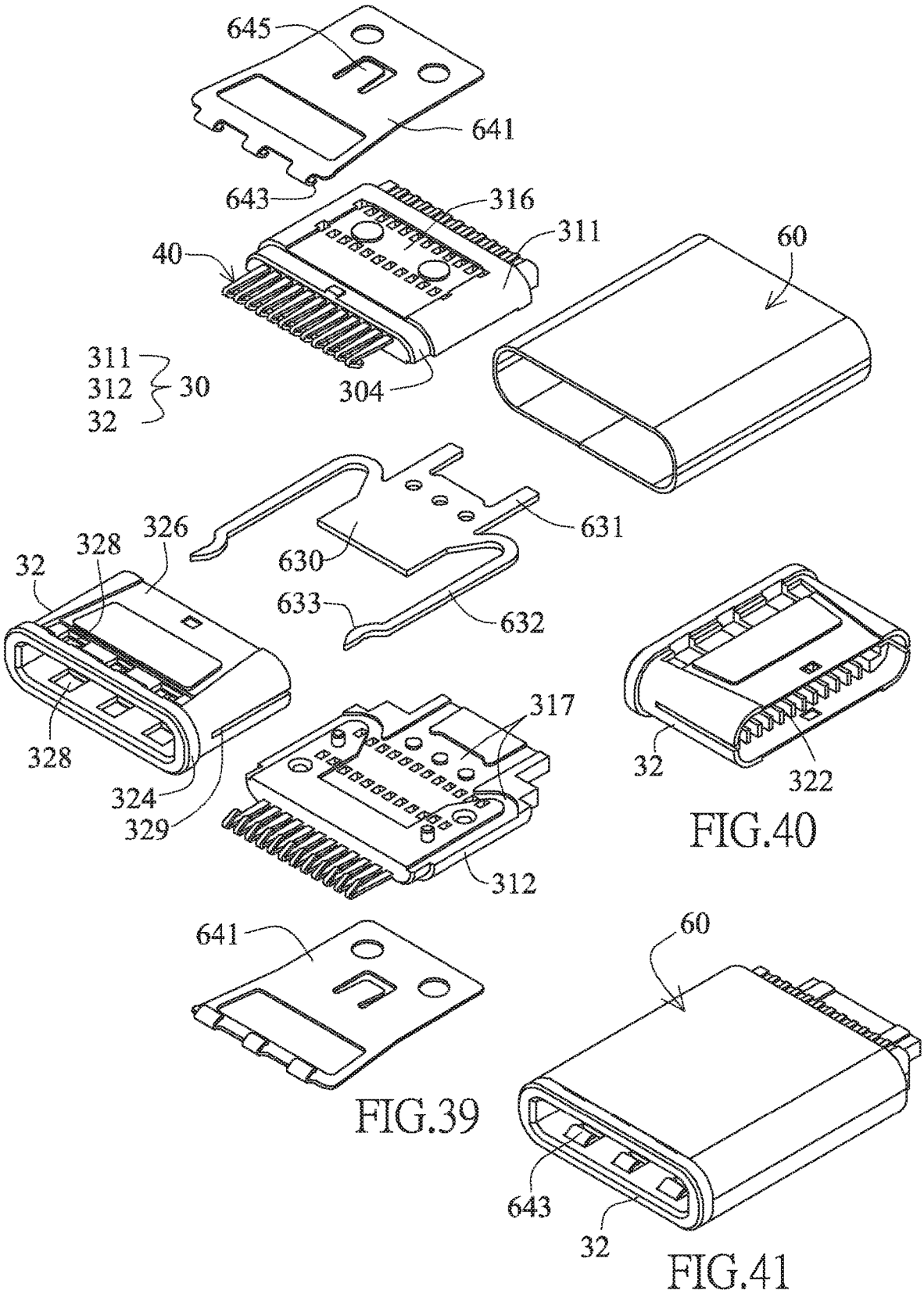
FIG. 39 is a pictorially exploded view according to a 14th embodiment of the invention.
FIG. 40 is a pictorial view showing the fitting member according to the 14th embodiment of the invention.
FIG. 41 is a pictorially assembled view according to the 14th embodiment of the invention.
Figure 42:
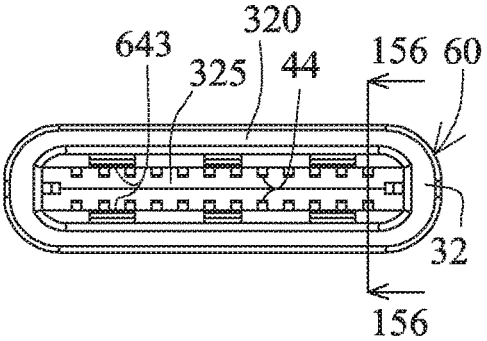
FIG. 42 is a pictorial front view according to the 14th embodiment of the invention.
Figure 43:
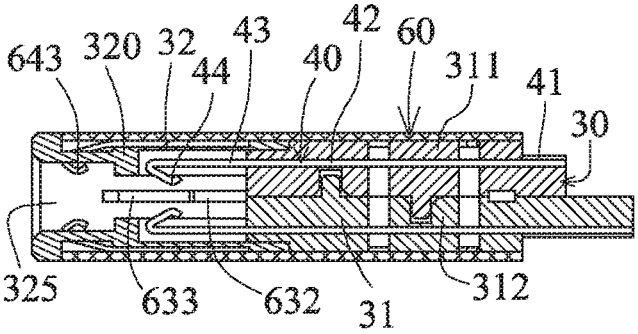
FIG. 43 is a side cross-sectional view according to the 14th embodiment of the invention.
Figure 44:
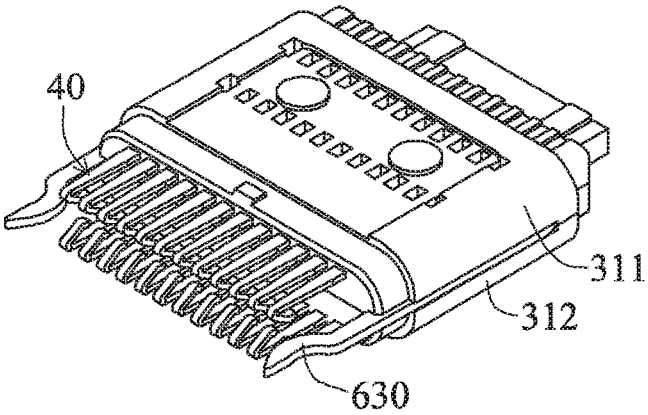
FIG. 44 is a pictorially assembled view showing the upper seat, the metal partition plate and the lower seat according to the 14th embodiment of the invention.
Figure 45:
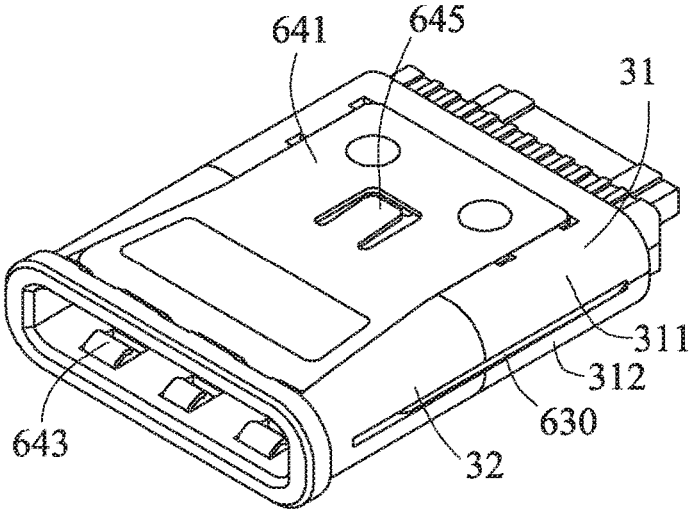
FIG. 45 is a pictorially assembled view (when the metal housing is not assembled) according to the 14th embodiment of the invention.

Referring to FIG. 38, the thirteenth embodiment of the invention is substantially the same as the twelfth embodiment except for the difference that the jointing portion 304 of the front end of the base seat of the insulated seat 30 is physical, so that the length of the docking part 32 needs to be longer than that of the twelfth embodiment. In addition, the extensions 43 of the two rows of first terminals 40 also need the longer elastically movable arm of force, so that the extensions of the two rows of first terminals 40 have the better resilience, but the normal force of the contact is decreased.

Referring to FIGS. 39 to 45, the 14th embodiment of the invention is a dual-position duplex USB TYPE-C electrical connection plug, and is substantially the same as the plug of the first embodiment and the twelfth embodiment except for the difference that: each of the outsides of the first and second base seats 311 and 312 of the base seat of the insulated seat 30 is provided with a concave surface 316; each of the top and bottom surfaces of the docking part 32 is provided with a concave surface 326, the front section of the concave surface 326 is provided with three openings 328, each of the left and right sides is provided with an opening 329, and the front end is provided with a convex ring 324 flush with the metal housing 60; the metal partition plate 630 and the two resilient snaps 632 of the left and right sides are on the same plane, the two resilient snaps 632 contact the metal housing 60 and extend into the connection slot 325 from the notches 329 of the left and right sides of the fitting member 320; and the two ground shielding sheets 641 are not integrally formed together and are separated from each other, the two ground shielding sheets 641 are respectively assembled and engaged with the concave surface 316 of the first and second base seats 311 and 312 and the top and bottom surfaces of the docking part 32, and each of the two ground shielding sheets 641 is provided with a projecting elastic sheet 645 resiliently resting against the metal housing 60.

Figure 46:
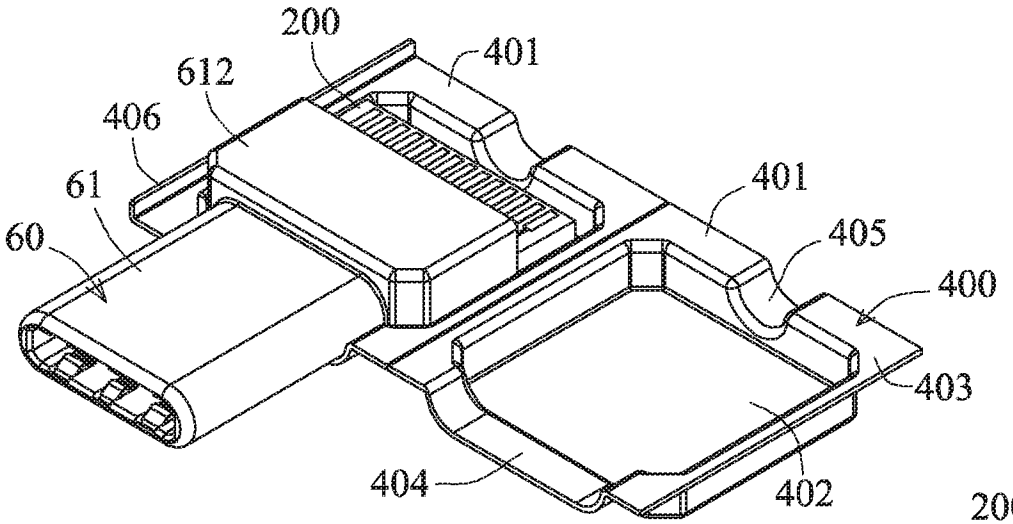
FIG. 46 is a pictorial view showing the open state of the rear shielding shell according to a 15th embodiment of the invention.

Referring to FIG. 46, the 15th embodiment of the invention is a dual-position duplex USB TYPE-C electrical connection plug, and is substantially the same as FIG. 15D of the first embodiment except for the difference that the convex shell 612 of the metal housing 60 is longer.

Figure 47:
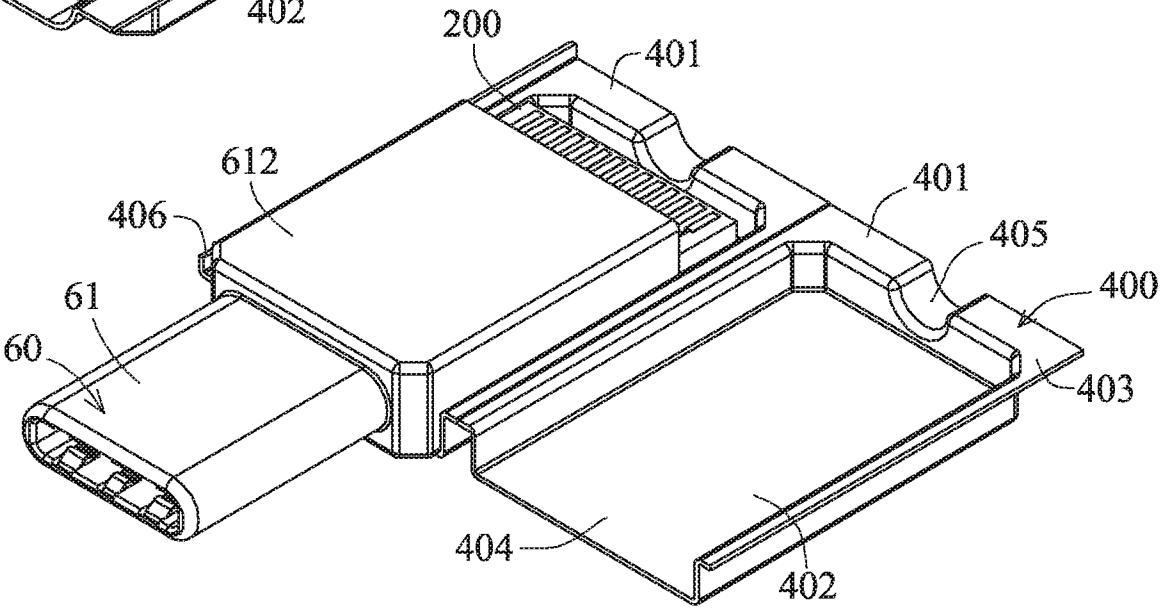
FIG. 47 is a pictorial view showing the open state of the rear shielding shell according to a 16th embodiment of the invention.

Referring to FIG. 47, the 16th embodiment of the invention is a dual-position duplex USB TYPE-C electrical connection plug, and is substantially the same as the 15th embodiment except for the difference that the fitting port 404 of the rear shielding shell 400 is fitted with the convex shell 612, and the fitting port 404 is flush with the height of the accommodating space.

Figure 48:
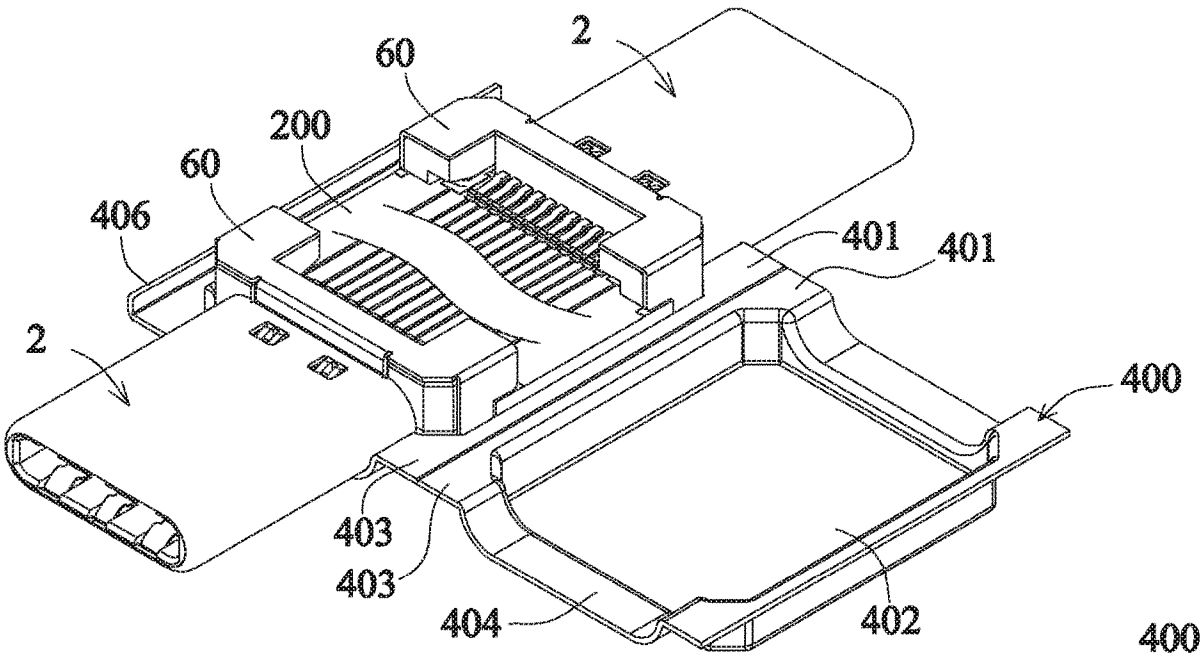
FIG. 48 is a pictorial view showing the open state of the rear shielding shell according to a 17th embodiment of the invention.
Figure 49:
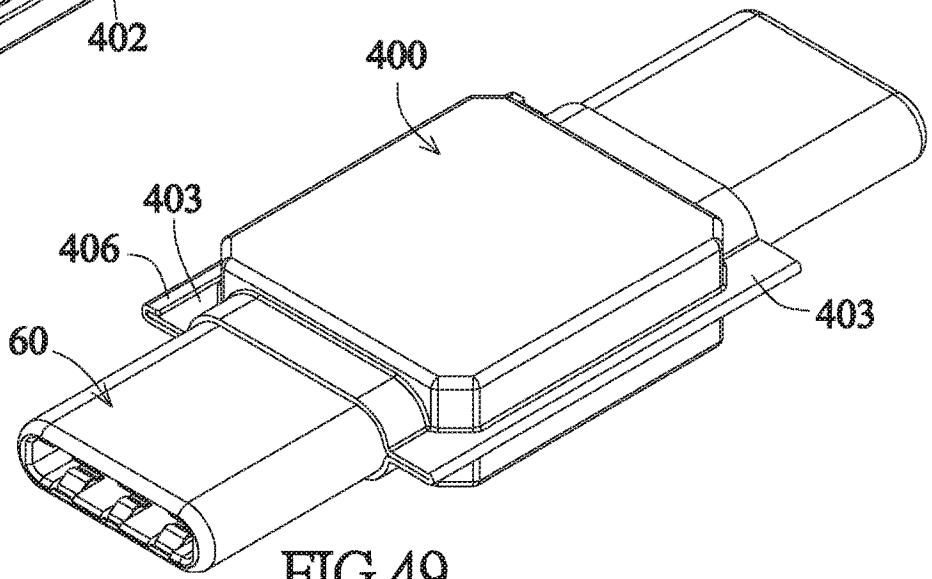
FIG. 49 is a pictorial view showing the closed state of the rear shielding shell according to the 17th embodiment of the invention.

Referring to FIGS. 48 and 49, the 17th embodiment of the invention is an adapter, and each of two ends of the adapter is a dual-position duplex USB TYPE-C electrical connection plug 2. Two terminal sets of the two dual-position duplex USB TYPE-C electrical connection plugs 2 are electrically connected to the circuit board 200, through which the adaptation is made. The rear sections of the metal housings 60 of the two dual-position duplex USB TYPE-C electrical connection the plugs 2 are covered by the same rear shielding shell 400. The rear shielding shell 400 is substantially the same as the FIG. 15D except for the difference that the length of the rear shielding shell 400 is longer and the front and rear ends thereof are fitting ports 404.

Two ends of the implemented adapter may also be a plug and a socket, respectively, or sockets, or any other type of plug or socket.

Figure 50:
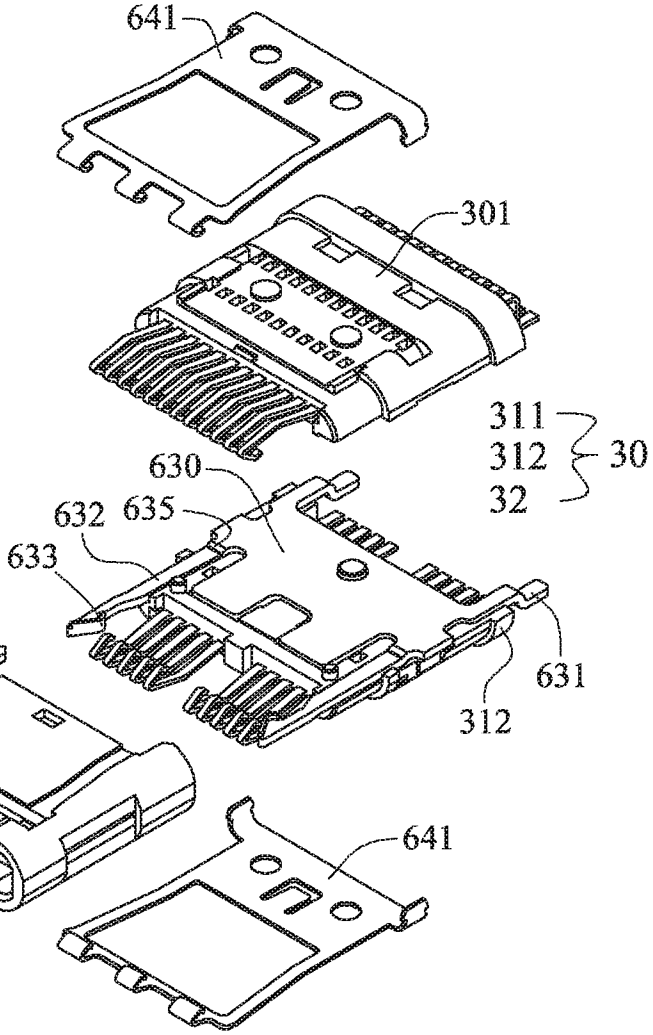
FIG. 50 is a pictorially exploded view according to an 18th embodiment of the invention.
Figure 51:
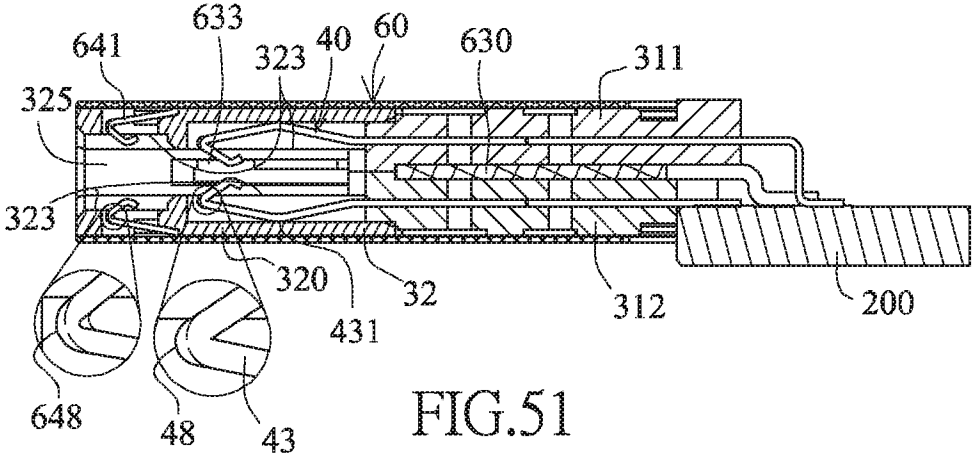
FIG. 51 is a side cross-sectional view according to the 18th embodiment of the invention.

Referring to FIGS. 50 and 51, the 18th embodiment of the invention is a dual-position duplex USB TYPE-C electrical connection plug, and is substantially the same as the 14th embodiment except for the difference that the fulcrums 431 of the extensions 43 of the two rows of first terminals 40 rest against the connection plate 320, so that the elastically movable arm of force has the high structural strength and the good resilience, that the contact 44 has the larger normal force, and that a bent angle 48 formed by reversely bending the end section of the extension 43 can be machined by the secondary machining to form a structure smaller than the naturally bent arc (see dashed lines). Thus, the bent angle 48 cannot project beyond the rear section of the connection surface 323. The bent angle 648 of the ground shielding sheet 641 is also machined by the secondary machining to form a structure smaller than the naturally bent arc (see dashed lines), so that the bent angle 648 cannot project beyond the front section of the connection surface 323, and can be used more smoothly.

In addition, the pins of the two terminal sets are electrically connected to a circuit board 200. The circuit board 200 may be provided with associated electrical elements or circuit protecting electrical elements. The circuit board 200 may be electrically connected to an electronic unit. The pins of the two sets of terminals and the electronic unit form the electrical connection through the circuit board.

Furthermore, the snapping convex portion 633 of the resilient snap 632 is formed by drawing and pulling a plate surface to have a larger height greater than the thickness of the metal partition plate 630. The section of the resilient snap 632 is provided with a bent portion 635 so that a vertical step is formed between the front section and the rear end, and that the middle height of the snapping convex portion 633 is substantially disposed at the middle thickness of the metal partition plate 630.

Figure 52:
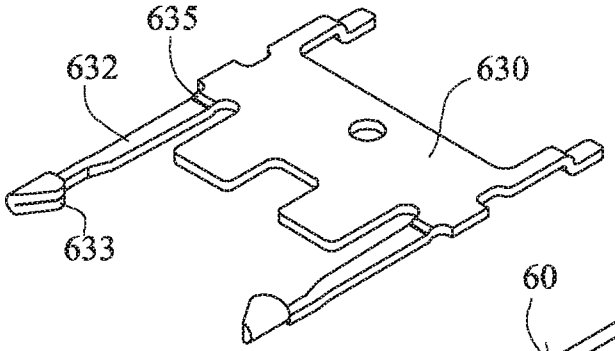
FIG. 52 is a pictorial view showing another variation of the metal partition plate according to the 18th embodiment of the invention.

Referring to FIG. 52 showing another variation of this embodiment, the snapping convex portion 633 is formed by stacking two plate surfaces of the resilient snap 632 to have the larger height.

Figure 53:
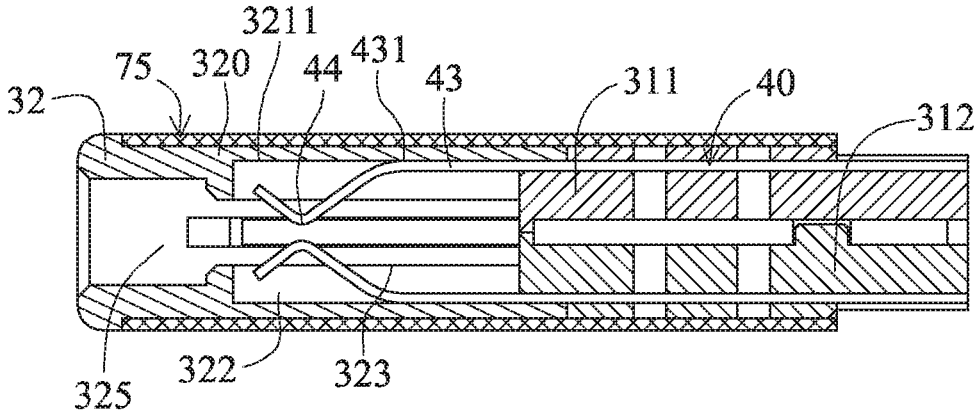
FIG. 53 is a side cross-sectional view according to a 19th embodiment of the invention.
Figure 54:
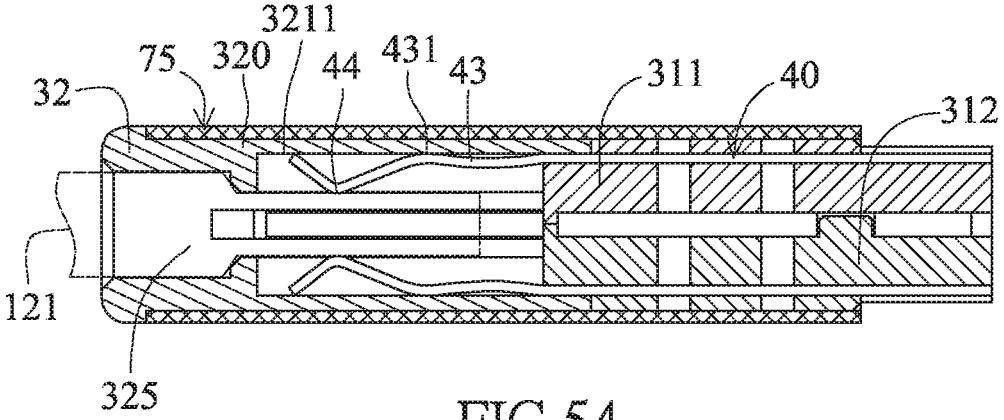
FIG. 54 is a diagram showing the implemented state according to the 19th embodiment of the invention.

Referring to FIG. 53 and FIG. 54, the 19th embodiment of the invention is a dual-position duplex USB TYPE-C electrical connection plug, and is substantially the same as the 14th embodiment except for the difference that the extensions 43 of the inner ends of the contacts 44 of the two rows of first terminals 40 of this embodiment are provided with a fulcrum 431 resting against the bottom surface 3211 of the elastic movement space 322, the extension 43 of the inner end of the fulcrum 431 is in flat surface contact with the bottom surface 3211. The extension 43 of the outer end of the fulcrum 431 does not rest against the bottom surface 3211. Referring to FIG. 54, when the connection slot 325 is connected to the tongue 121 of the socket and the contact 44 is pressed to elastically move toward the bottom surface 3211, the contact 44 has the larger normal force with the action of the fulcrum 431. Meanwhile, the extension 43 of the inner end of the fulcrum 431 elastically moves reversely, so the good resilience still can be obtained.

Referring to FIGS. 55 to 67, the 20th embodiment of the invention provides a bidirectional USB 2.0 electrical connection plug and a bidirectional USB 2.0 electrical connection socket.

Figure 55:
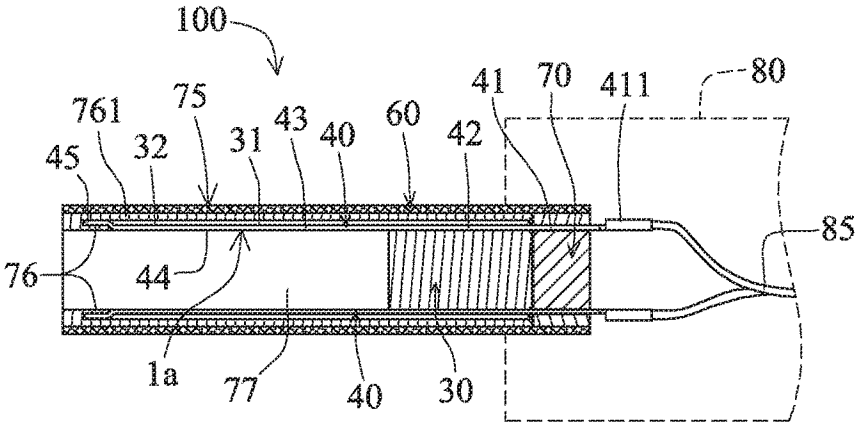
FIG. 55 is a side cross-sectional view showing a duplex plug according to a 20th embodiment of the invention.
Figure 57:
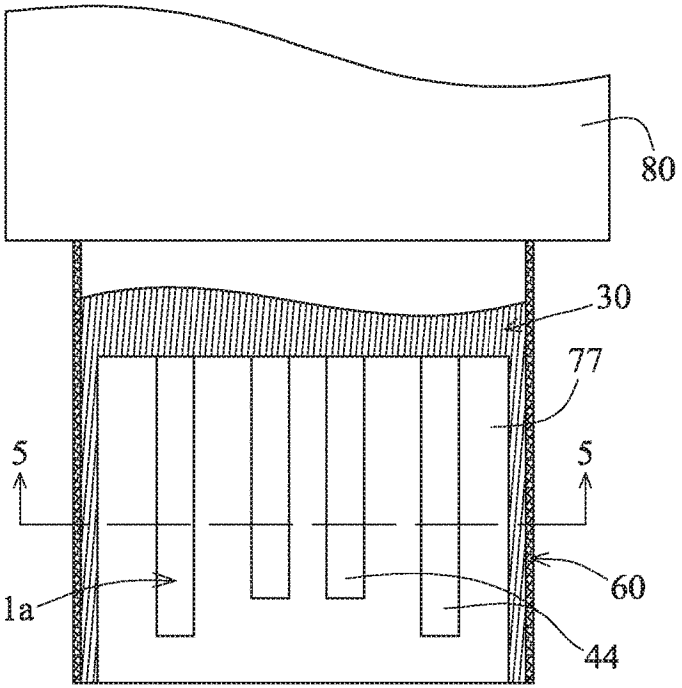
FIG. 57 is a top cross-sectional view showing the duplex plug according to the 20th embodiment of the invention.
Figure 56:
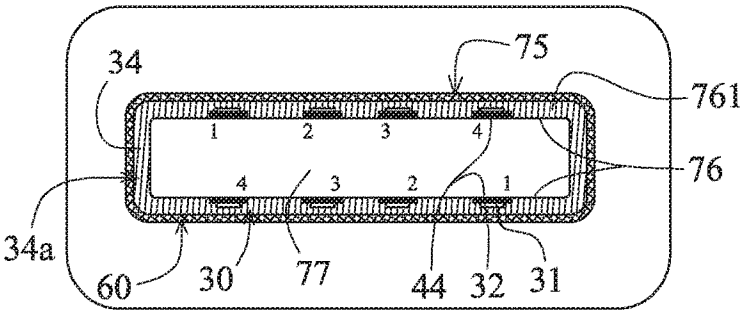
FIG. 56 is a front cross-sectional view showing the duplex plug according to the 20th embodiment of the invention.

Referring to FIGS. 55 to 57, a bidirectional duplex USB 2.0 electrical connection plug 100 of this embodiment comprises an insulating base 30, two rows of first terminals 40, a metal housing 60, a fitting portion 75, a positioning structure 34*a* and a rear plug 70.

The insulating base 30 is plastically injection molded and has a front segment formed with a fitting space 77. The insulating base 30 forms top, bottom, left and right sides of the fitting space 77. The cross-section of the front segment of the insulating base 30 is a hollow rectangular frame structure. The insertion port of the fitting space 77 faces frontwards. The insulating base 30 has two rows of first terminal slots 31, wherein a middle of the first terminal slot 31 has a concave portion 32.

Figure 58:
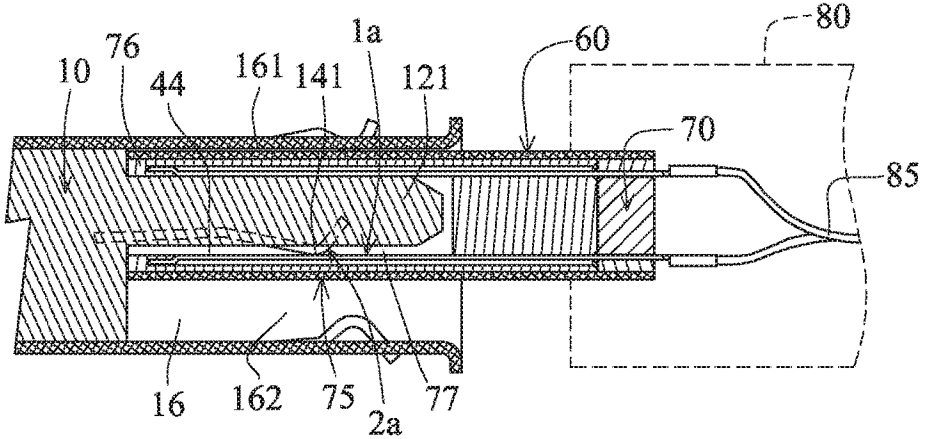
FIG. 58 is a side cross-sectional view showing a used state of the duplex plug according to the 20th embodiment of the invention.

The metal housing 60 covers the insulating base 30. The front-view shape of the metal housing 60 is rectangular, top-bottom symmetrical and left-right symmetrical. As shown in FIG. 58, the metal housing 60 has an open back end and has no projecting upright plate sheet.

The fitting portion 75 is disposed at the front end of the insulating base 30. The fitting portion 75 has two opposite contact interface substrates 76 and a fitting space 77. The two contact interface substrates 76 each having an insulating layer 761 are separated by the fitting space 77. The insulating layers 761 of the inside layers of the two contact interface substrates 76 are integrally formed jointly with the insulating base 30, and the outside layers of the contact interface substrates 76 pertain to the metal housing 60. The fitting space 77 is the same as the fitting space 77 of the insulating base 30. The insulating layers 761 of the inside layers of the two contact interface substrates 76 are the top and bottom sides of the fitting space 77. Each of the two contact interface substrates 76 has a USB 2.0 contact interface 1*a* to be electrically connected to an A-type biased USB 2.0 electrical connection socket. The two USB 2.0 contact interfaces 1*a* are formed by the two rows of first terminals 40. The two USB 2.0 contact interfaces 1*a* are electrically connected to the rear end of the insulating base 30, and the two USB 2.0 contact interfaces 1*a* have the same contact interface and the connection points with the circuit serial numbers arranged reversely. The fitting portion 75 has the rectangular external shape in a top-bottom symmetrical and left-right symmetrical manner. The fitting portion 75 can be bidirectionally inserted into the connection slot of the A-type biased USB 2.0 electrical connection socket. The two contact interface substrates 76 can be fit into the small space.

The positioning structure 34*a* is integrally formed jointly with front segments of two sidewalls 34 of the insulating base 30. The two sidewalls 34 are integrally connected to two sides of the insulating layers of the two contact interface substrates 76 to position the insulating layers 761 of the two contact interface substrates 76. The insulating layers 761 of the two contact interface substrates 76 are the top and bottom sides of the fitting space 77. The two sidewalls 34 are the left and right sides of the fitting space 77.

The two rows of first terminals 40 each having four first terminals are assembled and fixed to the two rows of first terminal slots 31 of the insulating base 30, the first terminal 40 sequentially has, from one end to the other end, a pin 41, a fixing portion 42 and an extension 43. The fixing portion 42 is fixed to the first terminal slot 31. The extension 43 is connected to the front end of the fixing portion 42, extends to the contact interface substrate 76 and has a contact 44. The contact 44 is not elastically movable and is flush with the inner surface of the contact interface substrate 76. The front end of the extension 43 has an engagement portion 45 engaged into the engagement hole formed at the front end of the concave portion 32. The pin 41, which is connected to the other end of the fixing portion 42 and projects beyond the rear end of the insulating base 30, has a distal segment formed with a wiring portion 411. The contacts 44 of the two rows of first terminals 40 respectively form the USB 2.0 contact interfaces 1*a* of the two contact interface substrates 76. The two USB 2.0 contact interfaces 1*a* are the same contact interface and have the connection points with the circuit serial numbers arranged reversely, as shown in FIG. 5. The upper USB 2.0 contact interface 1*a* has the connection points with the circuit serial numbers of 1, 2, 3, 4 from left to right, and the lower USB 2.0 contact interface 1*a* has the connection points with the circuit serial numbers of 4, 3, 2, 1 from left to right. According to the USB 2.0 contact interface specified by USB Association, the connection point with the circuit serial number 1 is the ground contact, the connection point with the circuit serial number 4 is the power contact, and the connection points with the circuit serial numbers 3 and 2 are one pair of signal contacts represented by D+ and D−, respectively.

The rear plug 70 is tightly fit within the rear segment of the metal housing and at the rear end of the insulating base. The rear plug 70 is a three-piece combination so that the pins 41 of the two rows of first terminals 40 can pass through and closely fit with the rear plug 70. The rear plug 70 mainly plugs the voids communicating the two rows of first terminal slots 31 with the rear end of the insulating base 30.

This embodiment functions as a connector of a connection cable. An insulating housing 80 covering the rear segment of the metal housing 60 is formed by way of glue pouring. The provision of the rear plug 70 can prevent the glue liquid from flowing into the first terminal slot 31 in the glue pouring process. Regarding the wiring portions 411 of the pins of the two rows of first terminals 40, the connection points with the same circuit serial number is connected to the same wire 85.

Referring to FIG. 58, with the above-mentioned structure, the heights of the two contact interface substrates 76 of the fitting portion 75 can be fit into the small space 161 of the connection slot 16 of the A-type biased USB 2.0 electrical connection socket 10. So, the fitting portion 75 can be bidirectionally inserted into the connection slot 16 of the A-type biased USB 2.0 electrical connection socket 10, and the USB 2.0 contact interface 1*a* (contacts 44) of one of the two contact interface substrates 76 is electrically connected to the USB 2.0 contact interface 2*a* (contacts 141) below the tongue 121 of the A-type biased USB 2.0 electrical connection socket 10.

The two contact interface substrates 76 of the fitting portion 75 of this embodiment have the same height of about 0.65 mm, and the fitting space 77 is about 1.95 mm, so the height of the fitting portion 75 is about 3.25 mm, which is significantly lower than the height (4.5 mm) of the connection portion of the A-type biased USB 2.0 electrical connection plug 20, and higher than the large space 162 (2.65 mm) of the connection slot 16 of the A-type biased USB 2.0 electrical connection socket 10. Thus, the fitting portion 75 cannot be incorrectly inserted into the large space 162 when being used. Upon designing, however, the height of the contact interface substrate 76 may range between 0.5 mm and 0.85 mm, and the height of the fitting portion 75 may range between 3 mm and 4 mm.

According to the above-mentioned descriptions, the plug of this embodiment has the following advantages.

1. The fitting portion 75 can be bidirectionally inserted into the connection slot 16 of the A-type biased USB 2.0 electrical connection socket 10 for electrical connection, and can be used in a very convenient manner.

2. The height of the fitting portion 75 is about 3.25 mm significantly lower than the height (4.5 mm) of the connection portion of the A-type biased USB 2.0 electrical connection plug 20, and has the slim and light advantages.

3. The structure is simplified and can be easily manufactured.

Figure 60:
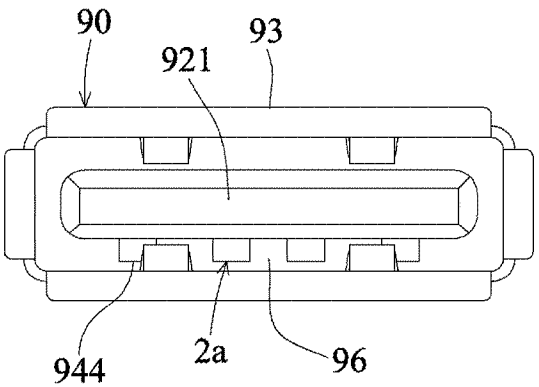
FIG. 60 shows a front view according to a 20th embodiment of the invention.
Figure 59:
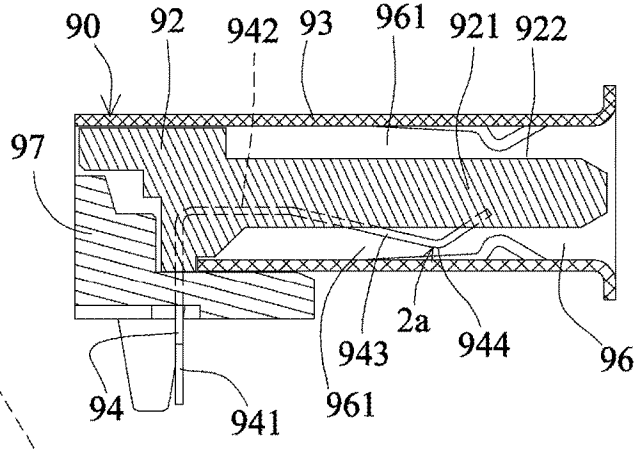
FIG. 59 is a side cross-sectional view showing a simplex socket according to the 20th embodiment of the invention.

Referring to FIGS. 59 and 60, a bidirectional simplex USB 2.0 electrical connection socket 90 of this embodiment comprises an insulating base 92, a metal housing 93, one row of first terminals 94 and a rear cover 97.

The insulating base 92 is plastically injection molded and has a front end with a middle projectingly formed with a horizontally extending tongue 921, wherein the bottom side of the tongue 921 has a USB 2.0 contact interface 2*a*. The USB 2.0 contact interface 2*a* is formed by the one row of first terminals 94. The contact interface is electrically connected to the rear end of the insulating base 30.

The metal housing 93 covers the insulating base 92 and the tongue 921 to form a connection slot 96 at the front end of the insulating base 92. The tongue 921 is disposed at a middle height of the connection slot 96. Two symmetrical spaces 961 are formed on the upper and lower connection surfaces 922 of the tongue 921. The external shape of the connection slot 96 is rectangular, top-bottom symmetrical and left-right symmetrical.

The one row of first terminals 94 are assembled or embedded into the insulating base 92. Each terminal has a pin 941, a fixing portion 942 and an extension 943. The fixing portion 942 is fixed to the insulating base 92. The extension 943 connected to the front end of the fixing portion 942 extends to the tongue 921 and has a contact 944. The contact 944 projecting beyond the bottom side of the tongue 921 is vertically elastically movable (or elastically movable up and down). The pin 941 connected to the rear end of the fixing portion 942 projects beyond the insulating base. The contacts 944 of the one row of first terminals 94 form the USB 2.0 contact interface 2*a*.

The rear cover 97 covers the rear and bottom of the insulating base 92 to position the pins 941 of the one row of first terminals 94.

This embodiment is characterized in that the spaces of the connection slot 96 on the upper and lower connection surfaces of the tongue 921 have the same height of about 0.72 mm, which is smaller than the large space 162 of the A-type biased USB 2.0 electrical connection socket and is substantially equal to the small space. The height of the tongue 921 is still 1.84 mm. The height of the connection slot 96 is about 3.3 mm, which is significantly lower than the A-type biased USB 2.0 electrical connection socket 10. A fitting portion of an electrical connection plug can be bidirectionally inserted into the connection slot 96.

Figure 61:
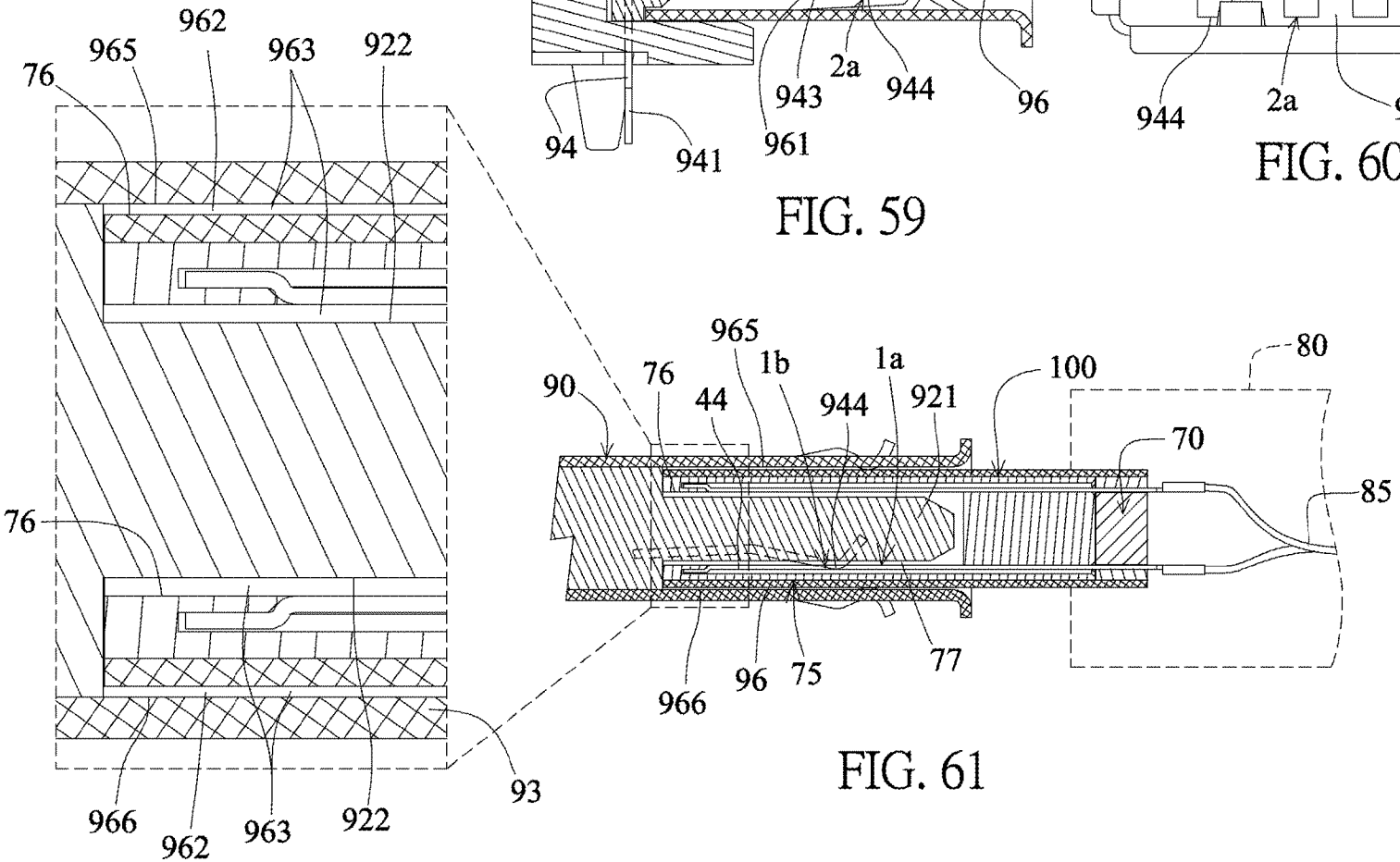
FIG. 61 is a side cross-sectional view showing a combination of the simplex socket and the duplex plug according to the 20th embodiment of the invention.

Referring to FIG. 61, with the above-mentioned structure, the heights of the two contact interface substrates 76 of the fitting portion 75 of the bidirectional duplex USB 2.0 electrical connection plug 100 can be fit into the spaces on the upper and lower connection surfaces of the tongue 921 of the connection slot 96. So, the fitting portion 75 can be bidirectionally inserted into the connection slot 96 of the bidirectional simplex USB 2.0 electrical connection socket 90, and the USB 2.0 contact interface 1*a* (contacts 44) of one of the two contact interface substrates 76 is electrically connected to the USB 2.0 contact interface 2*a* (contacts 944) of the bottom side of the tongue 921 of the bidirectional simplex USB 2.0 electrical connection socket 90. In addition, both of the fitting portion 75 of the bidirectional duplex USB 2.0 electrical connection plug and the connection slot 96 of the bidirectional simplex USB 2.0 electrical connection socket 90 can achieve the better fitting. That is, the two contact interface substrates 76 and the two spaces 961 on the upper and lower connection surfaces 922 of the tongue 921 of the connection slot 96 are tightly fit, each of two first fitting gaps 962 respectively between the two contact interface substrates 76 and an upper surface 965 and a lower surface 966 of the connection slot 96 is smaller than 0.15 mm, and each of the fitting gaps 963 left after the two spaces 961 are respectively fit with the contact interface substrates 76 is smaller than 0.15 mm. So, this is different from FIG. 58, in which a too large space is still left when the contact interface substrate 76 is in the large space 162.

Regarding the design of this embodiment, the spaces of the connection slot 96 on the upper and lower connection surfaces of the tongue 921 may have the same height or different heights, wherein the height may range between 0.55 mm and 2.1 mm. The height of the connection slot 96 may be designed to range between 3 mm and 6 mm. Thus, the height of the contact interface substrate matching with the inserted bidirectional USB 2.0 electrical connection plug ranges between 0.5 mm and 2.0 mm, and the height of the fitting portion ranges between 3 mm and 6 mm.

Figure 62:
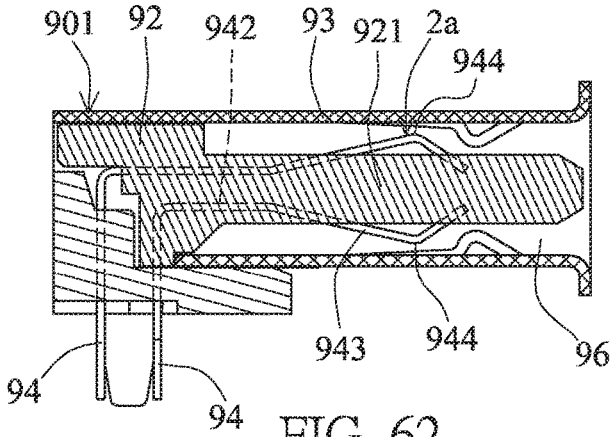
FIG. 62 is a side cross-sectional view showing a duplex socket according to the 20th embodiment of the invention.
Figure 63:
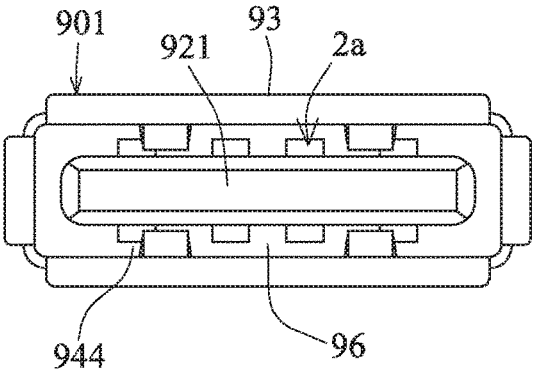
FIG. 63 is a front view showing the duplex socket according to the 20th embodiment of the invention.

Referring to FIGS. 62 and 63, a USB 2.0 bidirectional duplex electrical connection socket 901 of this embodiment is almost the same as the bidirectional simplex USB 2.0 electrical connection socket 90 except for the differences that there is additionally provided with one row of first terminals 94, and that the top side of the tongue 921 is also formed with a USB 2.0 contact interface 2*a*. The USB 2.0 contact interfaces 2*a* on the top and bottom sides of the tongue 921 have the same contact interface, and the connection points with the circuit serial numbers arranged reversely.

Figure 64:
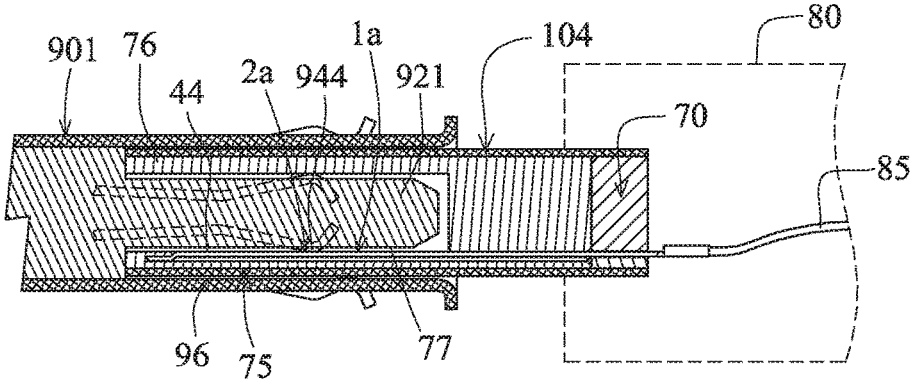
FIG. 64 is a side cross-sectional view showing a combination of the duplex socket and the simplex plug according to the first embodiment of the invention.

Referring to FIG. 64, a bidirectional simplex USB 2.0 electrical connection plug 104 is almost the same as the bidirectional duplex USB 2.0 electrical connection plug 100 except for the difference that only one of the two contact interface substrates 76 of the fitting portion 75 has the USB 2.0 contact interface 1*a*. So, the fitting portion 75 can be bidirectionally inserted into the connection slot 96 of the bidirectional duplex USB 2.0 electrical connection socket 901, and the USB 2.0 contact interface 1*a* (contacts 44) of the contact interface substrate 76 is inevitably electrically connected to one of the USB 2.0 contact interfaces 2*a* (contacts 944) on the top and bottom sides of the tongue 921 of the bidirectional duplex USB 2.0 electrical connection socket 901.

Figure 65:
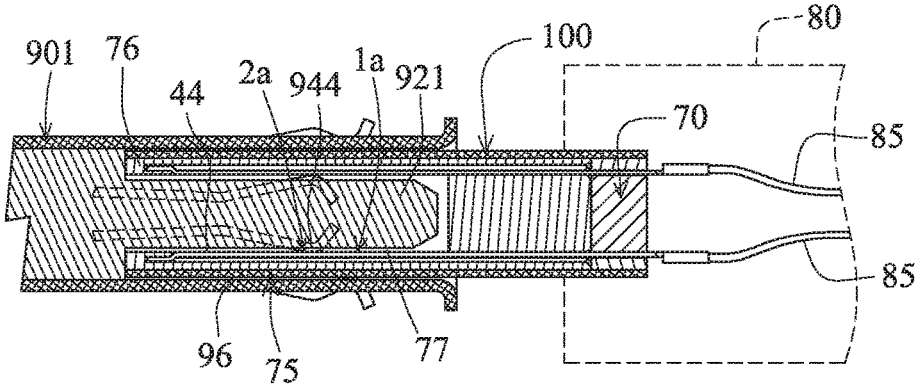
FIG. 65 is a side cross-sectional view showing a combination of the duplex socket and the duplex plug according to the 20th embodiment of the invention.

Referring to FIG. 65, the fitting portion 75 of the bidirectional duplex USB 2.0 electrical connection plug 100 can be bidirectionally inserted into the connection slot 96 of the bidirectional duplex USB 2.0 electrical connection socket 901, so that the two USB 2.0 contact interfaces 1*a* and 2*a* of the plug and the socket can be bidirectionally connected to achieve the convenient use and the doubled transmission speed. However, the plug and the socket of this embodiment are slimmer and lighter than those of the prior art.

As shown in FIGS. 65 and 64, the two contact interface substrates 76 of the plug and the spaces on the upper and lower connection surfaces of the tongue 921 of the connection slot 96 of the socket are tightly fit, wherein the fitting gap is smaller than 0.15 mm.

The socket of this embodiment has two contact interfaces, so the socket is electrically connected to a circuit board. The circuit board may have cascaded circuits to electrically connect the connection points of the two contact interfaces of the socket with the same circuit serial number to the same circuit to form one set of circuits. Thus, it can work in conjunction with a bidirectional simplex electrical connection plug to perform the bidirectional corresponding connection.

Figure 66:
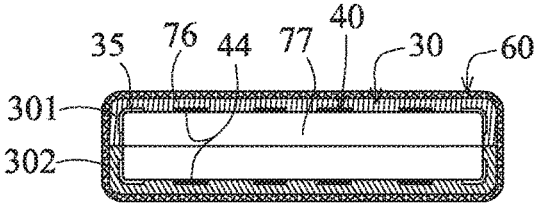
FIG. 66 is a front cross-sectional view showing another duplex plug according to the 20th embodiment of the invention.

Referring to FIG. 66, another modification of the bidirectional duplex USB 2.0 electrical connection plug of this embodiment is provided with the difference that the insulating base 30 is formed by stacking an upper base 301 and a lower base 302, wherein the cross-section of the front segment of the upper base 301 is inversely U-shaped, and the cross-section of the front segment of the lower base 302 is U-shaped. Each of the upper and lower bases 301 and 302 is embedded into and injection molded with one row of first terminals 40. Each of the upper and lower bases 301 and 302 forms the insulating layer of the contact interface substrate 76. An L-shaped reinforcing sheet 35 is assembled with or embedded into each of the left and right sides of the insulating layers of the two contact interface substrates 76.

In addition, each of the upper and lower bases 301 and 302 may be formed with one row of terminal slots, into which one row of first terminals are assembled.

Figure 67:
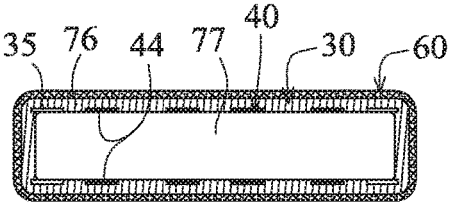
FIG. 67 is a front cross-sectional view showing another duplex plug according to the 20th embodiment of the invention.

Referring to FIG. 67, another modification of the bidirectional duplex USB 2.0 electrical connection plug of this embodiment is provided with the differences that the reinforcing sheet 35 is horizontal I shaped, and that the insulating base 30 is integrally embedded into and injection molded with the two rows of first terminals.

Referring to FIGS. 68 to 84, the 21st embodiment of the invention provides a bidirectional USB 3.0 electrical connection plug and a bidirectional USB 3.0 electrical connection socket.

Referring to FIGS. 68 to 71, a bidirectional duplex USB 3.0 electrical connection plug 103 of this embodiment is almost the same as the first embodiment except for the differences that two rows of five second terminals 50 are further provided, that the insulating base 30 has the upper and lower bases 301 and 302 stacked vertically, and that each of the upper and lower bases 301 and 302 has one row of five second terminal slots 33. Each of the rows of second terminal slots 33 extend to a contact interface substrate 76 and form one row of elastic movement spaces 762 separately arranged and depressed into the insulating layer 761. The insulating layer 761 has a bottom surface 763 on the one row of depressed elastic movement spaces 762 and is separated from the metal housing 60. The two rows of second terminals 50 are assembled into the two rows of second terminal slots 33, respectively. The two rows of first terminals 40 are embedded into, injected molded with and fixed to the upper and lower bases 301 and 302. In addition, a transversally extending metal partition plate 87, for separating the two rows of second terminals 50 to reduce the mutual electric interference and facilitate the high-speed transmission, is provided between the upper and lower bases 301 and 302.

Figure 18:
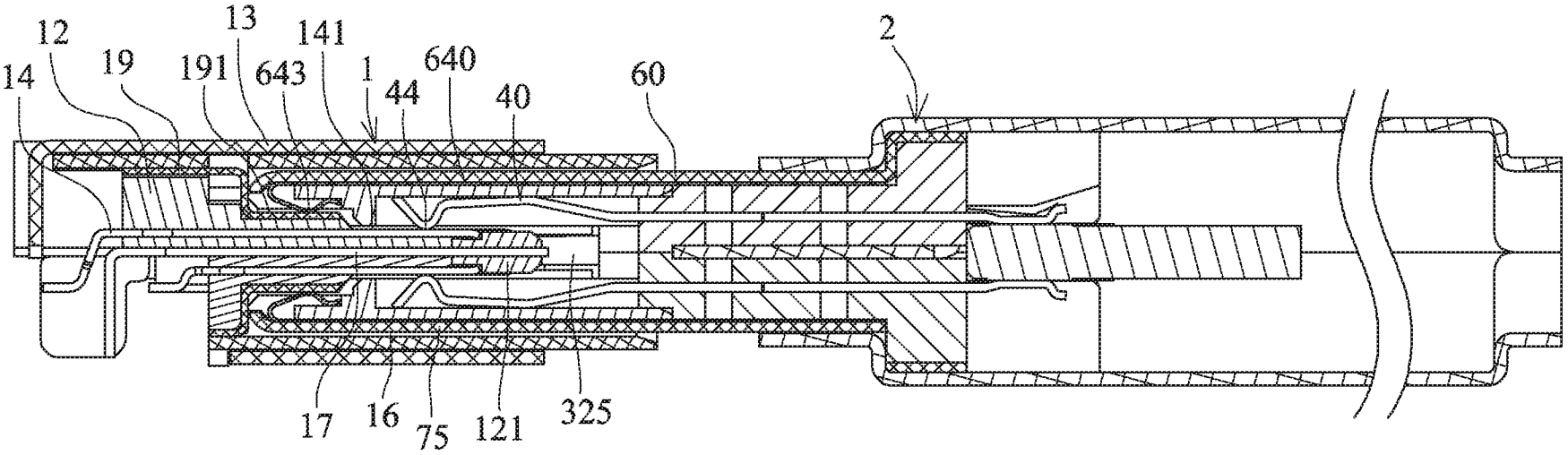
FIG. 18 is a side cross-sectional view showing docking between the first embodiment of the invention and an electric connector.
Figure 71:
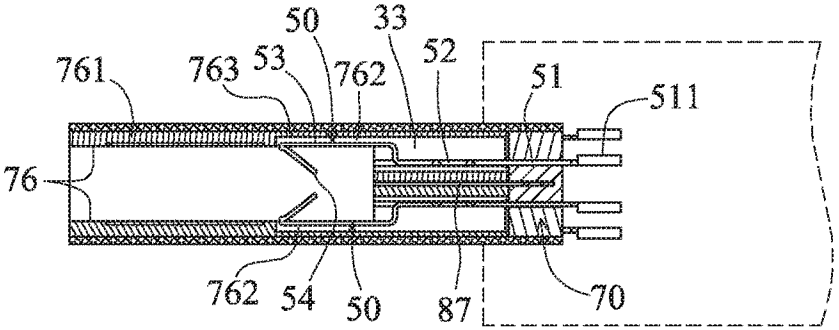
FIG. 71 is a side cross-sectional view (taken at the position of the second terminal 50) showing the duplex plug according to the 21st embodiment of the invention.
Figure 68:
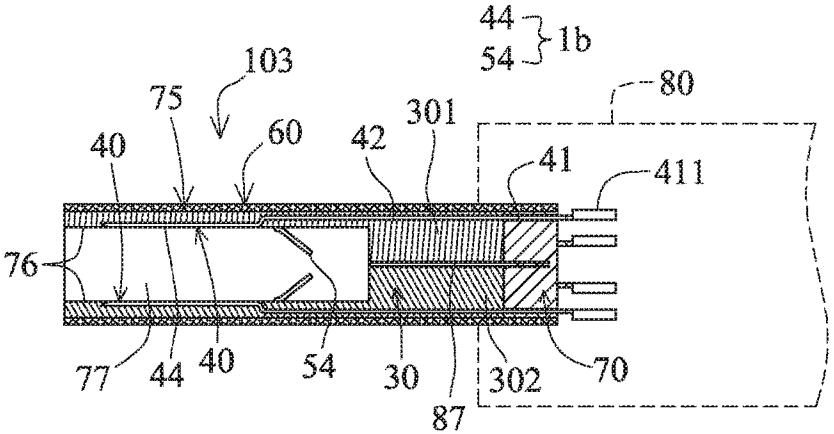
FIG. 68 is a side cross-sectional view (taken at the position of the first terminal 40) showing a duplex plug according to a 21st embodiment of the invention.

Referring to FIG. 71, the second terminal 50 sequentially has, from one end to the other end, a pin 51, a fixing portion (also referred to as a first fixing portion) 52 and an extension 53. The fixing portion 52 is fixed to the second terminal slot 33. The extension 53 connected to the front end of the fixing portion 52 extends to the contact interface substrate 76 and has a distal segment bent inversely to form a contact 54. The contact 54 is the cut section of the distal end of the extension 53. The extension 53 is vertically elastically movable in the elastic movement spaces 762. The contact 54 is vertically elastically movable and projects beyond the inner surface of the contact interface substrate 76. The pin 51 is connected to the other end of the fixing portion 52, projects beyond the rear end of the insulating base 30 and has a distal segment formed with a wiring portion 511. The contacts 44 of the two rows of first terminals 40 and the contacts 54 of the two rows of second terminals 50 respectively form the USB 3.0 contact interfaces 1*b* of the two contact interface substrates 76, respectively. The two USB 3.0 contact interfaces 1*b* have the same contact interface and the connection points with the circuit serial numbers arranged reversely. As shown in FIG. 18, the contacts 44 of the upper one row of first terminals have the connection points with the circuit serial numbers of 1, 2, 3, 4 arranged from left to right, the contacts 54 of one row of second terminals have the connection points with the circuit serial numbers of 9, 8, 7, 6, 5 arranged from left to right, the contacts 44 of the lower one row of first terminals have the connection points with the circuit serial numbers of 4, 3, 2, 1 arranged from left to right, and the contacts 54 of one row of second terminals have the connection points with the circuit serial numbers of 5, 6, 7, 8, 9 arranged from left to right.

Referring to FIGS. 68 to 71, the two contact interface substrates 76 are formed with the contacts 44 of the front row of the first terminals 40 and the contacts 54 of the rear row of the second terminals 50, wherein the width of each of the front row of contacts 44 is wider than the width of each of the rear row of contacts 54, the number of the front row of contacts 44 is equal to 4, which is smaller than the number the rear row of contacts 54, which is equal to 5. The arrangement width of the front row of contacts 44 is narrower than the arrangement width of the rear row of contacts 54. The insulating layers 761 of the two contact interface substrates have the transversal front-rear isolating regions 764 for separating the front and rear rows of contacts 44 and 54 from each other.

The two contact interface substrates 76 have separating structures corresponding to the rear row of contacts, so that the rear row of contacts 54 cannot touch the metal housing 60 when being vertically elastically moved. The separating structures are the elastic movement space 762 and the bottom surface 763.

The front row of contacts 44 is connected to a fixing portion (also referred to as a second fixing portion) 42 extending to and being positioned at the contact interface substrate 76. The fixing portions 52 of the second terminals 50 of the rear row of contacts 54 extend to and are positioned at the insulating base 30.

The rear row of contacts 54 of the two contact interface substrates are closer to the middle height of the fitting space 77 than the front row of contacts 44, so that the two rows of contacts 44 and 54 are in the front-low and rear-high manner.

According to the USB 3.0 contact interface specified by USB Association, the front row of contacts 44 have the connection point with the circuit serial number 1 being the ground contact, the connection point with the circuit serial number 4 being the power contact, and the connection points with the circuit serial numbers 3 and 2 being one pair of signal contacts represented by D+ and D−, respectively; and the rear row of contacts 54 have the connection point with the circuit serial number 7 being the ground contact, and the connection points with the circuit serial numbers 6 and 5, and 9 and 8 being two pairs of signal contacts represented by RX+ and RX−, and TX+ and TX−, respectively.

The front row of contacts 44 are connected to a fixing portion 42 extending to and being positioned at the contact interface substrate 76. The fixing portions 52 of the second terminals 50 of the rear row of contacts 54 extend to and are positioned at the insulating base 30.

Figure 72:
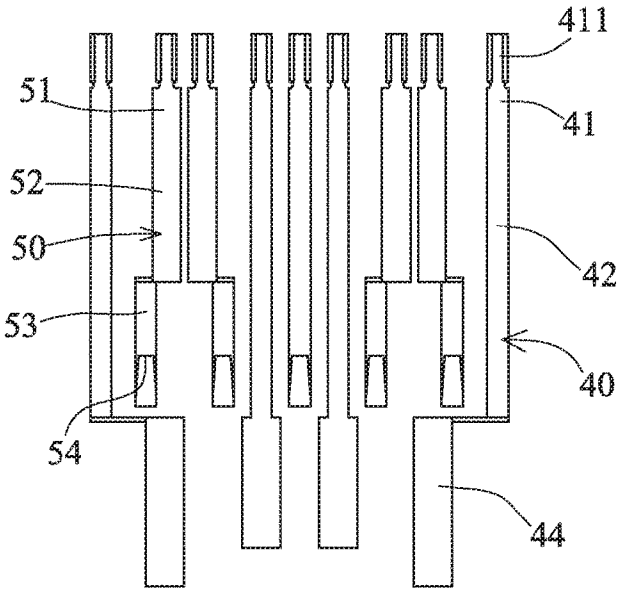
FIG. 72 is an arranged top view showing two rows of terminals of the duplex plug according to the 21st embodiment of the invention.

Referring to FIG. 72, the middle terminal of each row of second terminals 50 is the ground terminal, and one pair of signal terminals are disposed on two sides of the middle terminal. Each pair of signal terminals can be designed to be close to each other, and this is advantageous to the high-speed transmission, so the fixing portions 52 and the pins 51 of the two second terminals 50 on the two sides are close to each other.

Figure 73:
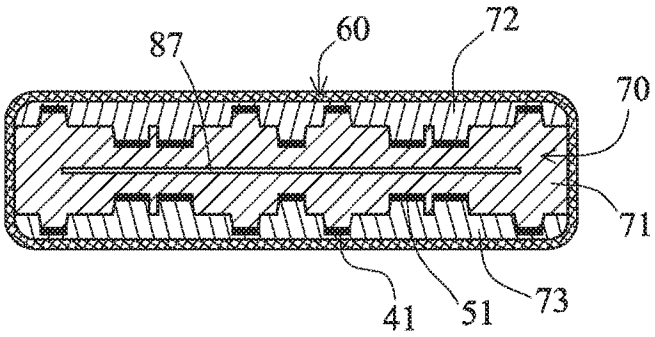
FIG. 73 is a back cross-sectional view showing the duplex plug according to the 21st embodiment of the invention.

Referring to FIG. 73, the rear plug 70 is a three-piece combination comprising an upper portion 72, a middle portion 71 and a lower portion 73, so that the pins 41 of the two rows of first terminals 40 and the pins 51 of the two rows of second terminals 50 pass through and closely fit with the rear plug 70. The rear plug 70 mainly plugs into the voids communicating the two rows of second terminal slots 33 with the rear end of the insulating base 30.

Figure 74:
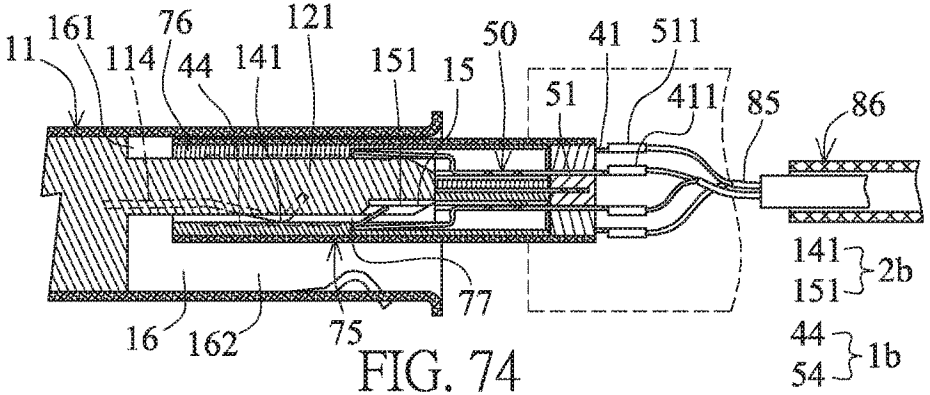
FIG. 74 is a side cross-sectional view showing a used state of the duplex plug according to the 21st embodiment of the invention.

Referring to FIG. 74, with the above-mentioned structure, the heights of the two contact interface substrates 76 of the fitting portion 75 can be fit into the small space 161 of the connection slot 16 of the A-type biased USB 3.0 electrical connection socket 11. So, the A-type biased USB 3.0 electrical connection socket 11 and the A-type biased USB 2.0 electrical connection socket 10 have substantially the same structure except that only one row of five second terminals 15 are added. The second terminal 15 has an elastically non-movable contact 151 disposed in front of the contact 141 of the first terminal 14. So, the fitting portion 75 can be bidirectionally inserted into the connection slot 16 of the A-type biased USB 3.0 electrical connection socket 11, and one of the USB 3.0 contact interfaces 1*b* (contacts 44 and 54) of the two contact interface substrates 76 is electrically connected to the USB 3.0 contact interface 2*b* (contacts 141 and 151) below the tongue 121 of the A-type biased USB 3.0 electrical connection socket 11.

Regarding the wiring portions 411 of the pins of the two rows of first terminals 40 of this embodiment, the connection points with the same circuit serial number are connected to the same wire 85. Regarding the wiring portions 511 of the pins of the two rows of second terminals 50, the connection points with the same circuit serial number are connected to the same wire 85. So, the connection cable 86 has one set of nine wires 85 thereinside.

Figure 75:
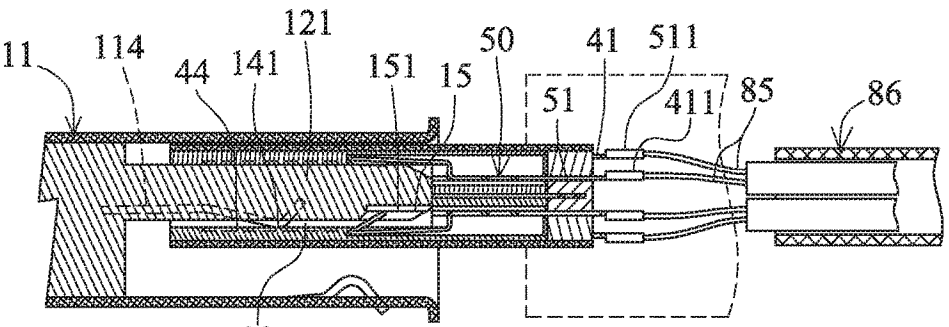
FIG. 75 is a side cross-sectional view showing the used state of the duplex plug according to the 21st embodiment of the invention.

Referring to FIG. 75 of this embodiment, each of the wiring portions 411 of the pins of the two rows of first terminals 40 and the wiring portions 511 of the pins of the two rows of second terminals 50 is connected to a wire 85. So, the connection cable 86 has two set of nine wires 85 (18 wires 85 in total).

Figure 76:
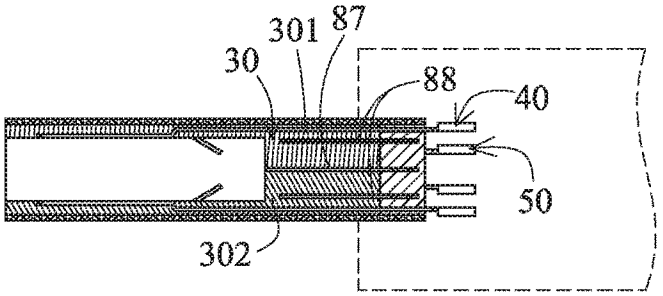
FIG. 76 is a side cross-sectional view (taken at the position of the first terminal 40) showing another duplex plug according to the 21st embodiment of the invention.

Referring to FIG. 76, another modification of the bidirectional duplex USB 3.0 electrical connection plug of this embodiment is provided with the difference that a transversally extending metal partition plate 88 is added to each of the upper and lower bases 301 and 302 of the insulating base 30, so that the mutual electric interference of one row of first and second terminals 40 and 50 is reduced, and this is more advantageous to the high-speed transmission.

Figure 78:
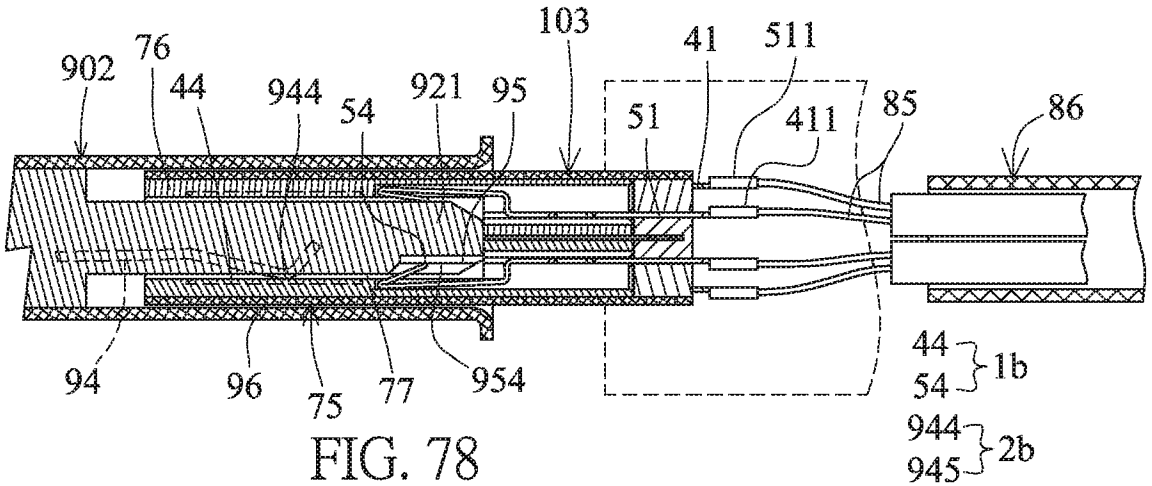
FIG. 78 is a side cross-sectional view showing the combination of the simplex socket and the duplex plug according to the 21st embodiment of the invention.
Figure 77:
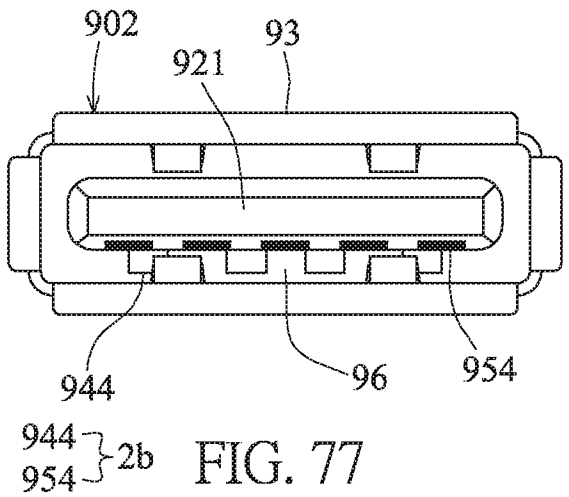
FIG. 77 is a front view showing a simplex socket according to the 21st embodiment of the invention.

Referring to FIGS. 77 and 78, a bidirectional simplex USB 3.0 electrical connection socket 902 of this embodiment is almost the same as the USB 2.0 bidirectional duplex electrical connection socket 901 of the first embodiment except for the difference that one row of five second terminals 95 are further provided. The second terminal 95 has an elastically non-movable contact 954 disposed in front of the contact 944 of the first terminal 94. The contact 954 is slightly depressed into the bottom side of the tongue 921. The one row of contacts 944 and the one row of contacts 954 form the USB 3.0 contact interface 2*b*.

The heights of the two contact interface substrates 76 of the fitting portion 75 of the bidirectional duplex USB 3.0 electrical connection plug 103 can be fit into the spaces on the upper and lower connection surfaces of the tongue 921 of the connection slot 96. So, the fitting portion 75 can be bidirectionally inserted into the connection slot 96 of the bidirectional simplex USB 3.0 electrical connection socket 902, and one of the USB 3.0 contact interfaces 1*b* (contacts 44 and 54) of the two contact interface substrates 76 is electrically connected to the USB 3.0 contact interface 2*b* (contacts 944 and 954) of the bottom side of the tongue 921 of the bidirectional simplex USB.0 electrical connection socket 902. In addition, the fitting portion 75 of the bidirectional duplex USB 3.0 electrical connection plug 103 and the connection slot 96 of the bidirectional simplex USB 3.0 electrical connection socket 902 can achieve the better fitting. So, this is different from FIG. 74, in which a too large space is still left when the contact interface substrate 76 is in the large space 162.

Figure 70:
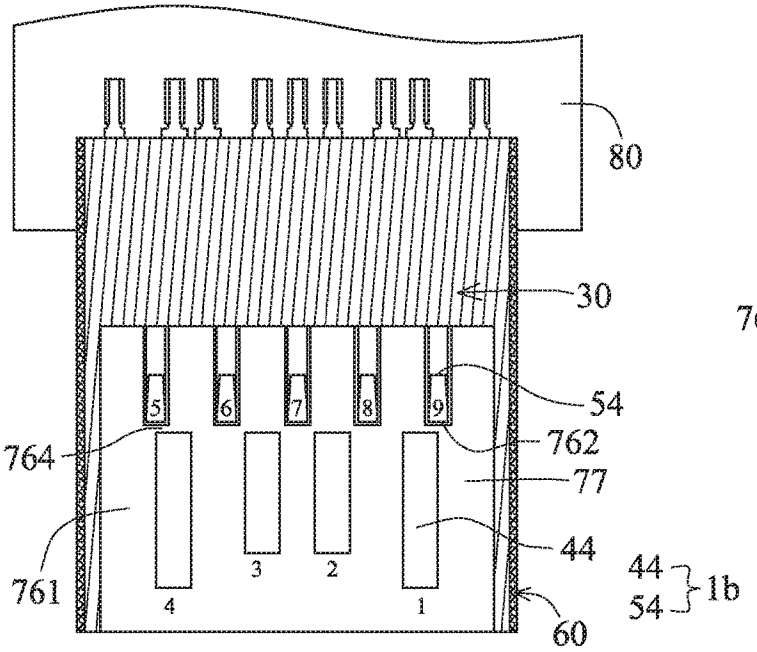
FIG. 70 is a top cross-sectional view showing the duplex plug according to the 21st embodiment of the invention.
Figure 69:
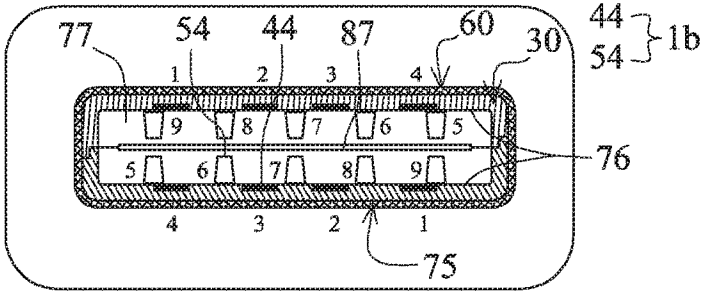
FIG. 69 is a front cross-sectional view showing the duplex plug according to the 21st embodiment of the invention.

The USB 3.0 contact interface 2*b* of the bidirectional simplex USB 3.0 electrical connection socket 902 is electrically connected to the USB 3.0 contact interface 1*b* of the bidirectional duplex USB 3.0 electrical connection plug 103 shown in FIG. 70. So, the front row of elastically non-movable contacts 954 of the socket also comprise two pairs of USB 3.0 signal contacts of RX+, RX−; and TX+, TX−, respectively, and the rear row of elastically movable contacts 944 also comprise one pair of USB 3.0 signal contacts of D+, D−.

The contact interface of at least one connection surface of the two connection surfaces of the tongue 921 has the five elastically non-movable contacts 954 in flat surface contact with the tongue. Only two pairs of elastically non-movable USB 3.0 signal contacts 954 in flat surface contact with the tongue of only one connection surface of the two connection surfaces are electrically connected to only two pairs of USB 3.0 signal contacts 54 of one side of the bidirectional electrical connection plug. The only two pairs of USB 3.0 signal contacts are shown in FIG. 70 as RX+, RX−; and TX+, TX−, respectively.

The contact interface of at least one connection surface of the two connection surfaces of the tongue 921 has at least nine contacts having connection points with the circuit serial numbers arranged in order. Only three pairs of USB 3.0 signal contacts of only one connection surface of the two connection surfaces are electrically connected to only three pairs of USB 3.0 signal contacts of one side of the bidirectional electrical connection plug. The only three pairs of USB 3.0 signal contacts as shown in FIG. 19 as D+, D−; RX+, RX−; and TX+, TX−, respectively.

Figure 80:
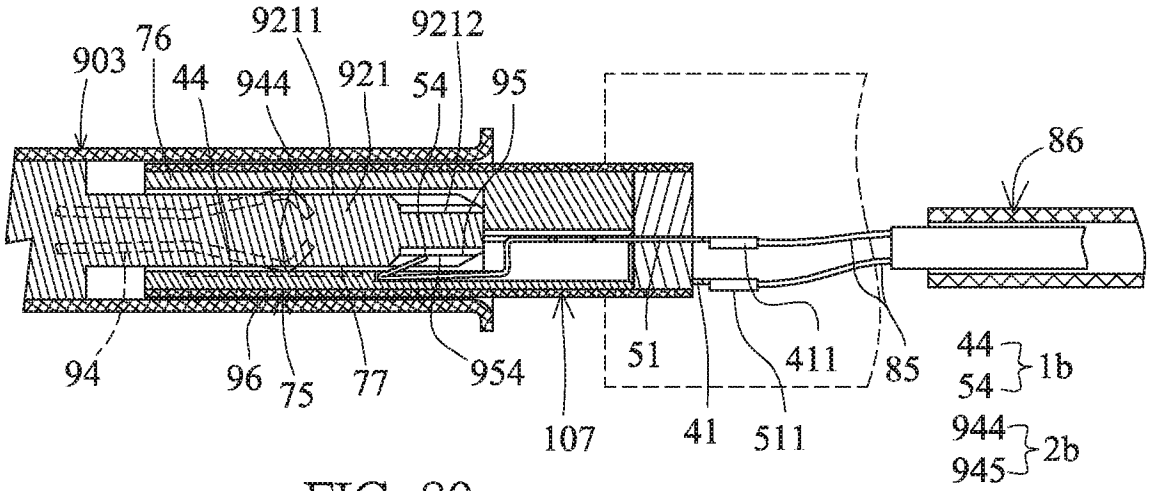
FIG. 80 is a side cross-sectional view showing a combination of the duplex socket and the simplex plug according to the 21st embodiment of the invention.
Figure 79:
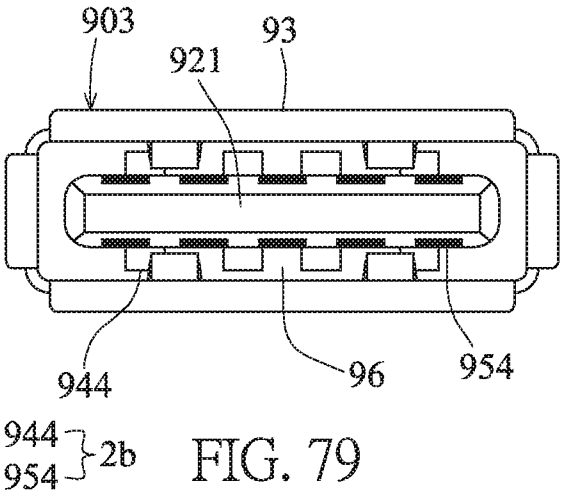
FIG. 79 is a front view showing a duplex socket according to the 21st embodiment of the invention.

Referring to FIGS. 79 and 80, a bidirectional duplex USB 3.0 electrical connection socket 903 and a bidirectional simplex USB 3.0 electrical connection plug 107 of this embodiment are correspondingly connected to each other, wherein the bidirectional duplex USB 3.0 electrical connection socket 903 is almost the same as the above-mentioned bidirectional simplex USB 3.0 electrical connection socket 902 except for the differences that the socket 903 further additionally comprises one row of first terminals 94 and one row of second terminals 95, that the top side of the tongue 921 is also formed with a USB 3.0 contact interface 2*b*, that the two connection surfaces of the tongue 921 have inner segments and outer segments lower than the inner segments to have an inverse T shape, that each of the upper and lower connection surfaces of the tongue has an inner section formed with a high surface 9211 and an outer section formed with a low surface 9212, that the two sides of the tongue 921 are formed with connection surfaces with steps, and that the contacts 954 of the one row of second terminals 95 of the two USB 3.0 contact interfaces 2*b* are in flat surface contact with and positioned at the low surfaces 9212 of the outer segments of the two connection surfaces of the tongue 921, and are not vertically elastically movable. The contacts 944 of the one row of first terminals 94 of the two USB 3.0 contact interfaces 2*b* respectively project beyond the high surface 9211 of the inner sections of the two connection surfaces of the tongue 921. The USB 3.0 contact interfaces 2*b* of the top and bottom sides of the tongue 921 have the same contact interface, and the connection points with the circuit serial numbers arranged reversely. The bidirectional simplex USB 3.0 electrical connection plug 107 is almost the same as the above-mentioned bidirectional duplex USB 3.0 electrical connection plug 103 except for the differences that only one of the two contact interface substrates 76 of the fitting portion 75 has the USB 3.0 contact interface 1*b*. So, the fitting portion 75 can be bidirectionally inserted into the connection slot 96 of the USB 3.0 bidirectional duplex electrical connection socket 903, and the USB 3.0 contact interface 1*b* (contacts 44 and 54) of the contact interface substrate 76 is inevitably electrically connected to the USB 3.0 contact interface 2*b* (contacts 944 and 954) of one of the top and bottom sides of the tongue 921 of the bidirectional duplex USB 3.0 electrical connection socket 903.

Only one of the two contact interface substrates 76 of the fitting portion 75 of the bidirectional simplex USB 3.0 electrical connection plug 107 has the USB 3.0 contact interface, and similarly has only three pairs of signal contacts D+, D−; RX+, RX−; and TX+, TX−, as shown in FIG. 19. The rear row of elastically movable contacts have only two pairs of signal contacts RX+, RX−; and TX+, TX−, and each of the front and rear rows of contacts 44, 54 has a ground contact, and represent two rows of horizontal pins 41, 51, which do not flush with each other.

The USB 3.0 contact interface of the two connection surfaces of the tongue 921 of the bidirectional duplex USB 3.0 electrical connection socket 903 is correspondingly electrically connected to the USB 3.0 contact interface of the bidirectional simplex USB 3.0 electrical connection plug 107. So, the USB 3.0 contact interface of the two connection surfaces of the tongue 921 similarly has three pairs of signal contacts represented as D+, D−; RX+, RX−; and TX+, TX−, respectively. Each of the front and rear rows of contacts 944, 954 has a ground contact. So, the two connection surfaces of the tongue 921 form high and low contacts and high and low ground contacts.

Figure 81:
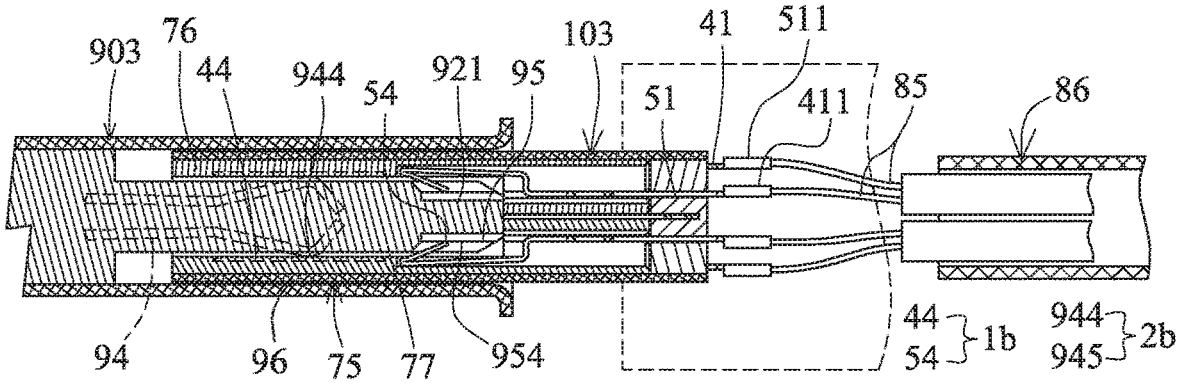
FIG. 81 is a side cross-sectional view showing the combination of the duplex socket and the duplex plug according to the 21st embodiment of the invention.

Referring to FIG. 81, the bidirectional duplex USB 3.0 electrical connection socket 903 and the bidirectional duplex USB 3.0 electrical connection plug 103 are correspondingly connected together, so that the two USB 3.0 contact interfaces 1*b* and 2*b* of the plug and the socket can be bidirectionally connected together to achieve the effect of the convenient use and the doubled transmission speed.

The socket of this embodiment may be designed such that the spaces of the connection slot 96 on the upper and lower connection surfaces of the tongue 921 may have the same height or different heights, wherein the height may range between 0.55 mm and 1.5 mm, and the height of the connection slot 96 may be designed to range between 3 mm and 4.9 mm. Thus, the height of the contact interface substrate matching with the inserted bidirectional USB 2.0 electrical connection plug ranges between 0.5 mm and 1.45 mm, and the height of the fitting portion ranges between 3 mm and 4.85 mm.

Figure 82:
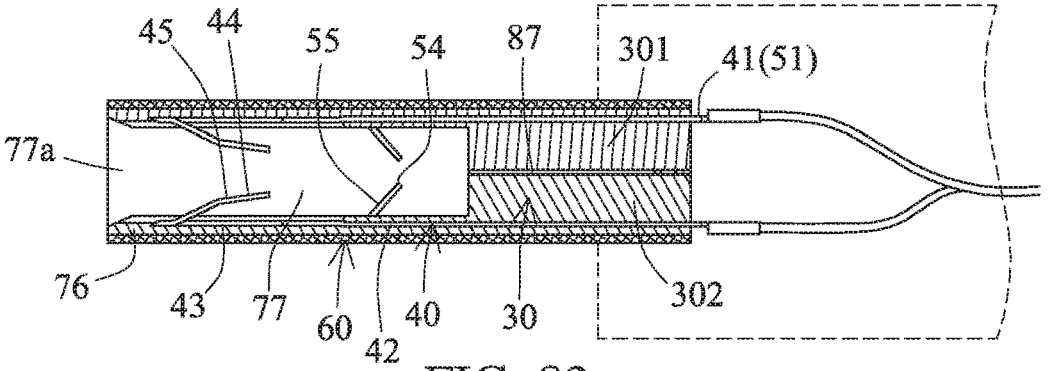
FIG. 82 is a side cross-sectional view (taken at the position of the first terminal 40) showing another duplex plug according to the 21st embodiment of the invention.
Figure 83:
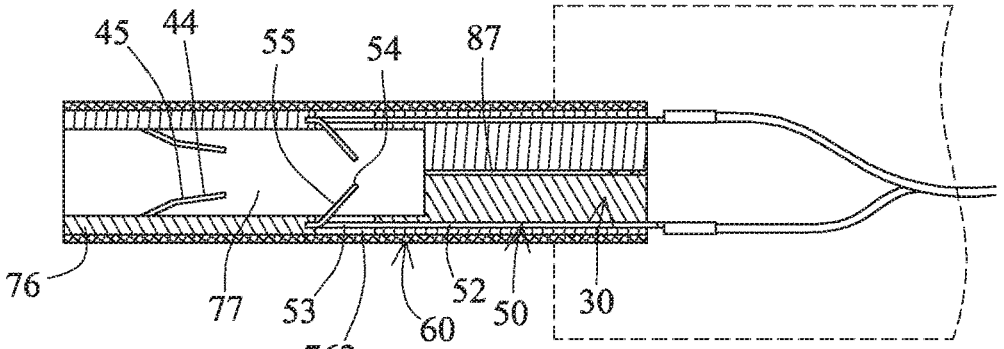
FIG. 83 is a side cross-sectional view (taken at the position of the second terminal 50) showing another duplex plug according to the 21st embodiment of the invention.
Figure 84:
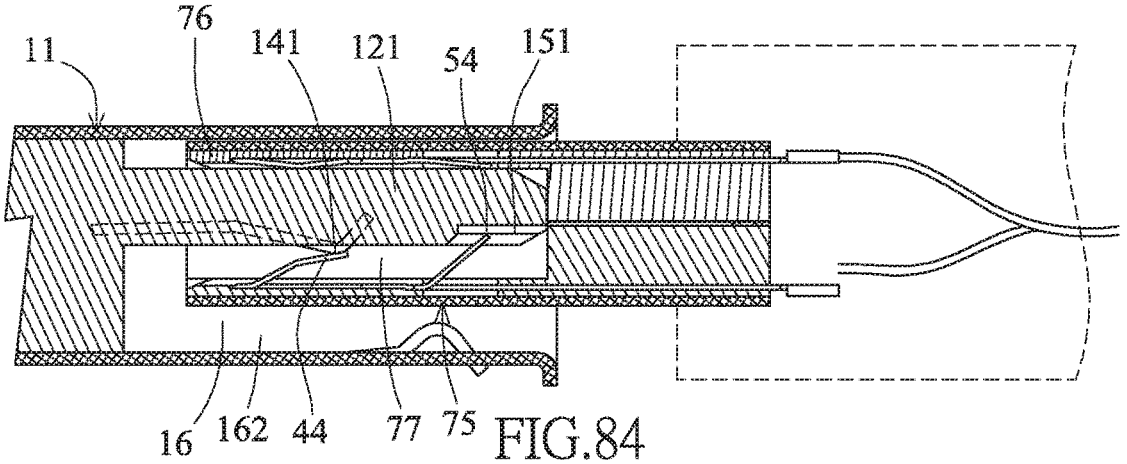
FIG. 84 is a side cross-sectional view showing a used state of another duplex plug according to the 21st embodiment of the invention.

Referring to FIGS. 82 and 83, another modification of the bidirectional duplex USB 3.0 electrical connection plug of this embodiment is provided, wherein the insulating base 30 thereof similarly has the vertically stacked upper and lower bases 301, 302, except for the difference that the inner surfaces of the two contact interface substrates 76 are projectingly formed with two rows of vertically elastically movable contacts. That is, the two rows of first terminals 40 are prodded from the plate surface of the extension 43 to the fitting space 77 to form a projecting reverse extending sheet 45. The reverse extending sheet 45 is vertically elastically movable and has the contact 44. The two rows of second terminals 50 are prodded from the plate surface of the extension 53 to the fitting space 77 to form a projecting reverse extending sheet 55. The reverse extending sheet 55 is vertically elastically movable and has a cut section of a distal end formed with the contact 54. The contacts 44 and 54 are elastically movable and much more projecting beyond the contact interface substrate than the contact of the A-type biased electrical connection plug by about 0.4 mm to 0.7 mm. So, the height of the fitting space 77 may be designed to be larger and range between about 2.35 mm and 2.7 mm, which is larger than the height (1.95 mm) of the fitting slot 24 of the conventional A-type biased USB 2.0 electrical connection plug 20. In this embodiment, the projecting distance of 0.6 mm is designed, the height of the fitting space 77 is 2.6 mm, and the height of the fitting portion 75 can reach 4.0 mm. Referring to FIG. 84, when the fitting portion 75 is fit into the connection slot 16 of the A-type biased USB 3.0 electrical connection socket 11, the contacts 44 and 54 still can be electrically connected to the contacts 141 and 151 by way of elastic movement. However, the remaining space of the large space of the contact interface substrate 76 in the connection slot 16 can be reduced to be about 1.12 mm. Thus, the space provided when the plug is improperly forced to rotate downwards can be shortened to prevent the tongue 121 of the socket from being broken. The front row of contacts 44 are one row of elastically movable contacts bent from an insertion port 77*a* of the fitting space 77 inversely to extend forwardly.

The two contact interface substrates 76 have a separating structure corresponding to the rear row of contacts, so that the rear row of contacts 54 cannot touch the metal housing 60 when being vertically elastically moved. The separating structure is the elastic movement space 762. The front row of contacts 44 is connected to a fixing portion 42 extending to and being positioned at the contact interface substrate 76. The fixing portions 52 of the terminals 50 of the rear row of contacts 54 extend to and are positioned at the insulating base 30.

Each of the pins 41, 51 of the terminals 40, 50 of the two contact interfaces forms one row of horizontal pins to constitute two rows of horizontal pins arranged vertically.

Referring to FIGS. 85 to 90, the 22nd embodiment of the invention provides a bidirectional low-height electrical connection plug and a bidirectional low-height electrical connection socket.

Figure 85:
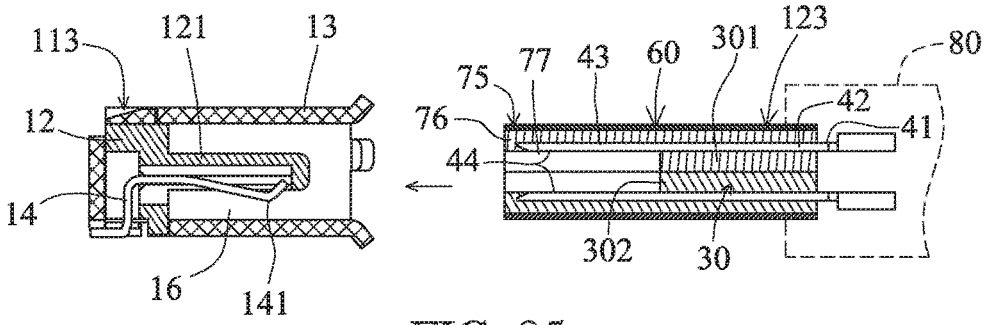
FIG. 85 shows a side cross-sectional exploded view according to a 22nd embodiment of the invention.
Figure 86:
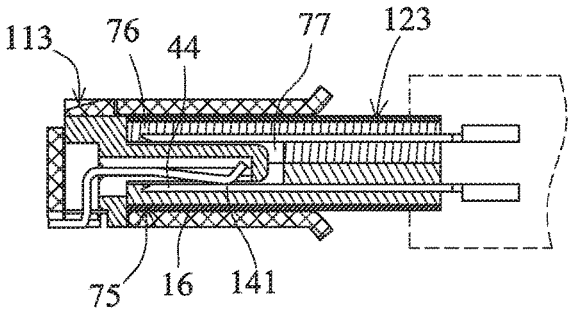
FIG. 86 shows a side cross-sectional combination view according to the 22nd embodiment of the invention.
Figure 87:
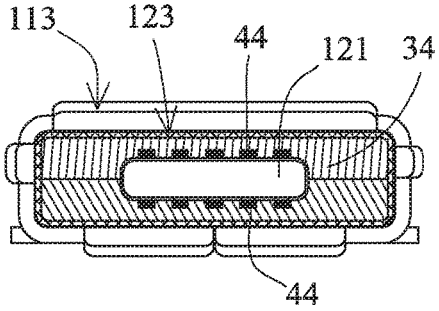
FIG. 87 shows a front cross-sectional combination view according to the 22nd embodiment of the invention.

Referring to FIGS. 85 to 87, a bidirectional duplex low-height electrical connection plug 123 and a bidirectional simplex low-height electrical connection socket 113 are provided and almost the same as the 20th embodiment except for the difference that this embodiment has the middle size design. That is, the height of the contact interface substrate 76 of the bidirectional duplex low-height electrical connection plug 123 ranges between 0.3 mm and 0.9 mm, wherein the fitting space 77 ranges between about 0.7 mm and 0.8 mm, and the total height ranges between about 1.3 mm and 2.5 mm. The height of the tongue 121 of the bidirectional simplex low-height electrical connection socket 112 ranges between about 0.65 mm and 0.75 mm. The heights of the two symmetrical spaces on the top and bottom sides of the tongue 121 range between 0.35 mm and 0.95 mm, and the height of the connection slot 16 ranges between 1.35 mm and 2.65 mm, so that the connector can be easily manufactured and become slim and light.

The height of the contact interface substrate 76 of the bidirectional duplex low-height electrical connection plug 123 of this embodiment is about 0.55 mm, the fitting space 77 is about 0.7 mm, the total height is about 1.8 mm, and the height of the tongue 121 of the bidirectional simplex low-height electrical connection socket 113 is about 0.65 mm. The heights of the two symmetrical spaces on the top and bottom sides of the tongue 121 are about 0.6 mm, and the height of the connection slot 16 is about 1.85 mm.

Figure 88:
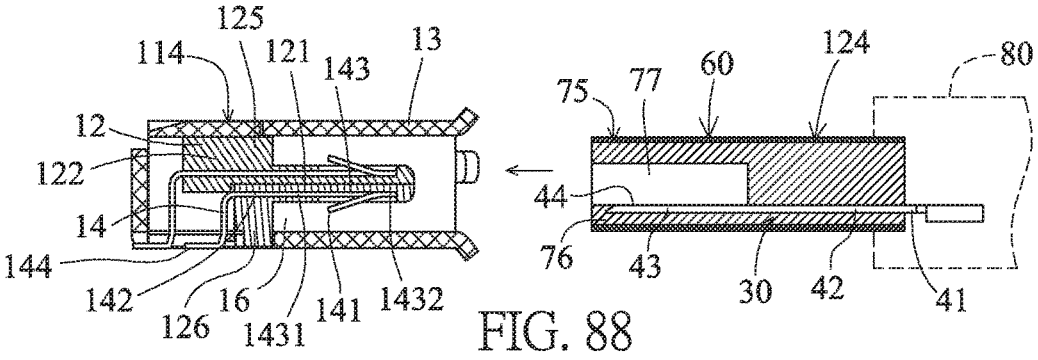
FIG. 88 shows a side cross-sectional exploded view according to the 22nd embodiment of the invention.
Figure 89:
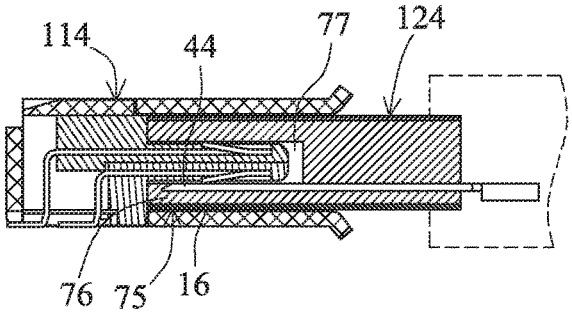
FIG. 89 shows a side cross-sectional combination view according to the 22nd embodiment of the invention.

Referring to FIGS. 88 and 89, a bidirectional simplex low-height electrical connection plug 124 and a bidirectional duplex low-height electrical connection socket (also referred to as an adapted connector) 114 are provided, wherein the bidirectional simplex low-height electrical connection plug 124 only has one row of first terminals 40. So, only one contact interface substrate 76 has one row of contacts 44, and the bidirectional duplex low-height electrical connection socket 114 has two rows of first terminals 14. The insulating base 12 has a base 122 and a tongue 121. The front end of the base 122 is projectingly formed with the tongue 121. The thickness of the base 122 is larger than that of the tongue 121. Each of the top and bottom sides of the tongue 121 is provided with one row of contacts 141 of terminals, and the insulating base 12 is formed by stacking the upper base 125 and the lower base 126. The upper and lower bases 125 and 126 are embedded and injection molded with the one row of first terminals 14.

Each first terminal is integrally provided with a pin 144, a fixing portion 142 and an extension 143. The fixing portion 142 is fixed to the insulating base 12. The extension 143 is connected to the front end of the fixing portion 142, extends to the tongue 121 and has a contact 141. The contact 141 projects beyond the bottom surface of the tongue 121 and is vertically elastically movable. The pin 144 connected to the rear end of the fixing portion 142 and extends out of the insulating base. The contacts 141 of the one row of first terminals 14 form the MICRO USB 2.0 contact interface.

The extension of each first terminal has an inner section 1431, which is embedded into, injection molded with and fixed to the inner section of the tongue 121, and an outer section 1432, which is embedded into, injection molded with and fixed to the outer section of the tongue 121 and exposes the outer sections of the two connection surfaces. The plate surface of the outer section 1432 of the extension is prodded to form the projecting contact 141.

Figure 90:
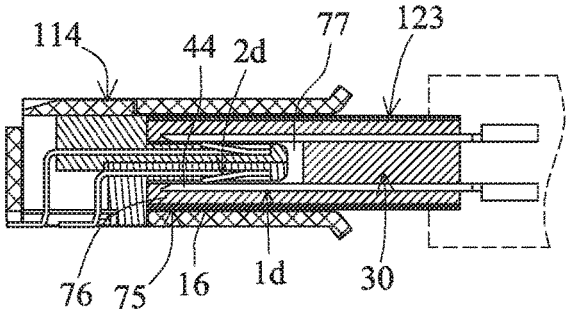
FIG. 90 shows a side cross-sectional combination view according to the 22nd embodiment of the invention.
Figure 91:
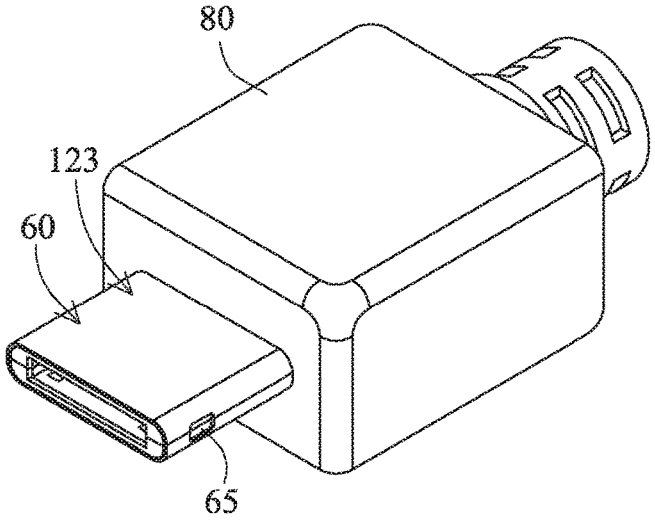
FIG. 91 is a pictorial view showing a plug according to a 23rd embodiment of the invention.
Figure 92:
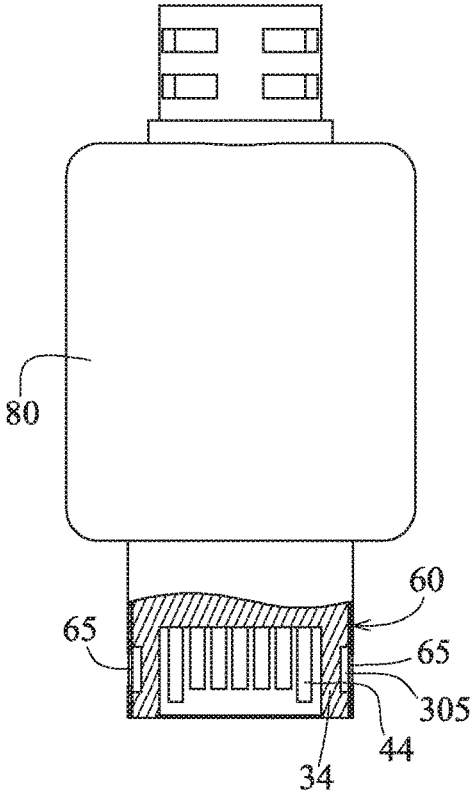
FIG. 92 is a top cross-sectional view showing the plug according to the 23rd embodiment of the invention.
Figure 93:
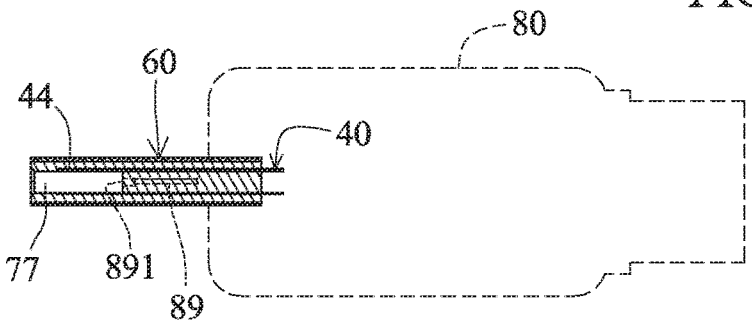
FIG. 93 is a side cross-sectional view showing the plug according to the 23rd embodiment of the invention.
Figure 94:
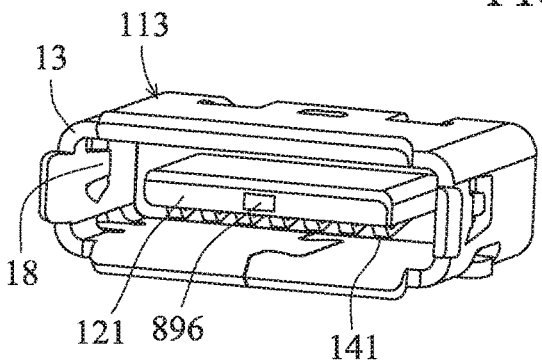
FIG. 94 is a pictorial view showing a socket according to the 23rd embodiment of the invention.
Figure 95:
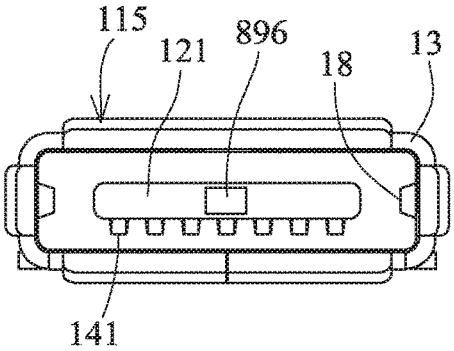
FIG. 95 is a front view showing the socket according to the 23rd embodiment of the invention.

Referring to FIG. 90, the bidirectional duplex low-height electrical connection plug 123 and a bidirectional duplex low-height electrical connection socket 114 are correspondingly connected together. The insulating base 12 of the bidirectional duplex low-height electrical connection plug 123 is integrally embedded and injection molded with two rows of first terminals, so that the doubled transmission speed can be achieved. The two contact interfaces 1*d* and 2*d* of the plug and socket have the same contact interface, and the two contact interfaces have the connection points with the circuit serial numbers arranged reversely.

In addition, the contact interface of the low-height electrical connection plug may also be designed to have the vertically elastically movable contacts, and the contact interface of the low-height electrical connection socket is designed to have elastically non-movable contacts.

Referring to FIGS. 91 to 95, the 23rd embodiment of the invention provides a bidirectional duplex low-height electrical connection plug 123 and a bidirectional simplex low-height electrical connection socket 113, and is almost the same as the 22nd embodiment except for the differences that the contact interface of the bidirectional duplex low-height electrical connection plug 123 of this embodiment has seven elastically non-movable contacts 44, and at least one optical fiber cable 89. The optical fiber cable 89 has a connection point 891 at the inner end of the fitting space 77. The top and bottom surfaces of the two contact interface substrates 76 perpendicularly corresponding to the metal case 60 are hole-free structures, each of left and right sides of the fitting space 77 is provided with a metallic engaging structure. That is, each of the left and right sides of the metal housing 60 has an engaging portion 65. The engaging portion 65 is an engagement hole, and each of the two sidewalls 34 of the insulating base also correspondingly has a slot 305 to provide the larger engaging depth. The contact interface of the low-height electrical connection socket has seven vertically elastically movable contacts 141, and at least one optical fiber cable. The optical fiber cable has a connection point 896 at the front end of the tongue 121 to match with the connection point 891 of the electrical connection plug. Each of the left and right sides of the metal housing 13 has an inwardly projecting engaging portion 18. The engaging portion 18 is a resilient fastener. The engaging portion 18 can engage with the engaging portion 65 of the plug to prevent the plug from detaching in a direction opposite to the docking direction. Because the engaging portion 18 engages with the engaging portion 65 by the larger depth, the engaging snap or hand feeling is provided when the plug is inserted into the socket.

Multiple portions of the metal housing 13 perpendicularly corresponding to two connection surfaces of the tongue 121 of the socket are respectively hole-free structures (structures without holes or openings). In the above-mentioned socket, each of two connection surfaces of the tongue 121 may also be provided with a contact interface to form a bidirectional duplex electrical connection socket.

Figure 96:
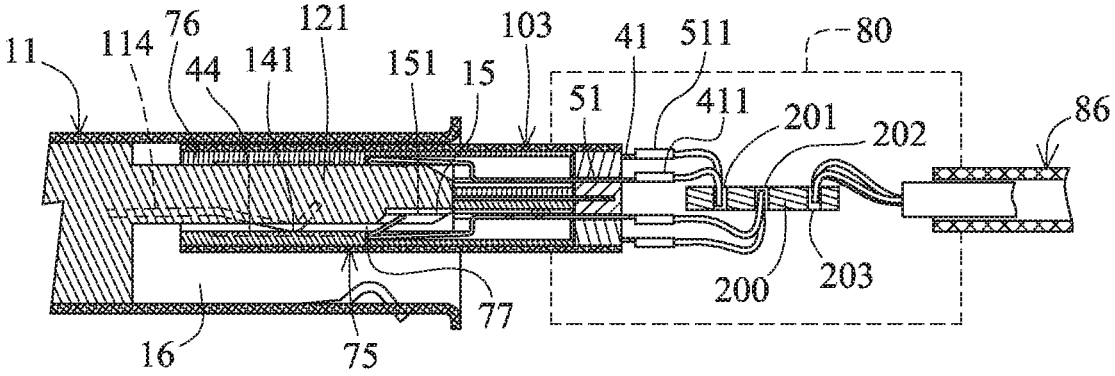
FIG. 96 is a side cross-sectional combination view according to the 24th embodiment of the invention.
Figure 97:
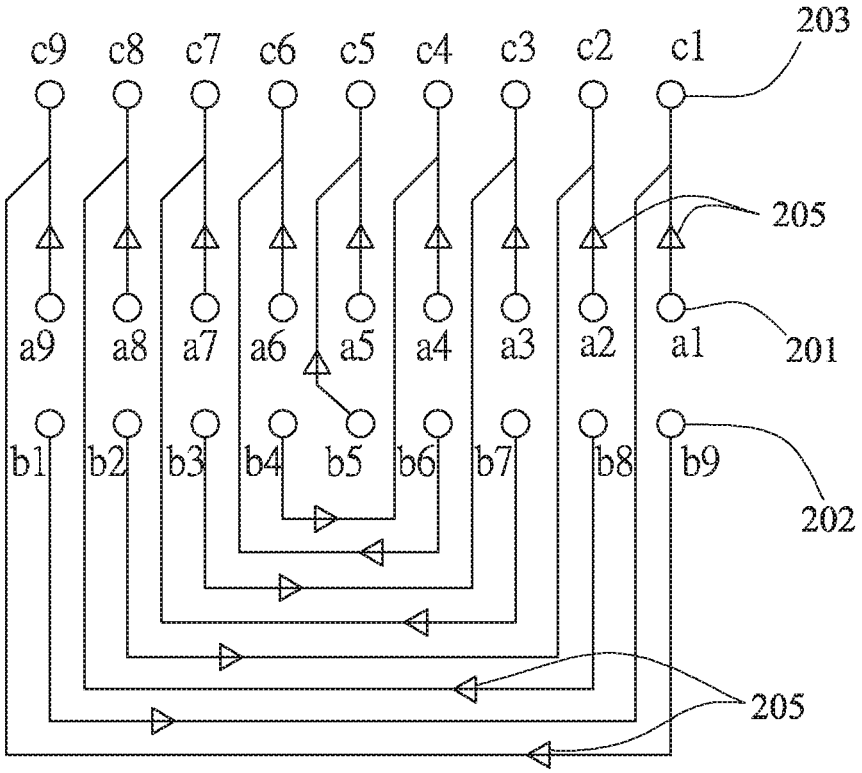
FIG. 97 is a schematic circuit diagram according to the 24th embodiment of the invention.

Referring to FIGS. 96 and 97, the 24th embodiment of the invention is directed to a bidirectional duplex USB 3.0 electrical connection plug 103 and a biased USB 3.0 electrical connection socket 11, and is substantially the same as the tenth embodiment except for the difference that a circuit board 200 is disposed in the housing 80 of this embodiment, wherein three rows of nine electrical connection holes 201, 202 and 203 are disposed on the circuit board 200, the one row of electrical connection holes 201 are a1 to a9, the contacts 44 of the one contact interface substrate 76 are respectively connected to a1 to a9 according to the connection points with the circuit serial numbers 1 to 9, the one row of electrical connection holes 202 are b1 to b9, and the contacts 44 of the other contact interface substrate 76 are respectively connected to b1 to b9 according to the connection points with the circuit serial numbers 1 to 9. As shown in FIG. 99, the circuits of the one row of electrical connection holes 201 (a1 to a9) and the one row of electrical connection holes 202 (b1 to b9) are individually connected to a signal circuit processing control element 205 and then sequentially reversely cascaded to form one set of circuits to one row of electrical connection holes 203 (c1 to c9), and the one row of electrical connection holes 201 (c1 to c9) are electrically connected to one set of cables of wires, so there are only one set of nine wires in the connection cable 86.

With the above-mentioned configuration, each signal circuit processing control element 205 can provide the anti-backflow or anti-short-circuit or circuit safety protection to achieve the circuit safety protection effect.

Because two contact interfaces are provided in the bidirectional duplex plug, the Schottky diode anti-short-circuit or anti-backflow functions may also be adopted as the circuit safety protection in addition to the provision of the signal circuit processing control element. However, there are also various ways, such as the provision of the anti-backflow electrical element, anti-short-circuit electrical element, circuit safety protection element or safety circuit configuration means, to achieve the circuit safety protection effect.

In addition, the bidirectional duplex electrical connection socket of the invention is also provided with two contact interfaces. So, as mentioned hereinabove, it is also possible to provide the signal circuit processing control element, anti-backflow electrical element, anti-short-circuit electrical element, circuit safety protection element or safety circuit configuration means to achieve the circuit safety protection effect.

Referring to FIGS. 98 to 100, the 25th embodiment of the invention is directed to a bidirectional duplex C-TYPE USB electrical connection plug 123 and a bidirectional simplex C-TYPE USB electrical connection socket 113, and is substantially the same as the 22nd embodiment. Referring to FIG. 98, the difference resides in that a circuit board 200 is disposed in the housing 80 of the bidirectional duplex C-TYPE USB electrical connection plug 123 of this embodiment, wherein an interpretation system is disposed on the circuit board 200, and the interpretation system includes a detection device 230, a switch control device (being one set of five circuit switches 210) and a control chip 220. The one row of contacts 44 (the connection points with the circuit serial numbers a1 to a5) of the contact interface of the upper contact interface substrate 76 are electrically connected to the top surface of the circuit board 200, and the pins of the one row of terminals 40 are bonded to the top surface of the circuit board 200. The one row of contacts 44 (the connection points with the circuit serial numbers b1 to b5) of the contact interface of the lower contact interface substrate 76 are electrically connected to the bottom surface of the circuit board 200, and the pins of the one row of terminals 40 are bonded to the bottom surface of the circuit board 200. The contact interfaces of the two contact interface substrates 76 are the same contact interface, and have connection points with circuit serial numbers arranged reversely. The contact interfaces of the two contact interface substrates 76 are cascaded to form one set of circuits, and one set of circuit switches 210 are used to switch on and off. The control chip 220 can control the operations of the one set of circuit switches 210 through instructions of the detection device 230.

Referring to FIGS. 99 and 100 showing the first cascading method of this embodiment, the two contact interfaces have the vertically corresponding contacts or connection points with the circuit serial numbers reversely corresponding to each other and electrically connected to the same circuit. As shown in the drawings, a1 and b5 are electrically connected to the same circuit and are switched on and off through a circuit switch 210, wherein a2 and b4 are paired, a3 and b3 are paired, a4 and b2 are paired and a5 and b1 are paired. The detection device 230 can detect the inserting orientation of the fitting portion 75 and thus notify the switch control device (one set of five circuit switches 210) to operate to turn on the contact interface electrically connected to the bidirectional simplex C-TYPE USB electrical connection socket 113, and to turn off the other contact interface, which is not electrically connected to the bidirectional simplex C-TYPE USB electrical connection socket 113. For example, when the inserting orientation of the fitting portion 75 is shown in FIG. 100 (when b1 to b5 are connected to the contacts 141 of the socket), the switch control device (one set of five circuit switches 210) switches on b1 to b5 and switches off a1 to a5 to prevent the signal or current from back-flow to the contact interface of a1 to a5, and the indeed anti-backflow can be achieved to prevent the poor electrical property. On the contrary, if the fitting portion 75 is inserted in the other orientation so that a1 to a5 are on, the switch control device (one set of five circuit switches 210) switches on a1 to a5 and switches off b1 to b5. In addition, the bidirectional simplex C-TYPE USB electrical connection socket 113 is combined with a control circuit and a detection device. The detection device can also detection the inserting orientation of the fitting portion 75 to notify the control circuit to switch the circuit signal of the connection points of the contact interface of the bidirectional simplex C-TYPE USB electrical connection socket 113 to match with the signal of the switched-on connection points of the plug. For example, if b1 to b5 are on, then the circuit signal is switched to the serial numbers 1, 2, 3, 4, 5; and if a1 to a5 are on, then the circuit signal is switched to the serial numbers 5, 4, 3, 2, 1.

Referring to FIGS. 101 to 104, the 26th embodiment of the invention is an adapter having a circuit board as a transmission medium. The adapter has a housing 80. A circuit board 200 is disposed inside the housing 80. At least one connection point switching device 250 is disposed on the circuit board 200. The adapter has one end having a bidirectional duplex USB 3.0 electrical connection plug 103, and the other end having a middle-size bidirectional duplex low-height electrical connection socket 114. The structures of two rows of terminals 14, the metal housing 13 and the insulating base thereof are substantially the same as those of the socket of FIG. 88. Each of the top and bottom sides of the tongue 121 has nine elastically non-movable contacts 141 in flat surface contact with the tongue, and the nine elastically non-movable contacts 141 correspond to nine circuit connection points of the bidirectional duplex USB 3.0 electrical connection plug 103, wherein two long ones and seven short ones are arranged into two rows of elastically non-movable contacts 141. In addition, two longer contacts 141 are respectively arranged on two outer sides of the connection surface of the tongue 121. The structures of the two rows of terminals 14, the metal housing 13 and the insulating base 12 are substantially the same as those of the socket of FIG. 88. So, the upper and lower surfaces of the tongue 121 have nine contacts 141, which similarly comprise the three pairs of USB 3.0 signal contacts, represented as D+, D−; RX+, RX−; TX+, TX−, respectively. In addition, each of left and right sides of the metal housing 13 has an engaging portion 18, which is an engagement hole (see FIG. 72). The two contact interfaces of the bidirectional duplex USB 3.0 electrical connection plug 103 and the two contact interfaces of the bidirectional duplex low-height electrical connection socket 114 are electrically connected to the circuit board 200, and perform the connection point integration and switching the corresponding circuit connection point transmission when the two contact interfaces are bidirectionally electrically connected together through the connection point switching device 250. The switch control method is substantially shown in FIGS. 98 to FIG. 100.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An electronic device, comprising:

a transmission medium;

a first duplex electrical connection plug comprising: an insulated seat, wherein the insulated seat is provided with a base seat and a docking part fitting with each other, the docking part is provided with two connection plates facing each other in a vertical direction and is provided with two side plates connected to the two connection plates to form a fitting frame body, each of opposite surfaces of the two connection plates is provided with a connection surface, and a connection slot is formed between the two connection surfaces, wherein at least one of the connection plates is provided with one or multiple elastic movement spaces much more depressed than the connection surface, and a rear end of the docking part is fitted with and positioned at a front end of the base seat; at least two terminal sets disposed in the insulated seat, wherein each of the terminal sets is provided with at least one row of terminals, the terminal is provided with a fixing portion and an extension, the fixing portion is fixed to the base seat, the extension is directly connected to a front end of the fixing portion, the fixing portion is directly fixed to the base seat and the extension extends out of the front end of the base seat, wherein after the two terminal sets are fixed to and combined with the base seat to form a total combination, the base seat is fitted with and positioned at the docking part, so that the docking part can be independently fitted with and positioned at, or separated from the total combination, wherein the extension is elastically movable up and down relatively to the docking part, the extension extends to the one or multiple elastic movement spaces of one of the connection surfaces and is provided with a contact projecting beyond the connection surface, the contact is elastically movable up and down, and the contacts of the terminals of each of the terminal sets project from the one of the connection surfaces to the connection slot to form a contact interface, wherein the total combination comprises the two terminal sets and the base seat combined together, and the two terminal sets are electrically connected to the transmission medium; and a metal housing covering the insulated seat and provided with a four-sided primary housing, wherein the four-sided primary housing shields the docking part to form a docking structure, the metal housing and the two connection plates form two contact interface substrates, and the contact interface substrate has a height, which is a perpendicular distance from an outer surface of the metal housing to the connection surface, wherein the heights of the two contact interface substrates are smaller than a height of a fitting interface substrate of a biased electrical connection plug having a minimum height specification of 0.9 mm specified by USB Association and larger than or equal to 0.65 mm; wherein the docking structure can be bidirectionally inserted into a connection slot of a first duplex electrical connection socket, the connection slot is formed by a metal housing, a tongue is disposed at a middle height of the connection slot of the first duplex electrical connection socket, upper and lower connection surfaces of the tongue form symmetrical two spaces, the heights of the two contact interface substrates of the first duplex electrical connection plug can be fit with the two spaces of the two connection surfaces of the tongue, and the connection slot of the first duplex electrical connection plug is fit with the tongue; and a second duplex electrical connection plug comprising: an insulated seat; a metal housing covering the insulated seat; and a fitting portion provided on one end of the insulated seat, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates has two inside layers being the insulating layers and two outside layers pertaining to the metal housing, each of the two contact interface substrates is provided with a contact interface, each of the two contact interfaces is provided with two rows of contacts arranged in a front-low and rear-high manner, the two rows of contacts project beyond the contact interface substrate and are elastically movable up and down, the two rear rows of contacts are formed on two rows of terminals, the terminal is provided with a pin, a fixing portion and an extension, the fixing portion is fixed to the insulated seat, the extension is connected to one end of the fixing portion, extends to the contact interface substrate and is provided with the contact, the pin is connected to the other end of the fixing portion, at least one pair of the contacts of the two contact interfaces with the same circuit are arranged reversely, at least one pair of the contacts of the two contact interfaces with the same circuit are electrically connected together, and the two contact interfaces are electrically connected to the transmission medium and electrically connected to the two terminal sets of the first duplex electrical connection plug; wherein the insulated seat is provided with vertically stacked upper and lower bases, the upper and lower bases are respectively embedded with, injection molded with and fixed to the two rows of terminals, a middle between the upper and lower bases is provided with a transversally extending metal partition plate, the metal partition plate separates the two rows of terminals from each other, and the heights of the two contact interface substrates are the same and are smaller than a height of a fitting interface substrate of the biased electrical connection plug having the minimum height specification of 0.9 mm specified by USB Association and larger than or equal to 0.65 mm; wherein the fitting portion can be bidirectionally inserted into a connection slot of a second duplex electrical connection socket, the connection slot is formed by a metal housing, a tongue is disposed at a middle height of the connection slot of the duplex electrical connection socket, upper and lower connection surfaces of the tongue form symmetrical two spaces, the heights of the two contact interface substrates of the second duplex electrical connection plug can be fit with the two spaces of the two connection surfaces of the tongue, and the fitting space is fit with the tongue.

2. The electronic device according to claim 1, wherein the first duplex electrical connection plug satisfies one of (a) to (e) or a combination of more than one of (a) to (e):

(a) wherein a total height of the docking structure is smaller than a total height obtained by adding a height of the fitting slot and a double of a height of the fitting interface substrate of the biased electrical connection plug having the minimum height specification specified by USB Association;

(b) wherein the at least one connection surface is projectingly provided with one front row of contacts and one rear row of contacts, the two rows of contacts are elastically movable up and down, and at least one row of contacts of the two rows of contacts are the contacts of the terminal set;

(c) wherein the terminal sets comprise two terminal sets, the contacts of the terminals of the two terminal sets respectively project beyond the two connection surfaces, the base seat of the insulated seat is provided with a first base seat and a second base seat stacked together, and the two terminal sets are respectively embedded into, injection molded with and fixedly disposed on the first and second base seats, wherein the first base seat and one terminal set of the two terminal sets form a first combination, the second base seat and the other terminal set of the two terminal sets form a second combination, and the first combination and the second combination are mutually stacked together to form the total combination;

(d) wherein the one or multiple elastic movement spaces of the connection plate have one or multiple bottom surfaces separated from the metal housing; and (e) wherein a middle of the base seat of the insulated seat is provided with a metal partition plate, and the metal partition plate separates the two terminal sets.

3. The electronic device according to claim 1, wherein the first duplex electrical connection plug is provided with a circuit board, the circuit board is electrically connected to the transmission medium and the two contact interfaces of the first duplex electrical connection plug, the second duplex electrical connection plug is provided with a circuit board, and the circuit board is electrically connected to the transmission medium and the two contact interfaces of the second duplex electrical connection plug.

4. The electronic device according to claim 3, wherein:

the circuit board of the first duplex electrical connection plug and/or the circuit board of the second duplex electrical connection plug is provided with a circuit safety protection device, the circuit safety protection device is provided with at least one of a signal circuit processing control element, an anti-backflow or anti-short-circuit or circuit safety protection element and a safety circuit configuration means, the circuit safety protection device is electrically connected to the two contact interfaces, and the circuit safety protection device ensures appropriate circuit safety protection when at least one pair of the contacts or at least one pair of the contacts the two contact interfaces with the same circuit are electrically connected together; or the circuit board of the first duplex electrical connection plug and/or the circuit board of the second duplex electrical connection plug is provided with a connection point switching device, the connection point switching device is electrically connected to the two contact interfaces, and the connection point switching device can switch corresponding circuit connection point transmission when the two contact interfaces are bidirectionally electrically connected together.

5. The electronic device according to claim 3, wherein in each of the two contact interfaces of the first duplex electrical connection plug and/or the second duplex electrical connection plug:

one pair of contacts of the same ground circuit are electrically connected together and one pair of contacts of the same power circuit are electrically connected together; or each of multiple pairs of contacts of all the same circuits are electrically connected together.

6. The electronic device according to claim 1 satisfying one of (a) to (k) or a combination of more than one of (a) to (k):

(a) wherein each of two fitting gaps between the two contact interface substrates of the first duplex electrical connection plug and an upper surface and a lower surface of the connection slot of the first duplex electrical connection socket is smaller than 0.15 mm to form tight fitting; and/or each of two fitting gaps between the two contact interface substrates of the second duplex electrical connection plug and an upper surface and a lower surface of the connection slot of the second duplex electrical connection socket is smaller than 0.15 mm to form tight fitting;

(b) wherein the transmission medium is a circuit board or an electrical connection cable;

(c) wherein each of the two connection surfaces of the tongue of each of the first and second duplex electrical connection sockets is provided with a contact interface, and the two contact interfaces of the first and second duplex electrical connection plugs are respectively electrically connected to the two contact interfaces of the first and second duplex electrical connection sockets;

(d) wherein each of the two contact interfaces of the first duplex electrical connection plug and/or the second duplex electrical connection plug is provided with two pairs of signal contacts RX+, RX− and TX+, TX−, and the four pairs of signal contacts are individually electrically connected to individually signal transmission circuits;

(e) wherein top and bottom surfaces of the metal housing perpendicularly corresponding to the two connection surfaces of the first duplex electrical connection socket and/or the second duplex electrical connection socket are hole-free structures;

(f) wherein top and bottom surfaces of the metal housing perpendicularly corresponding to the two contact interface substrates of the first duplex electrical connection plug and/or the second duplex electrical connection plug are hole-free structures;

(g) wherein each of left and right sides of the connection slot of the first duplex electrical connection socket and/or the second duplex electrical connection socket is provided with a metallic engaging structure, each of left and right sides of the connection slot (fitting space) of the first duplex electrical connection plug and/or the second duplex electrical connection plug is provided with a metallic engaging structure, the engaging structure of the first duplex electrical connection plug and/or the second duplex electrical connection plug engages with the engaging structure of the first duplex electrical connection socket and/or the second duplex electrical connection socket to prevent the first/second duplex electrical connection socket and the first/second duplex electrical connection plug from separating from each other in a direction opposite to a docking direction;

(h) wherein each of the two contact interfaces of the first duplex electrical connection plug and/or the second duplex electrical connection plug comprises one pair of D+, D− signal contacts, the two D+ signal contacts of the two contact interfaces are electrically connected together and the two D− signal contacts are electrically connected together;

(i) wherein the upper and lower bases of the insulated seat of the second duplex electrical connection plug are respectively integrally connected to the two contact interface substrates, and the two contact interface substrates are respectively embedded with, injection molded with and fixed to the two rows of terminals;

(j) wherein the front and rear rows of contacts of the second duplex electrical connection plug are only connected to the one row of pins; and (k) wherein each of two fitting gaps left after the two spaces of the first duplex electrical connection socket are respectively fit with the two contact interface substrates of the first duplex electrical connection plug is smaller than 0.15 mm; and/or each of two fitting gaps left after the two spaces of the second duplex electrical connection socket are respectively fit with the two contact interface substrates of the second duplex electrical connection plug is smaller than 0.15 mm.

7. The electronic device according to claim 1 being one of (a) to (d) or a combination of more than one of (a) to (d):

(a) wherein each of the two insulating layers of the two contact interface substrates of the second duplex electrical connection plug is provided with a transversal front-rear isolating region to separate the front and rear rows of contacts;

(b) wherein each of the front and rear rows of contacts of the second duplex electrical connection plug is provided with at least one ground contact, the front row of contacts are connected to at least one fixing portion, the at least one fixing portion extends to and is positioned at the contact interface substrate, and the fixing portions of one row of terminals provided with the rear row of contacts extend to and are positioned at the insulated seat;

(c) wherein the contact interface substrate of the second duplex electrical connection plug and the insulated seat are integrally formed, and the two contact interface substrates are provided with a separating structure corresponding to the rear row of contacts, so that the rear row of contacts do not touch the metal housing when being elastically moved up and down; and (d) wherein each of the two contact interface substrates of the second duplex electrical connection plug is provided with a depressed elastic movement space, one row of terminals forming the rear row of contacts are elastically movable up and down in the elastic movement space, and the insulating layer is provided with a bottom surface, separated from the metal housing, in the elastic movement space.

8. An electronic device, comprising:

a transmission medium;

a first duplex electrical connection plug comprising: an insulated seat, wherein the insulated seat is provided with a base seat and a docking part fitting with each other, the docking part is provided with two connection plates facing each other in a vertical direction and is provided with two side plates connected to the two connection plates to form a fitting frame body, each of opposite surfaces of the two connection plates is provided with a connection surface, and a connection slot is formed between the two connection surfaces, wherein at least one of the connection plates is provided with one or multiple elastic movement spaces much more depressed than the connection surface, and a rear end of the docking part is fitted with and positioned at a front end of the base seat; two terminal sets disposed in the insulated seat, wherein each of the terminal sets is provided with at least one row of terminals, the terminal is provided with a fixing portion and an extension, the fixing portion is fixed to the base seat, the extension is directly connected to a front end of the fixing portion, the fixing portion is directly fixed to the base seat and the extension extends out of the front end of the base seat, wherein after the two terminal sets are fixed to and combined with the base seat to form a total combination, the base seat is fitted with and positioned at the docking part, so that the docking part can be independently fitted with and positioned at, or separated from the total combination, wherein the extension is elastically movable up and down relatively to the docking part, the extension extends to the one or multiple elastic movement spaces of one of the connection surfaces and is provided with a contact projecting beyond the connection surface, the contact is elastically movable up and down, and the contacts of the terminals of each of the terminal sets project from the one of the connection surfaces to the connection slot to form a contact interface, the total combination comprises the two terminal sets and the base seat combined together, and the two terminal sets are electrically connected to the transmission medium; and a metal housing covering the insulated seat and provided with a four-sided primary housing, wherein the four-sided primary housing shields the docking part to form a docking structure, the metal housing and the two connection plates form two contact interface substrates, and the contact interface substrate has a height, which is a perpendicular distance from an outer surface of the metal housing to the connection surface, wherein the heights of the two contact interface substrates are smaller than a height of a fitting interface substrate of a biased electrical connection plug having a minimum height specification of 0.9 mm specified by USB Association and larger than or equal to 0.65 mm; wherein the docking structure can be bidirectionally inserted into a connection slot of a first duplex electrical connection socket, the connection slot is formed by a metal housing, a tongue is disposed at a middle height of the connection slot of the first duplex electrical connection socket, upper and lower connection surfaces of the tongue form symmetrical two spaces, the heights of the two contact interface substrates of the first duplex electrical connection plug can be fit with the two spaces of the two connection surfaces of the tongue, and the connection slot of the first duplex electrical connection plug is fit with the tongue; and a second duplex electrical connection plug comprising: an insulated seat; a metal housing covering the insulated seat; and a fitting portion provided on one end of the insulated seat, wherein the fitting portion is provided with two contact interface substrates, which have the same height and face each other, and a fitting space, each of the two contact interface substrates is provided with an insulating layer, an interval between the two contact interface substrates is the fitting space, the two contact interface substrates has two inside layers being the insulating layers and two outside layers pertaining to the metal housing, each of the two contact interface substrates is provided with a contact interface, each of the two contact interfaces comprises one row of elastically movable contacts, the two rows of elastically movable contacts are formed on two rows of terminals, the terminal is provided with a pin, a fixing portion and an extension, the fixing portion is fixed to the insulated seat, the extension is connected to one end of the fixing portion, extends to the contact interface substrate and is provided with the contact, the pin is connected to the other end of the fixing portion, at least one pair of the contacts of the two contact interfaces with the same circuit are arranged reversely, each of the two rows of contacts is provided with two pairs of signal contacts RX+, RX− and TX+, TX−, the four pairs of signal contacts are individually electrically connected to individually signal transmission circuits, and the two contact interfaces are electrically connected to the transmission medium and are electrically connected to the two terminal sets of the first duplex electrical connection plug; wherein the insulated seat is provided with vertically stacked upper and lower bases, the upper and lower bases are respectively embedded with, injection molded with and fixed to the two rows of terminals, a middle between the upper and lower bases is provided with a transversally extending metal partition plate, the metal partition plate separates the two rows of terminals from each other, the heights of the two contact interface substrates are the same and are smaller than a height of a fitting interface substrate of the biased electrical connection plug having the minimum height specification of 0.9 mm specified by USB Association and larger than or equal to 0.65 mm; wherein the fitting portion can be bidirectionally inserted into a connection slot of a second duplex electrical connection socket, the connection slot is formed by a metal housing, a tongue is disposed at a middle height of the connection slot of the second duplex electrical connection socket, upper and lower connection surfaces of the tongue form symmetrical two spaces, the heights of the two contact interface substrates of the second duplex electrical connection plug can be fit with the two spaces of the two connection surfaces of the tongue, and the fitting space is fit with the tongue.

9. The electronic device according to claim 8, wherein the first duplex electrical connection plug satisfies one of (a) to (e) or a combination of more than one of (a) to (e):

(a) wherein a total height of the docking structure is smaller than a total height obtained by adding a height of the fitting slot and a double of a height of the fitting interface substrate of the biased electrical connection plug having the minimum height specification specified by USB Association;

(b) wherein the at least one connection surface is projectingly provided with one front row of contacts and one rear row of contacts, the two rows of contacts are elastically movable up and down, and at least one row of contacts of the two rows of contacts are the contacts of the terminal set;

(c) wherein the terminal sets comprise two terminal sets, the contacts of the terminals of the two terminal sets respectively project beyond the two connection surfaces, the base seat of the insulated seat is provided with a first base seat and a second base seat stacked together, and the two terminal sets are respectively embedded into, injection molded with and fixedly disposed on the first and second base seats, wherein the first base seat and one terminal set of the two terminal sets form a first combination, the second base seat and the other terminal set of the two terminal sets form a second combination, and the first combination and the second combination are mutually stacked together to form the total combination;

(d) wherein the one or multiple elastic movement spaces of the connection plate have one or multiple bottom surfaces separated from the metal housing; and (e) wherein a middle of the base seat of the insulated seat is provided with a metal partition plate, and the metal partition plate separates the two terminal sets.

10. The electronic device according to claim 8, wherein the first duplex electrical connection plug is provided with a circuit board, the circuit board is electrically connected to the transmission medium and the two contact interfaces of the first duplex electrical connection plug, the second duplex electrical connection plug is provided with a circuit board, and the circuit board is electrically connected to the transmission medium and the two contact interfaces of the second duplex electrical connection plug.

11. The electronic device according to claim 10, wherein:

the circuit board of the first duplex electrical connection plug and/or the circuit board of the second duplex electrical connection plug is provided with a circuit safety protection device, the circuit safety protection device is provided with at least one of a signal circuit processing control element, an anti-backflow or anti-short-circuit or circuit safety protection element and a safety circuit configuration means, the circuit safety protection device is electrically connected to the two contact interfaces, and the circuit safety protection device ensures appropriate circuit safety protection when at least one pair of the contacts or at least one pair of the contacts the two contact interfaces with the same circuit are electrically connected together; or the circuit board of the first duplex electrical connection plug and/or the circuit board of the second duplex electrical connection plug is provided with a connection point switching device, the connection point switching device is electrically connected to the two contact interfaces, and the connection point switching device can switch corresponding circuit connection point transmission when the two contact interfaces are bidirectionally electrically connected together.

12. The electronic device according to claim 10, wherein in each of the two contact interfaces of the first duplex electrical connection plug and/or the second duplex electrical connection plug:

one pair of contacts of the same ground circuit are electrically connected together and one pair of contacts of the same power circuit are electrically connected together; or each of multiple pairs of contacts of all the same circuits are electrically connected together.

13. The electronic device according to claim 8 satisfying one of (a) to (k) or a combination of more than one of (a) to (k):

(a) wherein each of two fitting gaps between the two contact interface substrates of the first duplex electrical connection plug and an upper surface and a lower surface of the connection slot of the first duplex electrical connection socket is smaller than 0.15 mm to form tight fitting; and/or each of two fitting gaps between the two contact interface substrates of the second duplex electrical connection plug and an upper surface and a lower surface of the connection slot of the second duplex electrical connection socket is smaller than 0.15 mm to form tight fitting;

(b) wherein the transmission medium is a circuit board or an electrical connection cable;

(c) wherein each of the two connection surfaces of the tongue of each of the first and second duplex electrical connection sockets is provided with a contact interface, and the two contact interfaces of the first and second duplex electrical connection plugs are respectively electrically connected to the two contact interfaces of the first and second duplex electrical connection sockets;

(d) wherein each of the two contact interfaces of the first duplex electrical connection plug is provided with two pairs of signal contacts RX+, RX− and TX+, TX−, and the four pairs of signal contacts are individually electrically connected to individually signal transmission circuits;

(e) wherein top and bottom surfaces of the metal housing perpendicularly corresponding to the two connection surfaces of the first duplex electrical connection socket and/or the second duplex electrical connection socket are hole-free structures;

(f) wherein top and bottom surfaces of the metal housing perpendicularly corresponding to the two contact interface substrates of the first duplex electrical connection plug and/or the second duplex electrical connection plug are hole-free structures;

(g) wherein each of left and right sides of the connection slot of the first duplex electrical connection socket and/or the second duplex electrical connection socket is provided with a metallic engaging structure, each of left and right sides of the connection slot (fitting space) of the first duplex electrical connection plug and/or the second duplex electrical connection plug is provided with a metallic engaging structure, the engaging structure of the first duplex electrical connection plug and/or the second duplex electrical connection plug engages with the engaging structure of the first duplex electrical connection socket and/or the second duplex electrical connection socket to prevent the first/second duplex electrical connection socket and the first/second duplex electrical connection plug from separating from each other in a direction opposite to a docking direction;

(h) wherein each of the two contact interfaces of the first duplex electrical connection plug and/or the second duplex electrical connection plug comprises one pair of D+, D− signal contacts, the two D+ signal contacts of the two contact interfaces are electrically connected together and the two D− signal contacts are electrically connected together;

(i) wherein the upper and lower bases of the insulated seat of the second duplex electrical connection plug are respectively integrally connected to the two contact interface substrates, and the two contact interface substrates are respectively embedded with, injection molded with and fixed to the two rows of terminals;

(j) wherein the front and rear rows of contacts of the second duplex electrical connection plug are only connected to the one row of pins; and (k) wherein each of two fitting gaps left after the two spaces of the first duplex electrical connection socket are respectively fit with the two contact interface substrates of the first duplex electrical connection plug is smaller than 0.15 mm; and/or each of two fitting gaps left after the two spaces of the second duplex electrical connection socket are respectively fit with the two contact interface substrates of the second duplex electrical connection plug is smaller than 0.15 mm.

14. An electronic device, comprising:

a transmission medium;

a first duplex electrical connection plug comprising: an insulated seat, wherein the insulated seat is provided with a base seat and a docking part fitting with each other, the docking part is provided with two connection plates facing each other in a vertical direction and is provided with two side plates connected to the two connection plates to form a fitting frame body, each of opposite surfaces of the two connection plates is provided with a connection surface, and a connection slot is formed between the two connection surfaces, wherein at least one of the connection plates is provided with one or multiple elastic movement spaces much more depressed than the connection surface, and a rear end of the docking part is fitted with and positioned at a front end of the base seat; two terminal sets disposed in the insulated seat, wherein each of the terminal sets is provided with at least one row of terminals, the terminal is provided with a fixing portion and an extension, the fixing portion is fixed to the base seat, the extension is directly connected to a front end of the fixing portion, the fixing portion is directly fixed to the base seat and the extension extends out of the front end of the base seat, wherein after the two terminal sets are fixed to and combined with the base seat to form a total combination, the base seat is fitted with and positioned at the docking part, so that the docking part can be independently fitted with and positioned at, or separated from the total combination, wherein the extension is elastically movable up and down relatively to the docking part, the extension extends to the one or multiple elastic movement spaces of one of the connection surfaces and is provided with a contact projecting beyond the connection surface, the contact is elastically movable up and down, and the contacts of the terminals of each of the terminal sets project from the one of the connection surfaces to the connection slot to form a contact interface, wherein the total combination comprises the at least two rows of terminals and the base seat combined together, and the two terminal sets are electrically connected to the transmission medium; and a metal housing covering the insulated seat and provided with a four-sided primary housing, wherein the four-sided primary housing shields the docking part to form a docking structure, the metal housing and the two connection plates form two contact interface substrates, and the contact interface substrate has a height, which is a perpendicular distance from an outer surface of the metal housing to the connection surface, wherein the heights of the two contact interface substrates are smaller than a height of a fitting interface substrate of a biased electrical connection plug having a minimum height specification of 0.9 mm specified by USB Association and larger than or equal to 0.65 mm; wherein the docking structure can be bidirectionally inserted into a connection slot of a first duplex electrical connection socket, the connection slot is formed by a metal housing, a tongue is disposed at a middle height of the connection slot of the first duplex electrical connection socket, upper and lower connection surfaces of the tongue form symmetrical two spaces, the heights of the two contact interface substrates of the first duplex electrical connection plug can be fit with the two spaces of the two connection surfaces of the tongue, and the connection slot of the first duplex electrical connection plug is fit with the tongue; and a duplex electrical connection structure provided with an insulated seat, wherein a front end of the insulated seat is provided with a connection portion, the connection portion is provided with upper and lower connection surfaces, each of the two connection surfaces is provided with a contact interface, each of the two contact interfaces comprises one row of contacts, the two rows of contacts of the two contact interfaces are formed on one row of terminals, the two rows of terminals are fixed to the insulated seat, a shape of the connection portion can be bidirectionally docked with and positioned at a docking electrical connector, at least one pair of the contacts of the two contact interfaces with the same circuit are arranged reversely and at least one pair of the contacts of the two contact interfaces with the same circuit electrically connected together, and the two contact interfaces are electrically connected to the transmission medium and thus electrically connected to the two contact interfaces of the first duplex electrical connection plug.

15. The electronic device according to claim 14, wherein the first duplex electrical connection plug satisfies one of (a) to (e) or a combination of more than one of (a) to (e):

(a) wherein a total height of the docking structure is smaller than a total height obtained by adding a height of the fitting slot and a double of a height of the fitting interface substrate of the biased electrical connection plug having the minimum height specification specified by USB Association;

(b) wherein the at least one connection surface is projectingly provided with one front row of contacts and one rear row of contacts, the two rows of contacts are elastically movable up and down, and at least one row of contacts of the two rows of contacts are the contacts of the terminal set;

(c) wherein the terminal sets comprise two terminal sets, the contacts of the terminals of the two terminal sets respectively project beyond the two connection surfaces, the base seat of the insulated seat is provided with a first base seat and a second base seat stacked together, and the two terminal sets are respectively embedded into, injection molded with and fixedly disposed on the first and second base seats, wherein the first base seat and one terminal set of the two terminal sets form a first combination, the second base seat and the other terminal set of the two terminal sets form a second combination, and the first combination and the second combination are mutually stacked together to form the total combination;

(d) wherein the one or multiple elastic movement spaces of the connection plate have one or multiple bottom surfaces separated from the metal housing; and (e) wherein a middle of the base seat of the insulated seat is provided with a metal partition plate, and the metal partition plate separates the two terminal sets.

16. The electronic device according to claim 14, wherein the first duplex electrical connection plug is provided with a circuit board, the circuit board is electrically connected to the transmission medium and the two contact interfaces of the first duplex electrical connection plug, the duplex electrical connection structure is provided with a circuit board, and the circuit board is electrically connected to the transmission medium and the two contact interfaces of the duplex electrical connection structure.

17. The electronic device according to claim 16, wherein:

the circuit board of the first duplex electrical connection plug and/or the circuit board of the duplex electrical connection structure is provided with a circuit safety protection device, the circuit safety protection device is provided with at least one of a signal circuit processing control element, an anti-backflow or anti-short-circuit or circuit safety protection element and a safety circuit configuration means, the circuit safety protection device is electrically connected to the two contact interfaces, and the circuit safety protection device ensures appropriate circuit safety protection when at least one pair of the contacts or at least one pair of the contacts the two contact interfaces with the same circuit are electrically connected together; or the circuit board of the first duplex electrical connection plug and/or the circuit board of the duplex electrical connection structure is provided with a connection point switching device, the connection point switching device is electrically connected to the two contact interfaces, and the connection point switching device can switch corresponding circuit connection point transmission when the two contact interfaces are bidirectionally electrically connected together.

18. The electronic device according to claim 16, wherein in each of the two contact interfaces of the first duplex electrical connection plug and/or the duplex electrical connection structure:

one pair of contacts of the same ground circuit are electrically connected together and one pair of contacts of the same power circuit are electrically connected together; or each of multiple pairs of contacts of all the same circuits are electrically connected together.

19. The electronic device according to claim 14, wherein the duplex electrical connection structure is a second duplex electrical connection plug provided with a metal housing covering the insulated seat, the connection portion is a fitting portion, the fitting portion is provided with two contact interface substrates, which have the same height and face each other, and a fitting space, each of the two contact interface substrates is provided with an insulating layer, an interval between the two contact interface substrates is the fitting space, the two contact interface substrates has two inside layers being the insulating layers and two outside layers pertaining to the metal housing, two opposite surfaces of the two contact interface substrates are the two connection surfaces, the terminal is provided with a pin, a fixing portion and an extension, the fixing portion is fixed to the insulated seat, the extension is connected to one end of the fixing portion, extends to the contact interface substrate and is provided with the contact, and the pin is connected to the other end of the fixing portion, wherein top and bottom surfaces of the metal housing perpendicularly corresponding to the two contact interface substrates are hole-free structures, each of left and right sides of the fitting space is provided with a metallic engaging structure, and the heights of the two contact interface substrates are the same and are smaller than a height of a fitting interface substrate of the biased electrical connection plug having the minimum height specification of 0.9 mm specified by USB Association and larger than or equal to 0.65 mm; wherein the fitting portion can be bidirectionally inserted into a connection slot of a second duplex electrical connection socket, the connection slot is formed by a metal housing, a tongue is disposed at a middle height of the connection slot of the second duplex electrical connection socket, upper and lower connection surfaces of the tongue form symmetrical two spaces, the heights of the two contact interface substrates of the second duplex electrical connection plug can be fit with the two spaces of the two connection surfaces of the tongue, the fitting space is fit with the tongue, the engaging structure of the second duplex electrical connection plug engages with an engaging structure of the second duplex electrical connection socket to prevent the second duplex electrical connection socket and the second duplex electrical connection plug from separating from each other in a direction opposite to a docking direction.

20. The electronic device according to claim 19 satisfying one of (a) to (l) or a combination of more than one of (a) to (l):

(a) wherein each of two fitting gaps between the two contact interface substrates of the first duplex electrical connection plug and an upper surface and a lower surface of the connection slot of the first duplex electrical connection socket is smaller than 0.15 mm to form tight fitting; and/or each of two fitting gaps between the two contact interface substrates of the second duplex electrical connection plug and an upper surface and a lower surface of the connection slot of the second duplex electrical connection socket is smaller than 0.15 mm to form tight fitting;

(b) wherein the transmission medium is a circuit board or an electrical connection cable;

(c) wherein each of the two connection surfaces of the tongue of each of the first and second duplex electrical connection sockets is provided with a contact interface, and the two contact interfaces of the first and second duplex electrical connection plugs are respectively electrically connected to the two contact interfaces of the first and second duplex electrical connection sockets;

(d) wherein each of the two contact interfaces of the first duplex electrical connection plug is provided with two pairs of signal contacts RX+, RX− and TX+, TX−, and the four pairs of signal contacts are individually electrically connected to individually signal transmission circuits;

(e) wherein top and bottom surfaces of the metal housing perpendicularly corresponding to the two connection surfaces of the first duplex electrical connection socket and/or the second duplex electrical connection socket are hole-free structures;

(f) wherein top and bottom surfaces of the metal housing perpendicularly corresponding to the two contact interface substrates of the first duplex electrical connection plug are hole-free structures;

(g) wherein each of left and right sides of the connection slot of the first duplex electrical connection socket is provided with a metallic engaging structure, each of left and right sides of the connection slot of the first duplex electrical connection plug is provided with a metallic engaging structure, the engaging structure of the first duplex electrical connection plug engages with the engaging structure of the first duplex electrical connection socket to prevent the first duplex electrical connection socket and the first duplex electrical connection plug from separating from each other in a direction opposite to a docking direction;

(h) wherein each of the two contact interfaces of the first duplex electrical connection plug and/or the second duplex electrical connection plug comprises one pair of D+, D− signal contacts, the two D+ signal contacts of the two contact interfaces are electrically connected together and the two D− signal contacts are electrically connected together;

(i) wherein the insulated seat of the second duplex electrical connection plug has upper and lower bases, which are stacked vertically and respectively integrally connected to the two contact interface substrates, and the two contact interface substrates are respectively embedded with, injection molded with and fixed to the two rows of terminals;

(j) wherein the front and rear rows of contacts of the second duplex electrical connection plug are only connected to the one row of pins;

(k) wherein the insulated seat of the second duplex electrical connection plug is provided with vertically stacked upper and lower bases, the upper and lower bases are respectively embedded with, injection molded with and fixed to the two rows of terminals, a middle between the upper and lower bases is provided with a transversally extending metal partition plate, and the metal partition plate separates the two rows of terminals; and (l) wherein each of two fitting gaps left after the two spaces of the first duplex electrical connection socket are respectively fit with the two contact interface substrates of the first duplex electrical connection plug is smaller than 0.15 mm; and/or each of two fitting gaps left after the two spaces of the second duplex electrical connection socket are respectively fit with the two contact interface substrates of the second duplex electrical connection plug is smaller than 0.15 mm.

21. The electronic device according to claim 14 satisfying one of (a) to (d) or a combination of more than one of (a) to (d):

(a) wherein each of two fitting gaps between the two contact interface substrates of the first duplex electrical connection plug and an upper surface and a lower surface of the connection slot of the first duplex electrical connection socket is smaller than 0.15 mm to form tight fitting;

(b) wherein the transmission medium is a circuit board or an electrical connection cable;

(c) wherein the insulated seat of the duplex electrical connection structure is provided with vertically stacked upper and lower bases, the upper and lower bases are respectively embedded with, injection molded with and fixed to the two rows of terminals, a middle between the upper and lower bases is provided with a transversally extending metal partition plate, and the metal partition plate separates the two rows of terminals; and (d) wherein each of two fitting gaps left after the two spaces of the first duplex electrical connection socket are respectively fit with the two contact interface substrates of the first duplex electrical connection plug is smaller than 0.15 mm.

22. The electronic device according to claim 14, wherein the duplex electrical connection structure is a second duplex electrical connection plug, and a structure of the second duplex electrical connection plug is the same as a structure of the first duplex electrical connection plug.

23. The electronic device according to claim 14, wherein the duplex electrical connection structure is the first duplex electrical connection socket, the connection portion is the tongue, the two rows of contacts are formed on two rows of terminals, the terminal is provided with a pin, a fixing portion and an extension, the fixing portion is fixed to the insulated seat, the extension is connected to one end of the fixing portion, extends to the tongue and is provided with the contact, the pin is connected to the other end of the fixing portion and electrically connected to the circuit board, the tongue is disposed at a middle height of the connection slot, the two connection surfaces of the tongue form symmetrical two spaces, and heights of the two spaces of the two connection surfaces are smaller than a large space of 0.97 mm of the connection slot of a standard electrical connection socket having a minimum height specification specified by USB Association and greater than 0.65 mm, wherein the electronic device satisfies one of (a) to (h) or a combination of more than one of (a) to (h):

(a) wherein each of the two rows of contacts of the first duplex electrical connection socket are provided with two pairs of signal contacts RX+, RX− and TX+, TX−, the four pairs of signal contacts are individually electrically connected to individually signal transmission circuits, and the two rows of contacts are in flat surface contact with the tongue and are elastically non-movable;

(b) wherein top and bottom surfaces of the metal housing perpendicularly corresponding to the two connection surfaces of the first duplex electrical connection socket are hole-free structures;

(c) wherein each of left and right sides of the connection slot of the first duplex electrical connection socket is provided with a metallic engaging structure, the engaging structure engages with an engaging structure of the docking electrical connector to prevent the first duplex electrical connection socket and the docking electrical connector from separating from each other in a direction opposite to a docking direction;

(d) wherein each of the two rows of contacts of the first duplex electrical connection socket comprises at least seven contacts and provided with only one pair of D+, D− signal contacts, wherein the two D+ signal contacts are electrically connected together and the two D− signal contacts are electrically connected together;

(e) wherein each of the two contact interfaces of the first duplex electrical connection socket is provided with multiple contacts disposed in a front-low and rear-high manner, and the multiple contacts comprise the one row of contacts, which are in flat surface contact with the tongue and are elastically non-movable;

(f) wherein the insulated seat of the first duplex electrical connection socket are vertically stacked upper and lower bases, and the upper and lower bases are respectively embedded with, injection molded with and fixed to the two rows of terminals;

(g) wherein the insulated seat of the first duplex electrical connection socket are vertically stacked upper and lower bases, the upper base is integrally provided with an upper segment of the tongue, the lower base is integrally provided with a lower segment of the tongue, and the upper and lower segments of the tongue are respectively embedded with, injection molded with and fixed to the two rows of terminals; and (h) wherein the insulated seat of the first duplex electrical connection socket are vertically stacked upper and lower bases, the upper base is integrally provided with an upper segment of the tongue, the lower base is integrally provided with a lower segment of the tongue, the upper and lower segments of the tongue are respectively embedded with, injection molded with and fixed to the two rows of terminals, an inner section of the extension of the terminal is embedded with, injection molded with and fixed to an inner section of the tongue, an outer section of the extension is embedded with, injection molded with and fixed to the outer section of the tongue to expose outer sections of the two connection surfaces, and the outer section of the extension is provided with the contact.

* * * * *